US006355210B1

(12) United States Patent
Hirabayashi

(10) Patent No.: US 6,355,210 B1
(45) Date of Patent: Mar. 12, 2002

(54) POWDER-COMPACTING METHOD AND APPARATUS

(75) Inventor: Yasuyuki Hirabayashi, 1-3-5 Shinei, Narashino, Chiba, 275-0005 (JP)

(73) Assignees: Yasuyuki Hirabayashi, Chiba; Takako Industries, Inc., Osaka, both of (JP)

( * ) Notice: Subject to any disclaimer, the term of this patent is extended or adjusted under 35 U.S.C. 154(b) by 0 days.

(21) Appl. No.: 09/942,917

(22) Filed: Aug. 31, 2001

(30) Foreign Application Priority Data

Sep. 11, 2000 (JP) ..... 2000-274893

(51) Int. Cl.[7] ..... B22F 3/02
(52) U.S. Cl. ..... 419/38; 425/78
(58) Field of Search ..... 419/38; 425/78

(56) References Cited

U.S. PATENT DOCUMENTS 3,794,215 A * 2/1974 Osterhaus ..... 222/1
5,449,481 A * 9/1995 Sagawa et al. ..... 264/123

* cited by examiner

*Primary Examiner*—Daniel J. Jenkins
(74) *Attorney, Agent, or Firm*—Stevens, Davis, Miller & Mosher, LLP

(57) ABSTRACT

An improved powder-compacting method and apparatus designed to require a reduce level of a pressurizing force for powder compacting by utilizing an elastomeric plate for compaction, thereby allowing powder to be compacted by means of a smaller-scaled compacting apparatus instead of a larger-scaled compacting apparatus.

24 Claims, 38 Drawing Sheets

Compression characteristics of various kinds of powder

Technique according to the present invention

Fβ=Local area⊿S×σPa

Prior art technique

Fα=Pressurized area S×σPa

Compacting pressurizing force curve during step compression

Compacting pressurizing force curve during step compression for $\phi$120 circular plate shape

POWDER-COMPACTING METHOD AND APPARATUS

BACKGROUND OF THE INVENTION

1. Field of the Invention

The present invention relates to a powder-compacting method and apparatus suited for a process in which powder (hereinafter simply called powder, which includes granulated powder containing a binder) is compacted in a manufacturing line, such as ceramics, powder metallurgy, a magnetic material in the field of electric materials, a ferrite magnet, and a rare earth magnet. More particularly, it relates to a powder-compacting technique and apparatus in which the apparatus includes a mechanism designed to sequentially apply a sufficient pressure for the powder compacting to each part of a pressurized area, while the technique includes step compression for reducing a total pressurizing force.

2. Description of the Related Art

It has heretofore been believed that powder compacting usually requires a total pressurizing force in which a sufficient pressure to obtain a target compacting density is applied to the entire compact or an area (an area of a die opening) in a direction in which the pressure is projected.

A mold for use in the powder compacting includes a die and upper-lower punches when a compact does not includes a hole in a direction in which pressure is applied. The mold is filled with powder, which is then pressurized by the upper-lower punches. The total pressurizing force is applied to an area of the powder at which the punches contact the powder.

A compact positioned in the middle of the mold after pressurization is knocked out and then thrown out of the mold by means of the lower punch. In the process of such an operation, the compact is held in frictional contact with an inner wall surface of the die under elevated pressure. As a result, a high level of discharging pressure is required during knockout. In metallic powder, there occur defects during a series of the above processes, such as scuffing adhesion between the inner wall of the die and the punches, cracks, and chip-off. In addition, other general compacts such as oxides tend to chip off, crack, and laminated-crack because of internal distortion.

In order to eliminate such defects, the die is made of an ultra-hardened alloy having good abrasion resistance to the powder, or otherwise a special film having a reduced degree of surface adhesion is applied to the die. In addition, a mold for the die must be fabricated with a high degree of precision.

It is assumed that a basic patent on the above powder compacting was initially filed in Europe nearly at the year of 1910. (See "History and Development of Powder Metallurgy" by Kimura Hisashi, issued by Agune Gijyutu Center.)

A powder compacting process under magnetic field conditions in the field of magnets is described in, e.g., "Magnetic Materials for New Era" issued by Mitokako Kakoh Gijyutu Kyoukai, second edition, 1983, and "COBALT 53", December 1971, by R. E. Johnson, A. I. M., and C. J. Fellows, on pages 191–196. In addition, the same powder compacting process has recently been filed for patent, as seen from published Japanese Patent Application Laid-Open No.3–40861.

However, similarly to the above-mentioned typical powder compacting, the prior art as given above pressurizes the die at a pressurized opening area thereof, and thus requires a similar total pressurizing force.

In an overall process for manufacturing a product in each field, a compacting process is believed to require the most important key technology that determines manufacturing cost of the product as well as a quality level of the product. The present invention provides a new key technology-based technique and apparatus to related wide fields.

The prior art powder compacting as described above has shortcomings of high energy to be supplied to an apparatus, high costs, and a large-scaled apparatus with a consequential increase in space to be occupied by such an apparatus, because a large-sized powder compact, an elongated powder compact, a plurality of powder compacts are produced by a large-scaled compacting apparatus having an increased overall pressurizing force.

In view of the above, an object of the present invention is to provide an improved powder-compacting method and apparatus designed to require a reduced level of a pressurizing force for powder compacting, thereby allowing powder to be compacted by means of a smaller-scaled compacting apparatus instead of a larger-scaled compacting apparatus.

SUMMARY OF THE INVENTION

A powder-compacting method according to the present invention comprises the steps of: filling powder to be pressurized into a molding container; and, individually pressing a plurality of pressurizing members in sequence toward the powder, the pressurizing members being aligned on a pressurized surface of the powder through an elastic plate.

According to the present invention, step compaction makes it possible to reduce a total pressurizing force required for conventional techniques, and thus allows a smaller-scaled compacting apparatus to compact the powder. As a result, a low cost apparatus is achievable.

A powder-compacting apparatus according to an aspect of the present invention comprises a molding container having a plurality of pressurizing members disposed on a bottom of the container, and further having an elastic plate disposed on the pressurizing members as a bottom surface, wherein the plurality of pressurizing members are sequentially driven to pressurize powder via the elastic plate for compacting.

A powder-compacting apparatus according to another aspect of the present invention comprises: a molding container having a bottom, the container having a powder-filled opening formed at an upper portion thereof and a wedge-inserted hole defined through a sidewall of the container; a plurality of pressurizing members aligned on a bottom plate of the molding container; an elastic plate disposed on the plurality of pressurizing members for providing a bottom surface of the powder when the powder is filled into the molding container through the powder-filled opening; a lid body for closing the powder-filled opening; and, a wedge inserted into the molding container through the wedge-inserted hole, the wedge being pushed along the bottom plate into between an inner surface of the bottom plate and the pressurizing members, thereby permitting the plurality of pressurizing members to sequentially pressurize the powder via the elastic plate for compacting.

In a powder-compacting apparatus as previously defined, at least the lid body and compacting surfaces of the pressurizing members contiguous with the elastic plate are curvilinear in shape in order to allow the compact to be formed into one of a pillar shape, substantially semi-pillar shape, substantially semi-cylindrical shape, partially cylindrical shape.

The above structure provides compacts having a wide variety of shapes.

In a powder-compacting apparatus as previously defined, the wedge includes a slanted surface for raising the pressurizing members and a planar surface continuously extending from the slanted surface for retaining the pressurizing members at a position where the pressurizing members are raised.

The above structure allows the powder to remain pressurized for a certain time. This feature prevents the occurrence of cracks in the compact.

In a powder-compacting apparatus as previously defined, the molding container has an inner peripheral surface tapered at the powder-filled opening so as to expand outward.

The above structure permits a knockout position at which the compact is discharged to be positioned adjacent to an opening of the container at the top of the die. In addition, the draft-tapered upper opening reduces a draft pressure and internal compact distortion. Such a reduction in internal compact distortion contributes toward reductions in compact chip-off, cracks, and laminated cracks, eliminates an inconvenience of scuffing on a die, which otherwise would occur in metallic powder. Moreover, the reduced internal compact distortion is believed to contribute toward reductions in quantity of binders and lubricating agents, which are required for various kinds of powder. Furthermore, in conventional techniques, the die must involve an expensive ultra-hardened alloy, a mold structure sufficient to withstand high pressure, and specific dimensional precision, with which the compact is fabricated. Meanwhile, the present invention is free from such requirements, and can employ an inexpensive mold structure.

In a powder-compacting apparatus as previously defined, the upper lid serves as a magnetic field yoke, the magnetic field yoke having a coil wound therearound in order to vertically generate a magnetic field in the molding container.

The above structure provides a simply structured magnetic field-applying apparatus.

In a powder-compacting apparatus as previously defined, a coil is trained around the molding container in order to generate a magnetic field in the molding container in a direction in which the wedge is advanced and retracted.

Such a structure provides a simply structured magnetic field-applying apparatus.

In a powder-compacting apparatus as previously defined, the molding container includes one of a plurality of the same compacting sections and a plurality of different compacting sections, and the wedge, elastic plate, and pressurizing members are provided so as to correspond with the compacting sections, the wedge having a proximal end combined together.

Such a construction further facilitates realizing a smaller-scaled apparatus.

In a powder-compacting apparatus as previously defined, the wedge has the slanted surface and the planar surface continuously extending therebetween in a stepwise manner so as to form a several stage construction.

Such a construction allows the wedge to be driven in stages, and thus allows a driving apparatus to provide a reduced level of a driving force.

In a powder-compacting apparatus as previously defined, the molding container includes a core for forming a hollow in the compact, and the pressurizing members and the wedge are both configured to avoid the core.

In a powder-compacting apparatus as previously defined, the lid body is provided with a slicer that protrudes into the molding container for dividing a compact during powder compacting.

Such a construction makes it possible to produce a plurality of compacts at one time.

In a powder-compacting apparatus as previously defined, the pressurizing member includes a plurality of concentric cylinders, the wedge including a V-shaped pointed end, the wedge having a plurality of slanted surfaces formed along an inner surface of the V-shaped pointed end for sequentially raising the pressurizing members.

In a powder-compacting apparatus as previously defined, the pressurizing member is defined with a convex surface at an upper end thereof, while the elastic member is formed with a concave surface to be engaged with the convex surface of the pressurizing member.

Such a construction alleviates a tensile force of the elastic plate.

A powder-compacting apparatus as previously defined further comprises: an upper lid-lifting apparatus for raising and lowering an upper lid for closing an upper opening of the molding container; a discharging apparatus spaced apart from the upper lid-lifting apparatus for discharging a compact out of the molding container; a delivering means for reciprocably delivering the molding container between the upper lid-lifting apparatus and the discharging apparatus; a filling apparatus disposed between the upper lid-lifting apparatus and the discharging apparatus for filling the next pack of powder to be compacted into the molding container through the upper opening of the molding container after the discharging apparatus discharges the compact out of the molding container; and, a wedge-driving means for permitting a wedge for sequentially driving the pressurizing members to be inserted into the molding container after the upper lid-lifting apparatus closes the upper opening of the molding container.

Such a construction provides a simplified structure of the entire apparatus.

In a powder-compacting apparatus as previously defined, the wedge-driving means moves the wedge in a direction identical to a direction in which the molding container is moved.

Such a construction allows all of the apparatus to be aligned on a line, and a simplified space is available.

A powder-compacting apparatus as previously defined further comprises: a driving apparatus including an upper lid for closing an upper opening of the molding container and a powder-filling apparatus for filling powder into the molding container through the upper opening, the driving apparatus permitting a combination of the upper lid and the powder-filling apparatus to be individually moved to a position above the upper opening; a wedge-driving apparatus including a wedge inserted between the pressurizing members and a bottom of the molding container for permitting the pressurizing members to pressurize the powder via the elastic plate, the wedge-driving means designed to insert and retract the wedge; and, a discharging apparatus for raising the bottom of the molding container to discharge a compact out of the molding container through the upper opening after the wedge is pulled out of the molding container, the bottom of the molding container being free to rise and lower, wherein the driving means permits a pointed end of the upper lid to push the compact to a position where a product is discharged, while causing the powder-filling apparatus to be positioned above the upper opening.

In a powder-compacting apparatus as previously defined, the wedge includes a plurality of laminated components, each of which is individually driven by a driving means.

Such a construction is able to drive the wedges with a reduced level of a driving force.

A powder-compacting apparatus as previously defined further comprises: a magnetic field coil, in which the molding container is inserted; an upper lid attachment-detachment apparatus disposed adjacent to the magnetic field coil for attaching and detaching an upper lid that closes an upper opening of the molding container; a discharging apparatus disposed on the side opposite to the upper lid attachment-detachment apparatus for discharging a compact out of the molding container; a delivering means for reciprocably delivering the molding container between the magnetic field coil and the discharging apparatus; a filling apparatus disposed between the upper lid attachment-detachment apparatus and the discharging apparatus for filling the next pack of powder to be compacted into the molding container through the upper opening of the molding container after the discharging apparatus discharges the compact out of the molding container; and, a wedge-driving means disposed on the side opposite to the upper lid attachment-detachment apparatus, the wedge-driving means including a wedge for sequentially driving the pressurizing members while the upper lid attachment-detachment apparatus closes the opening of the molding container and the molding container is positioned in the magnetic field coil, the wedge-driving means being designed to insert the wedge into the molding container.

In a powder-compacting apparatus as previously defined, the powder-compacting apparatus are aligned longitudinally and transversely, and the powder-compacting apparatus share a common material powder tank.

Such a construction allows for further downsizing of the apparatus.

In a powder-compacting apparatus as previously defined, inert gases are hermetically sealed up within the powder-compacting apparatus.

Such a construction facilitates preventing oxidation of rare earth magnet powder, and thus expects magnetic characteristics that involve a higher level of performance. In addition, a reduced amount of inert gases can be sealed with ease.

DETAILED DESCRIPTION OF THE PREFERRED EMBODIMENTS

Figure 1A:
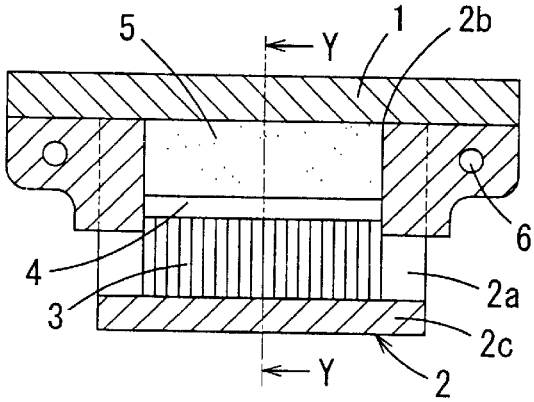
FIG. 1A is a cross-sectional view taken along line X—X of FIG. 1E, illustrating a powder-compacting apparatus according to a first embodiment of the present invention.
Figure 1B:
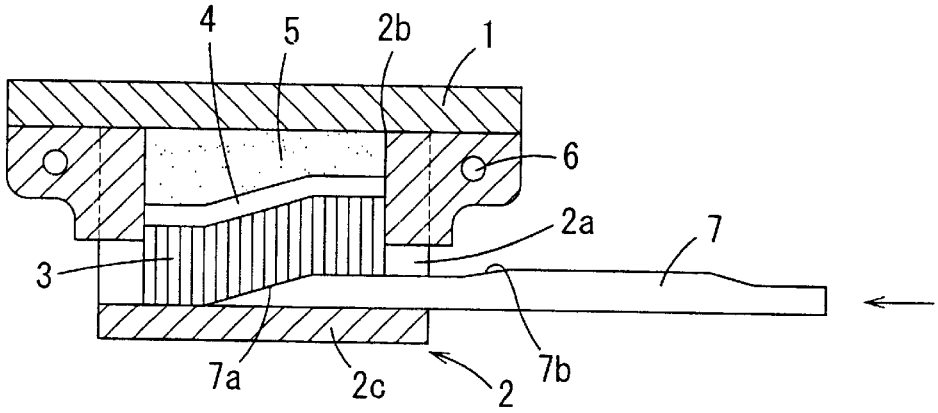
FIG. 1B is a cross-sectional view, showing the powder-compacting apparatus in which a wedge bar is inserted halfway.

A powder-compacting method and apparatus according to the present invention will now be described, in which the under-mentioned step compression reduces a total pressurizing force.

FIG. 1 illustrates an apparatus for compacting powder into a rectangular plate-shaped compact according to the step compression in typical non-magnetic field compacting according to a first embodiment of the present invention.

A die 2 having a bottom is positioned below a lid body or an upper lid 1. When the upper lid 1 is opened, then powder 5 is filled into the die 2 through an upper opening 2*b*. In the die 2, a plate-like elastic plate (e.g., an elastomeric plate 4) and a plurality of pressurizing rods 3 are disposed below the filled powder 5. The die 2 is used as a molding container for powder compacting. The elastomeric plate 4 is an elastic plate that is resiliently deformable by being pressurized by the pressurizing rods 3, and further that forms the entire essential bottom portion on which the powder 5 is placed. The elastomeric plate 4 contacts the pressurizing rods 3 through a surface that is substantially identical in shape to surfaces of the aligned pressurizing rods 3. The elastomeric plate 4 preferably withstands a pressurizing force of, e.g., 100–1000 MPa during powder compression, and preferably possesses an elongation rate to withstand tension between the elastomeric plate 4 and the sequentially raised pressurizing rods 3.

The pressurizing rods 3 are used as pressurizing members for supporting the elastic plate. The pressurizing rod 3 has a width equal to an internal width of the die. The pressurizing rods 3 are aligned in great numbers in a longitudinal direction or in a direction in which a wedge is inserted. The upper lid 1 closes the upper opening 2*b* after the die 2 is filled with the powder 5, and is then combined integrally with the die 2 by means of positioning pins 6.

A wedge bar 7 is inserted into the die 2 through a lower opening 2*a* of the die 2, and the pressurizing rods 3 are sequentially raised vertically and upwardly to sequentially compress the filled powder 5 on the elastomeric plate 4. The lower opening 2*a* is a wedge-inserted hole that is formed through a sidewall of the die 2 at a lower portion thereof. The wedge bar 7 is a wedge having two-stage slanted surfaces 7*a*, 7*b* formed toward a forward end thereof at predetermined inclined angles.

The powder-compacting method is practiced using the above apparatus. The powder-compacting method involves filling the die 2 with the powder to be pressurized, and individually pressing the pressurizing rods 3 toward the powder in sequence or in steps, which pressurizing rods 3 are arranged closely adjacent to each other on a pressurized surface or bottom surface of the filled powder through the elastomeric plate 4.

Figure 1C:
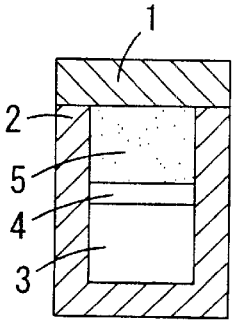
FIG. 1C is a cross-sectional view taken along line Y—Y of FIG. 1A, illustrating the powder-compacting apparatus before powder is pressurized.
Figure 1D:
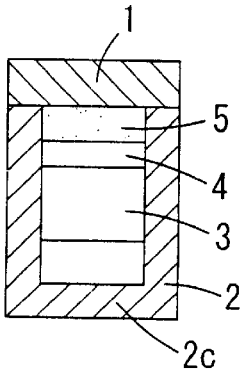
FIG. 1D is a cross-sectional view taken along line Y—Y of FIG. 1A, illustrating the powder-compacting apparatus after the powder is pressurized.
Figure 1E:
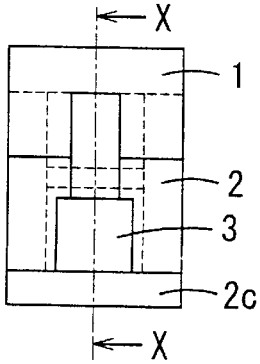
FIG. 1E is a front view, illustrating the powder-compacting apparatus.

When the wedge bar 7 inserted through the lower opening 2*a* is inserted at a pointed end thereof between a bottom plate 2*c* and the pressurizing rods 3, then the rods 3 are sequentially raised along the slanted surface 7*a*, thereby deforming the elastomeric plate 4 to press against the powder. As a result, the powder is sequentially pressed to move from a pre-pressurized position as illustrated in FIG. 1C and to a post-pressured position as shown in FIG. 1D. The powder compacting is completed when all of the rods 3 are carried on the upper surface of the wedge bar 7. At this time, the wedge bar presses part of the rods 3 using a pressing force, and the wedge bar 7 is moved by a stroke greater than when pressing the entire rods 3, but is required to provide a pressing force smaller than when pressing the entire rods 3. When the upper lid 1 is opened and then raised, then the compacted powder compact is brought out of the die 2 through the opening 2*b*. When compared with the prior art in which the compact is discharged from the die after being pressed by means of upper and lower punches, the compact is easily discharged because the powder is pressurized for compacting adjacent to the opening 2*b*, not at a central portion of the die 2.

According to the first embodiment, a reduced level of a pressurizing force is required for powder compacting. This feature allows the above-described compacting to be achieved by a smaller-scaled compacting apparatus instead of a larger-scaled compacting apparatus.

FIG. 2 illustrates a powder-compacting apparatus according to a second embodiment. More specifically, a cylindrical compact is produced, while the first embodiment provides a rectangular plate-shaped compact.

Figure 2A:
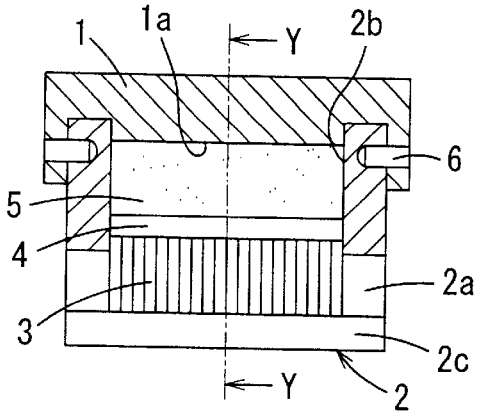
FIG. 2A is a cross-sectional view taken along line X—X of FIG. 2E, illustrating a powder-compacting apparatus according to a second embodiment.
Figure 2B:
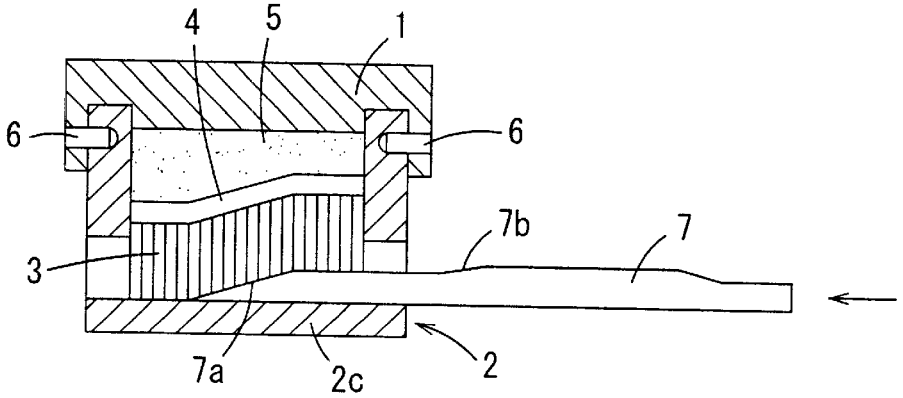
FIG. 2B is a cross-sectional view, showing the powder-compacting apparatus in which a wedge bar is inserted halfway.
Figure 2C:
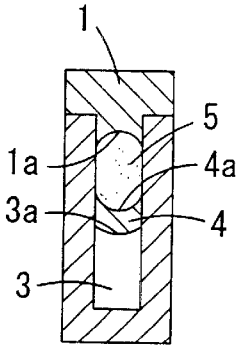
FIG. 2C is a cross-sectional view taken along line Y—Y of FIG. 2A, illustrating the powder-compacting apparatus before powder is pressurized.
Figure 2D:
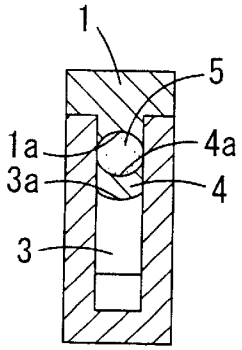
FIG. 2D is a cross-sectional view taken along line Y—Y of FIG. 2A, illustrating the powder-compacting apparatus after the powder is pressurized.
Figure 2E:
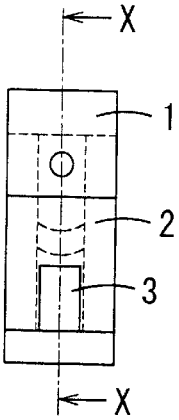
FIG. 2E is a front view, illustrating the powder-compacting apparatus.
Figure 3A:
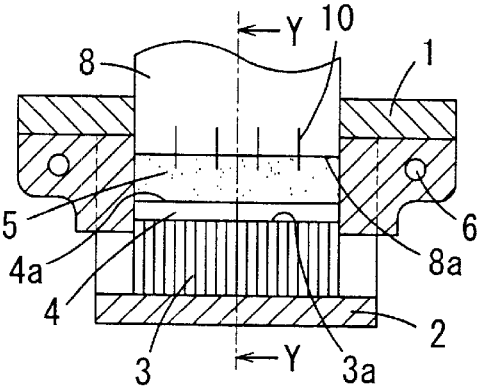
FIG. 3A is a cross-sectional view taken along line X—X of FIG. 3E, illustrating a powder-compacting apparatus according to a third embodiment.
Figure 3B:
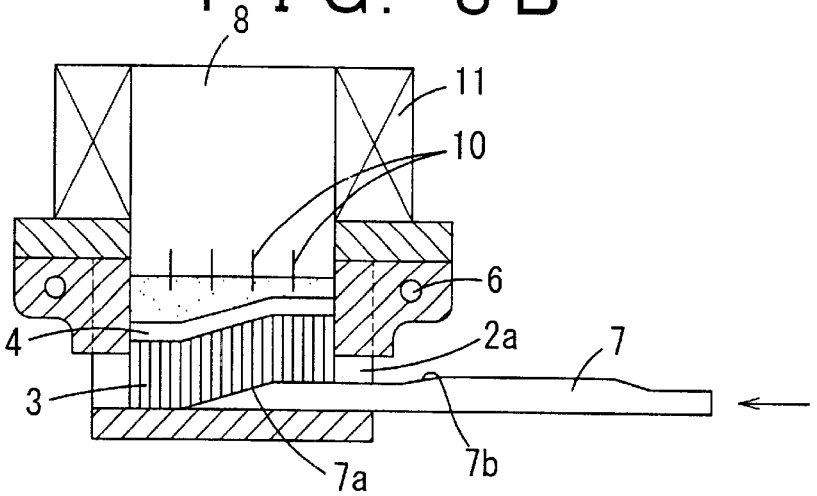
FIG. 3B is a cross-sectional view, showing the powder-compacting apparatus in which a wedge bar is inserted halfway.
Figure 3C:
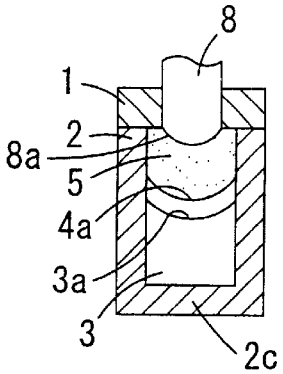
FIG. 3C is a cross-sectional view taken along line Y—Y of FIG. 3A, illustrating the powder-compacting apparatus before powder is pressurized.
Figure 3D:
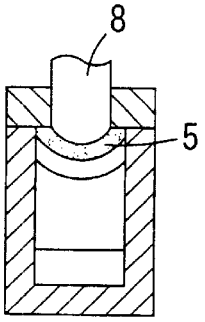
FIG. 3D is a cross-sectional view taken along line Y—Y of FIG. 3A, illustrating the powder-compacting apparatus after the powder is pressurized.
Figure 3E:
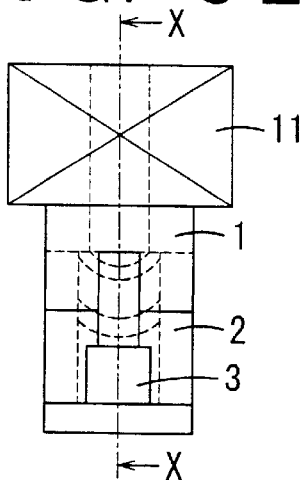
FIG. 3E is a front view, illustrating the powder-compacting apparatus.
Figure 4A:
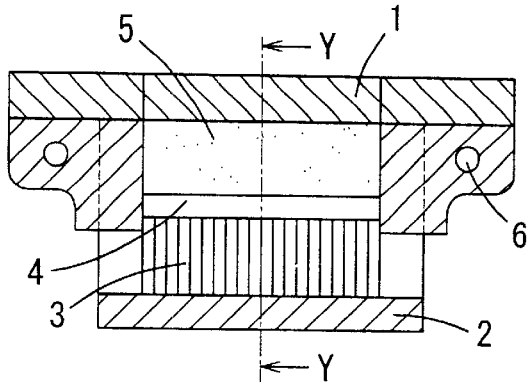
FIG. 4A is a cross-sectional view taken along line X—X of FIG. 4E, illustrating a powder-compacting apparatus according to a fourth embodiment.
Figure 4B:
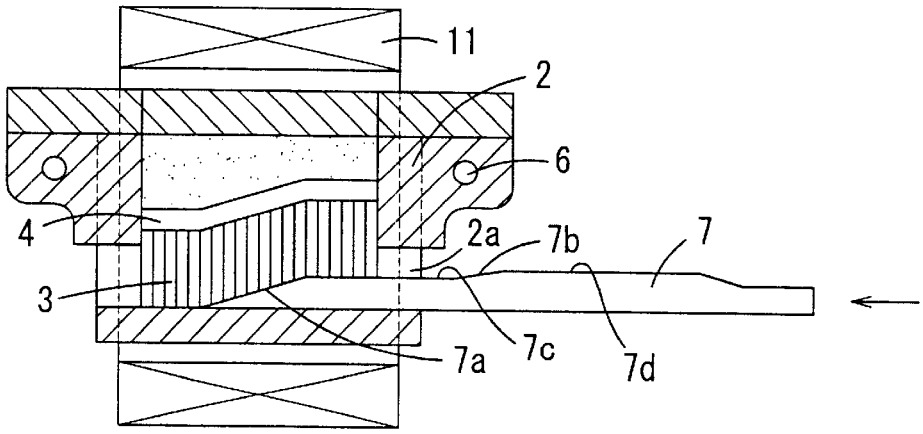
FIG. 4B is a cross-sectional view, showing the powder-compacting apparatus in which a wedge bar is inserted halfway.
Figure 4C:
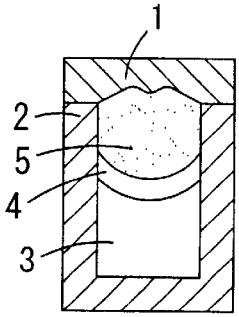
FIG. 4C is a cross-sectional view taken along line Y—Y of FIG. 4A, illustrating the powder-compacting apparatus before powder is pressurized.
Figure 4D:
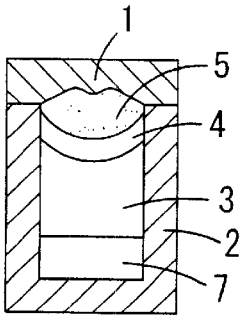
FIG. 4D is a cross-sectional view taken along line Y—Y of FIG. 4A, illustrating the powder-compacting apparatus after the powder is pressurized.
Figure 4E:
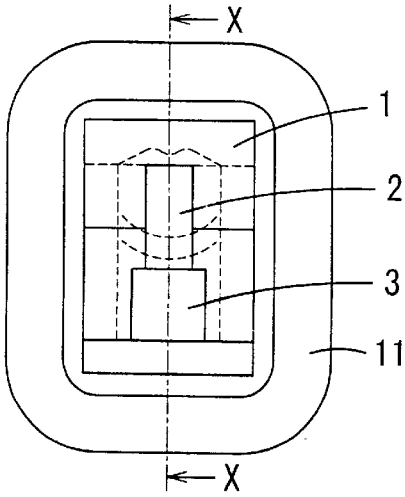
FIG. 4E is a front view, illustrating the powder-compacting apparatus.

In this case, the elastomeric plate 4 has a concave 4*a* formed on a bottom surface thereof, while the pressurizing rod 3 has a concave 3a formed on an upper surface thereof for supporting the elastomeric plate 4. The concaves 3*a*, 4*a* are arcuate or semi-circular in cross-section. The upper lid 1 has a similarly shaped concave 1*a* defined on the underside thereof. The powder is pressurized to change from a pre-pressurized state as shown in FIG. 2C to a post-pressurized state as illustrated in FIG. 2D, thereby providing a cylindrical compact. Reference numeral 6 denotes a positioning pin for positioning the upper lid 1 on the die 2. The other reference numerals are similar to those in the first embodiment.

FIG. 3 illustrates a powder-compacting apparatus according to a third embodiment. More specifically, it illustrates a compacting mold structure that includes a magnetic coil for a partial cylindrical segmented magnet for use in a motor when the powder is compacted under a magnetic field. Reference numeral 8 denotes a magnetic circuit yoke disposed through the upper lid 1 at a position where an opening of the die 2 is located. The underside of the magnetic circuit yoke 8 forms a partial cylindrical surface 8*a*, while projecting in an arcuate fashion in cross-section. A plurality of slicers 10 is disposed on the magnetic circuit yoke 8 in an axial direction thereof so as to extend outward from the underside of the yoke 8 by a predetermined amount. As illustrated in FIG. 3C, the elastomeric plate 4 and the pressurizing rods 3 are formed with concaves 4*a*, 3*a*, respectively, which are both arcuate in cross-sections. Reference numeral 11 denotes a magnetic field coil for providing the magnetic circuit yoke 8 with a magnetic field. The magnetic coil 11 is rendered magnetically conducting while the pressurized powder 5 is compacted. As a result, easy axis of magnetization axes of the pressurized powder 5 can be provided in the same direction through the magnetic circuit yoke 8. After the powder is compacted, the slicers 10 divide the compacted powder into a plurality of compacts.

FIG. 4 illustrates a powder-compacting apparatus according to a fourth embodiment. More specifically, a compacting mold is disposed inside a solenoid magnetic coil 11 in order to provide a magnetic field in a direction in which a wedge is inserted. A VCM magnet for HDD is shown compacted by way of one example, and a partial cylindrical compact is provided. Similar to the third embodiment, the pressurizing rod 3 includes an arcuately concave upper surface, while the elastomeric plate 4 is partially cylindrical so as to be fittingly laid on the upper surface of the rod 3. In particular, the elastomeric plate 4 has an inner peripheral surface formed so as to provide a substantially radius of an outer peripheral surface of the compact. The underside of the upper lid 1 defines a radius that forms an inner peripheral surface of the compact, and further defines a circumferentially extending end surface of the compact.

In FIG. 4, the apparatus including a wedge bar 7 and a transport rail (not shown) is made of non-magnetic materials, except for part of the compacting mold. The other features are similar to those in the first embodiment.

In the above drawings, a difference between non-magnetic field compacting and magnetic field compacting simply depends upon whether a magnetic field from a magnetic circuit is present in the compacting mold. For the magnetic field compacting, the apparatus includes a combination of magnetic and non-magnetic raw materials.

Figure 5:
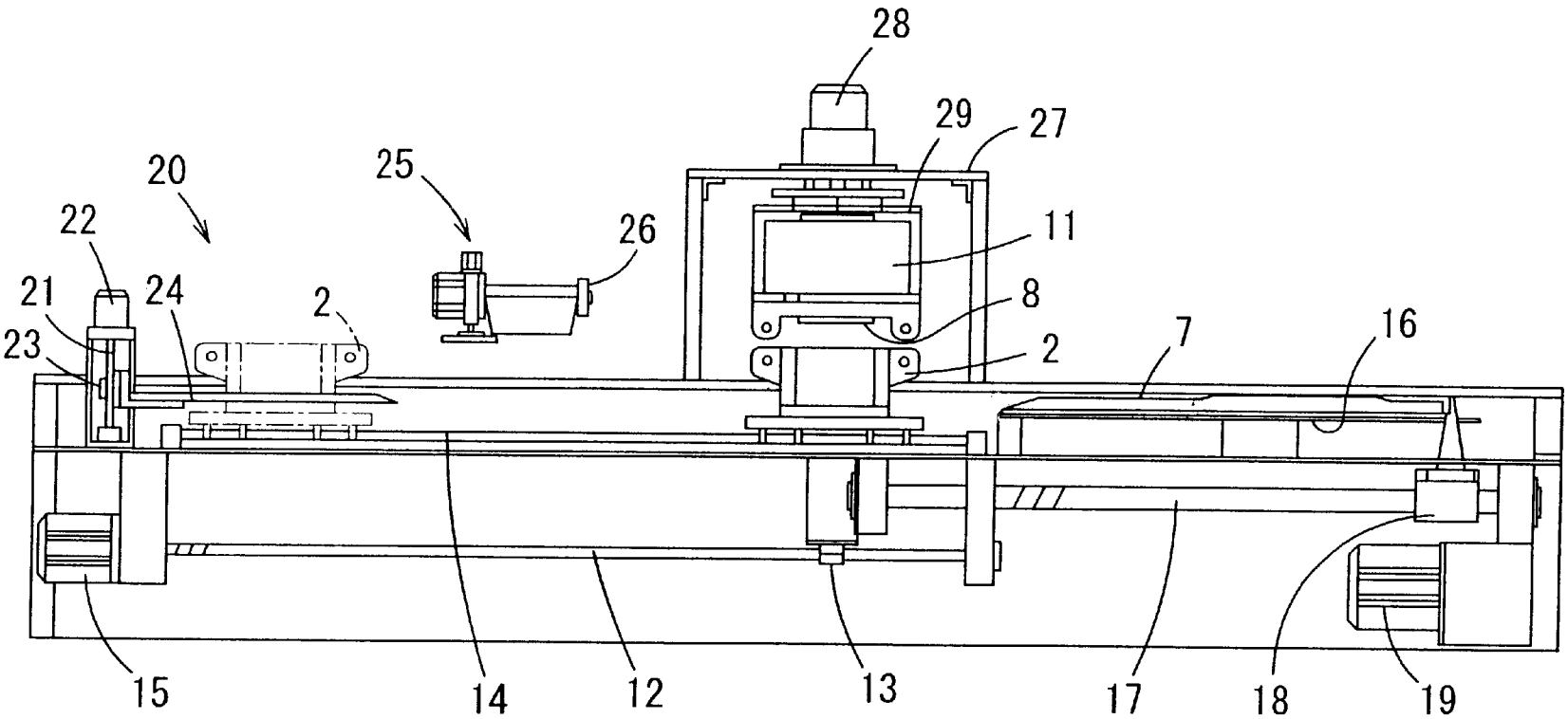
FIG. 5 is a side view, illustrating a powder-compacting apparatus according to a fifth embodiment.
Figure 6:
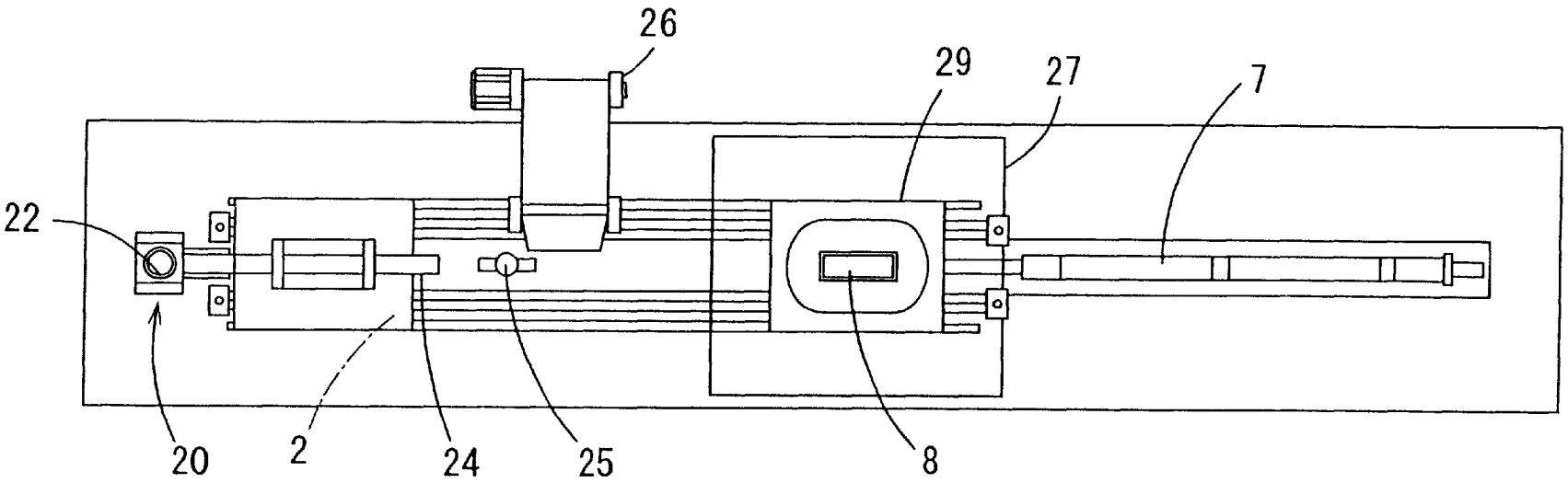
FIG. 6 is a front view, showing the powder-compacting apparatus.

FIGS. 5 and 6 illustrate a powder-compacting apparatus according to a fifth embodiment. More specifically, a magnetic field-compacting machine (no magnetic field power source shown) is shown, in which the compacting mold as shown in FIG. 3 is disposed on a transport conveyor. A description will now be made about how the compacting machine be operated.

A die 2 is connected to a driving mechanism or a transfer apparatus for moving the die 2 to the right and left directions of FIG. 5. Reference numerals 12 denotes a threaded bar; 13 a connector that is internally threaded for engagement with the threaded bar 12, and further that is connected to the die 2; and, 14 a guide for the die 2. At a compacting position of the die 2, a motor 28 on a mounting stand 27 is positioned above the die 2. A coil frame body 29 including a magnetic coil 11 is disposed on a lifting apparatus that is raised and lowered in response to rotation of the motor 28. A magnetic circuit yoke 8 positioned through the magnetic coil 11 has a bottom surface serving as an upper lid 1 for closing an upper surface of the compacted powder. Initially, the die 2 filled with no powder is positioned on a material-supplying conveyor of a material-filling apparatus. The die 2 now filled with powder is moved along the guide 14, and then the motor 28 is actuated to permit the upper lid 1 to close an opening of the die 2, through which the powder is filled into the die 2. A positioning pin (not shown) of a die/upper lid-fixing actuator allows the die 2 and the upper lid 1 to be combined together. The wedge bar 7 is inserted into the die 2, while the magnetic coil 11 is supplied with electrical current. A means for driving the wedge bar 7 includes a guide 16, a threaded bar 17, a connector 18 internally threaded so as to be held in engagement with the threaded bar 17, and a motor 19. The motor 19 is actuated to rotate the threaded bar 17, thereby moving the wedge bar 7 that is connected to the connector 18. The wedge bar 7 includes slanted surfaces 7*a*, 7*b* to form a two-stage construction. While the magnetic coil 11 is supplied with electrical current in order to provide the powder with a magnetic flux, the motor 19 is driven to insert the wedge bar 7 into the die 2. As a result, magnetic powder compaction is completed. Next, compact discharging includes the preliminary steps of driving the motor 28 to raise the coil frame body 29, thereby causing the yoke 8 (which acts as the upper lid) to be spaced apart from the die 2, rotating the motor 19 in a reverse direction to pull the wedge bar 7 out of the die 2 while a motor 15 is driven to transport the die 2 to a discharge position, and moving the die 2 in order to insert a bar 24 of a compact-discharging apparatus or a knockout mechanism 20 into a space below the pressurizing rods. In the knockout mechanism 20, reference numerals 21 denotes a vertical threaded bar; 22 a motor connected to the top of the threaded bar 21; and, 23 a connection of the bar 24, which is held in threading engagement with the threaded bar 21. The motor 22 is actuated after insertion of the bar 24 in order to move the bar 24 upward, thereby knocking out a compact from the die 2. The compact thus knocked out is received by means of a compact-receiving mechanism (not shown). When the above operation is completed, then the die 2 is again moved to an initial position in the right direction of FIG. 5; however, the die 2 is stopped halfway, and then an elastomer-raising machine 25 lowers the elastomeric plate 4 in the die 2 to the bottom surface of the die 2 for powder filling. Then, the die 2 is slightly further moved, and the supply powder-filling mechanism (feeder) 26 of a belt conveyor type for transporting powder materials in a direction perpendicular to the die 2 fills the powder into the die 2 on the elastomeric plate 4. The motor 15 brings the die 2 back to an initial position where the powder is compacted, and the die 2 is then located under the coil frame body 29.

Figure 7:
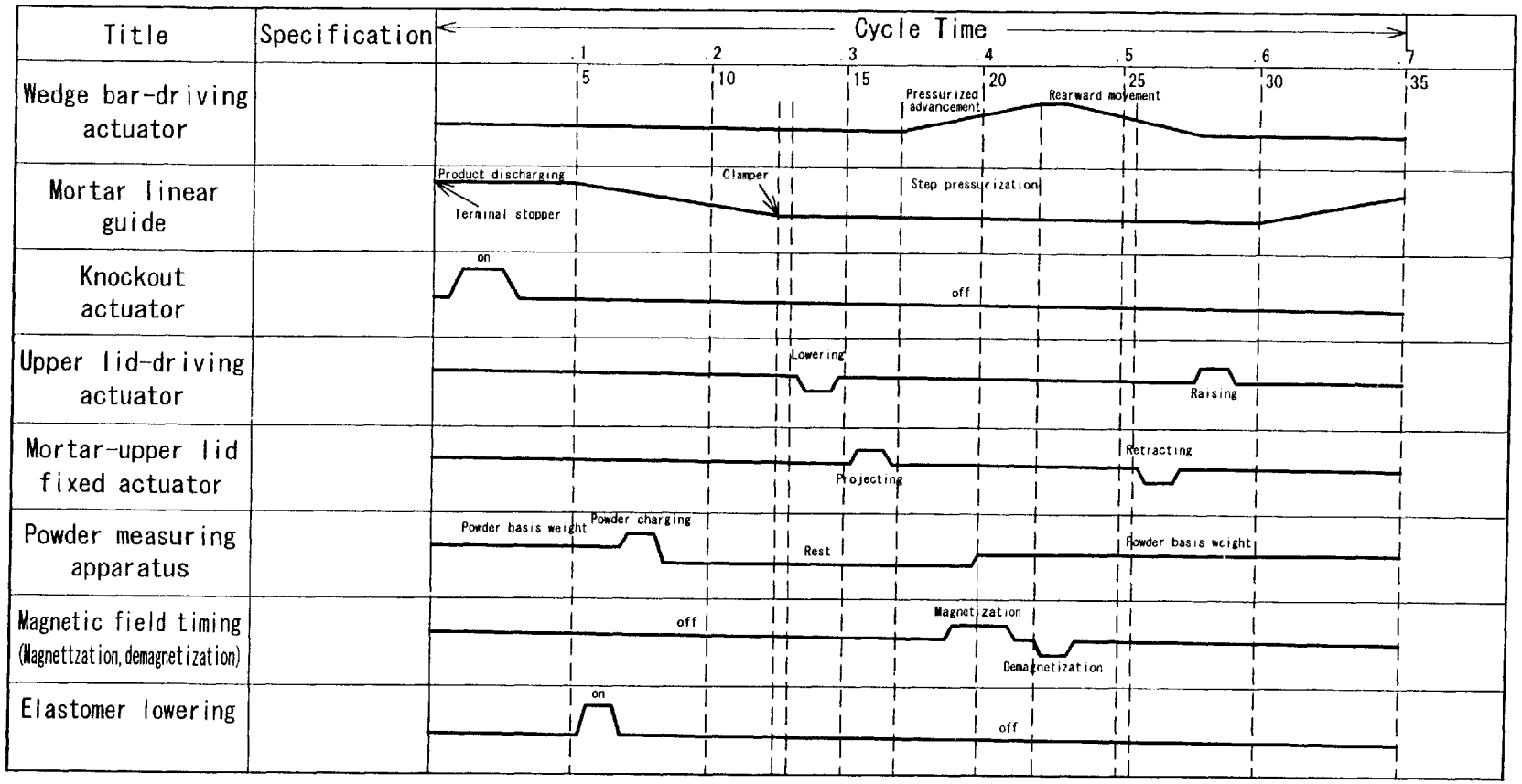
FIG. 7 is a graph, illustrating operational timing in the powder-compacting apparatus.

The above-described actions are provided by the compacting machine including mechanisms that are aligned in a substantially straight array. In FIG. 7, the features as illustrated in FIGS. 5 and 6 are illustrated as a diagram in which a series of actuators behaves within seven seconds of a cycle time. More specifically, the knockout mechanism 20 is actuated during an initial one second while the die 2 is positioned at the knockout mechanism 20, and a compact is thereby discharged from the die 2. During another one second, the die 2 is moved to lower the elastomeric plate 4, and then subsequently powder that is measured in advance by a powder-measuring apparatus is filled into the die 2 by means of the filling mechanism 26. During the next one second, the die 2 is moved to a position where the upper lid is located, and then the motor 28 is actuated to permit the yoke 8 to close the opening of the die 2. During the following nearly one second, the die/upper lid-fixing actuator is actuated to cause the positioning pins to extend outward so as to combine the die 2 and the coil frame body 29 together, and then subsequently the motor 19 of a wedge bar-driving actuator starts moving the wedge bar 7. At the same time, powder magnetization is initialized. During another nearly one second, the magnetization is stopped when powder compacting using the wedge bar 7 reaches its peak, and then demagnetization is practiced while the wedge bar 7 is pulled out of the die 2 after the powder is pressurized. During the next nearly one second, the positioning pins are retracted, and then subsequently the motor 28 is driven to raise the yoke 8. During the subsequent nearly one second, the motor 15 is driven to move the die 2 to an initial position where components are discharged.

When the cycle time is set to be thirty-five seconds, then each one-second as described above is replaced by five seconds.

Figure 8:
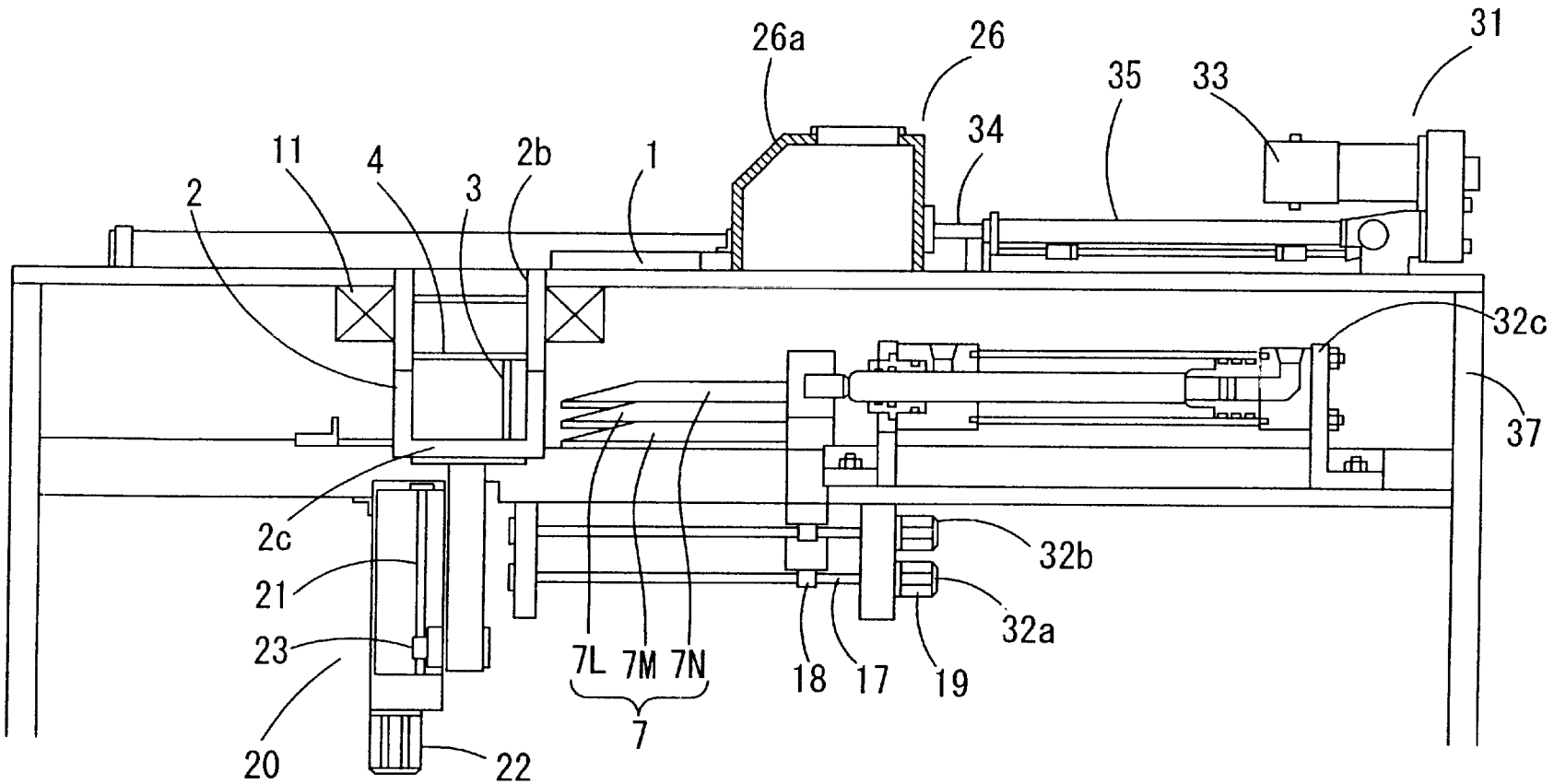
FIG. 8 is a partial cross-sectional side view, showing a powder-compacting apparatus according to a sixth embodiment.
Figure 9:
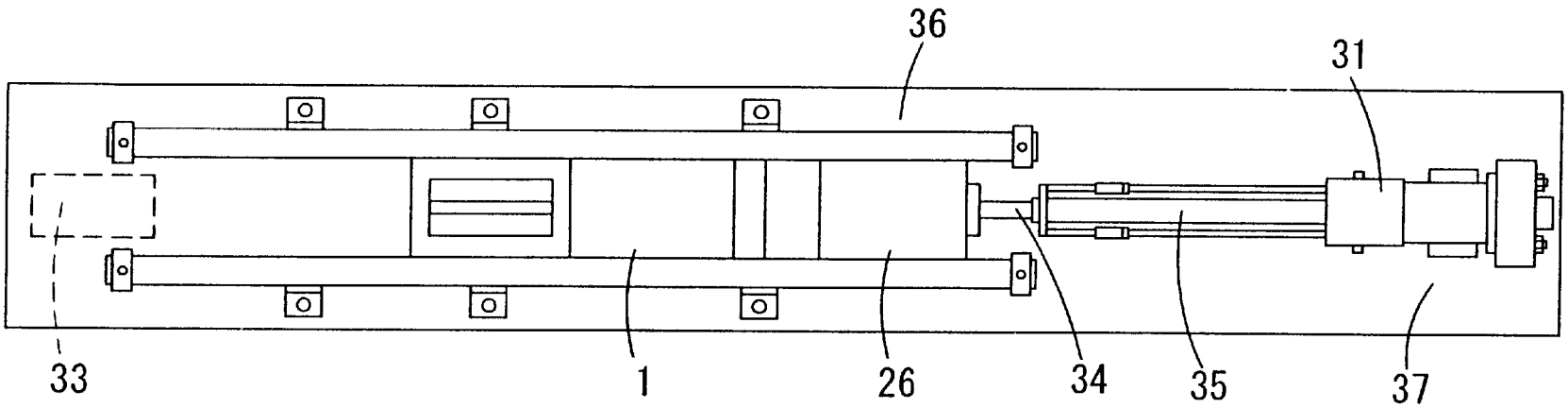
FIG. 9 is a plan view, showing the powder-compacting apparatus.

FIGS. 8 and 9 illustrate a powder-compacting apparatus according to a sixth embodiment. More specifically, unlike the previous embodiment, this is an example of a compacting machine that includes an immovable die 2. A knockout mechanism 20 is positioned below the die 2. The bottom 2*c* of the die 2 is able to move upward and downward, and is connected to a connection 23 of the knockout mechanism 20. When a motor 22 is driven to rotate a vertical threaded bar 21, then the connection 23 is raised or lowered, depending upon a direction in which the motor 22 is rotated, while simultaneously the bottom 2*c* is moved upward or downward. This system allows a compact to be brought out of the die 2 through an upper opening 2*b* with the aid of pressurized rods 3 and an elastomeric plate 4. An upper lid 1 and a feeder 26 for the supply of powder are connected together and are movably guided by means of a pair of guides 36. A driving apparatus 31 moves the upper lid 1 onto an upper opening 2*b* of the die 2. When the compact is taken out of the die 2, then the driving apparatus 31 permits a pointed end of the upper lid 1 to push the compact, thereby moving the compact to a product-discharged position 33. The driving apparatus 31 includes a motor 33, a driving bar 34, and a driving means 35 for driving the driving bar 34 in response to the motor 33. The feeder 26 is positioned above the die 2, and then the die 2 is supplied with the following pack of powder to be compacted, while the compact is pushed to the product-discharged position 33 by means of the pointed end of the upper lid 1. A wedge 7 is of a three-stage structure, in which wedges 7L–7N are driven by driving apparatus 32*a*–32*c*, respectively. The driving apparatus 32*a*, 32*b* drive the lower two wedges 7L, 7M individually. Each of the driving apparatus 32*a*, 32*b* includes a motor 19, a threaded bar 17, and a connection 18. The driving apparatus 32*c* includes a hydraulic apparatus. Reference numeral 11 denotes a magnetic field coil wound around the die 2. The coil 11 applies a magnetic field to the powder, if necessary, when the powder is compacted. Reference numeral 37 denotes a platform for supporting each apparatus.

Next, actions of the apparatus will be described. The driving apparatus 31 is actuated to position a hopper 26*a* of the feeder 26 above the die 2, and then the powder is filled into the die 2 through the hopper 26*a*. The driving apparatus 31 is actuated to permit the upper lid 1 to close the upper opening 2*b* of the die 2. The first-stage wedge 7L is inserted into the die 2 below the pressurizing rods 3, thereby sequentially raising the pressurizing rods 3 to pressurize the powder in steps. The second-stage wedge 7M is subsequently driven to further raise the rods 3. The third-stage wedge 7N is ultimately driven to complete the powder compacting. During such operations, while the powder is pressurized, the magnetic field coil 11 is supplied with electrical current to magnetize the powder, and the powder is then demagnetized while the wedge 7 is pulled out of the die 2 after the powder is compacted. The driving apparatus 31 is actuated to remove the upper lid 1, and then to allow the knockout mechanism 20 to bring the compact onto the opening 2*b* of the die 2. The drive apparatus 31 permits the pointed end of the upper lid 1 to bring the compact to the discharge position 33 in such a manner that the hopper 26*a* is positioned above the opening 2*b* at a transport position.

The above-described compacting machine can efficiently be aligned because of a space saving. The three-stage wedge 7 is able to drive the wedges 7L–7N with a reduced level of a driving force, and thus the motors 19 and the hydraulic apparatus can be operated with lower power.

Figures 10A, 10B:
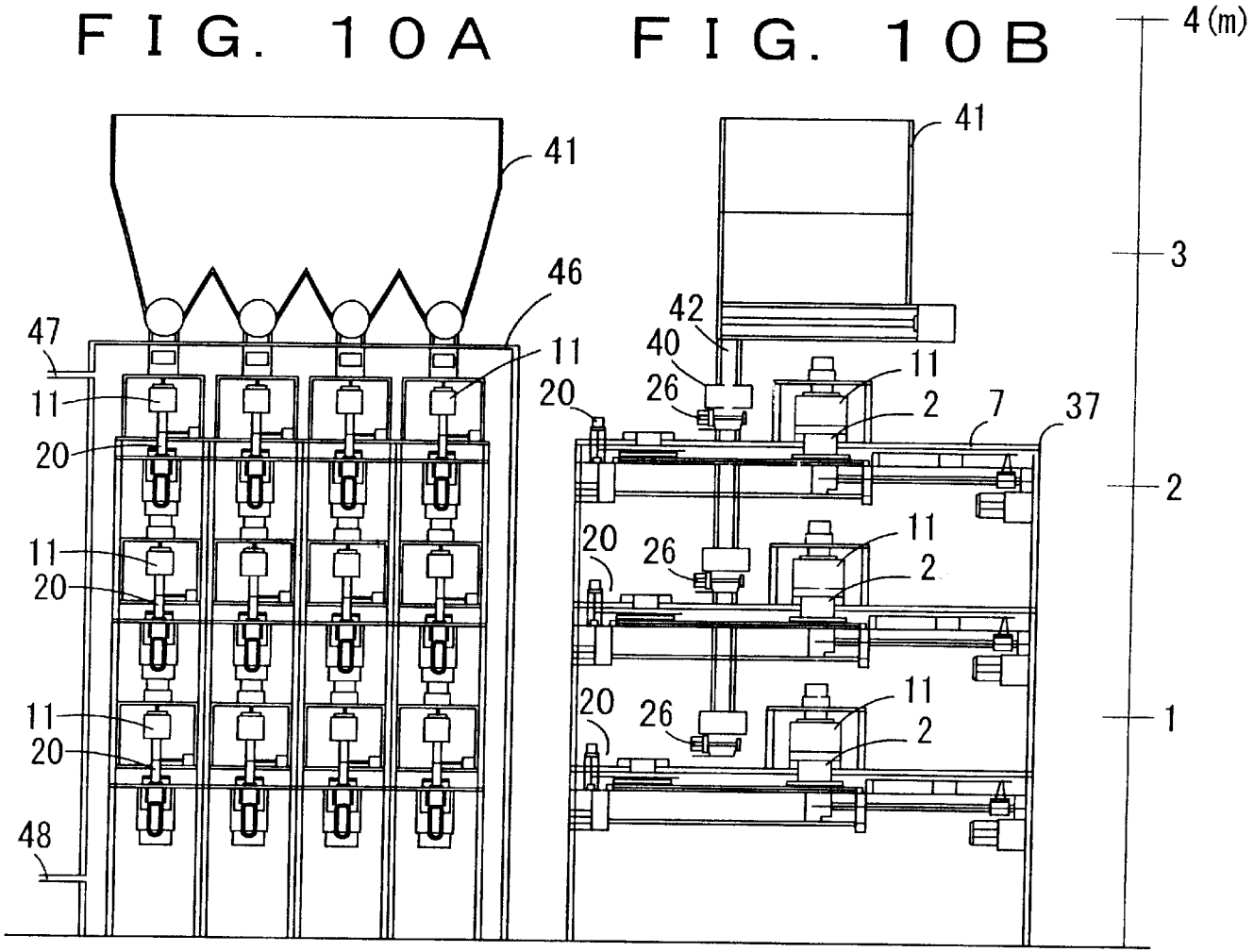
FIG. 10A is a cross-sectional front view, illustrating a powder-compacting apparatus according to a seventh embodiment.
FIG. 10B is a side view, illustrating the powder-compacting apparatus.

FIG. 10 illustrates a powder-compacting apparatus according to a seventh embodiment, in which a plurality-of compacting apparatus as shown in FIGS. 5 and 6 are longitudinally and transversely connected together and arranged above each other. In the present embodiment, one platform 45 includes three vertical stages, at each of which four apparatus are horizontally aligned. In this case, the powder is supplied to each powder-filling section 40 from a material powder tank 41 though a pipe 42. The material powder tank 41 is disposed at the top of the apparatus. The entire system except for the tank 41 is surrounded by an enclosure 46, but N2 or argon gases and other inert gases are charged and discharged through charge-discharge ports 47, 48. A maintenance-dedicated mechanism (not shown) is able to separately move from such a laminated line for each of the compacting apparatus.

Figures 11A, 11B:
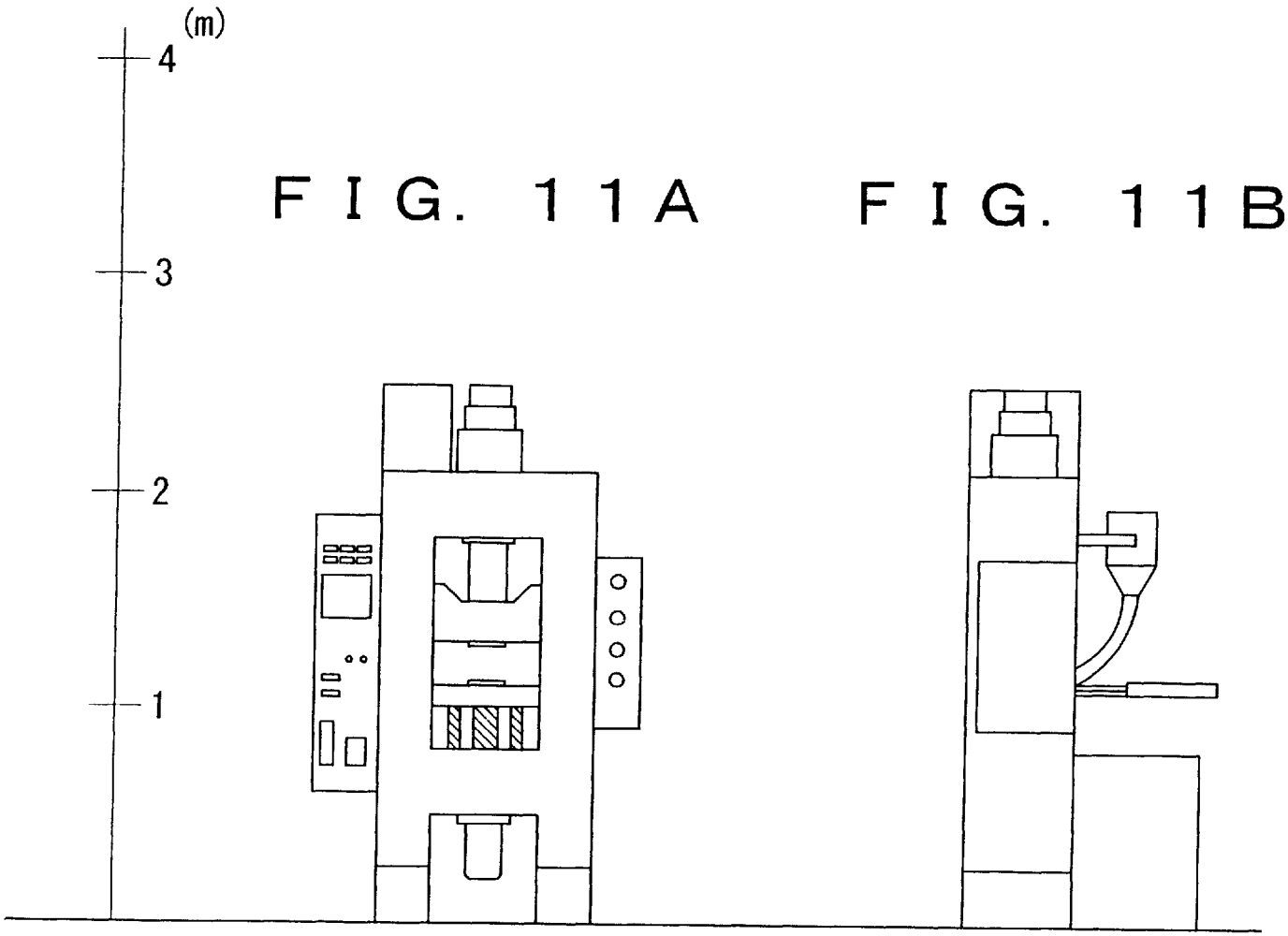
FIG. 11A is a front view, showing a prior art powder-compacting apparatus for the purpose of comparison with FIG. 10.
FIG. 11B is a side view, showing the prior art powder-compacting apparatus.

For the purpose of comparison, FIG. 11 illustrates a conventional hydraulic compacting machine that has a total pressurizing force similar to that in the seventh embodiment; however, the compacting apparatus according to the present invention largely differs in space from such a conventional apparatus, and demonstrates a great progress in downsizing.

All of the compacting apparatus according to the present invention can be connected together and disposed above each other. For example, the plurality of apparatus according to the sixth embodiment can be arranged longitudinally and transversely as practiced in the seventh embodiment.

Figure 12A:
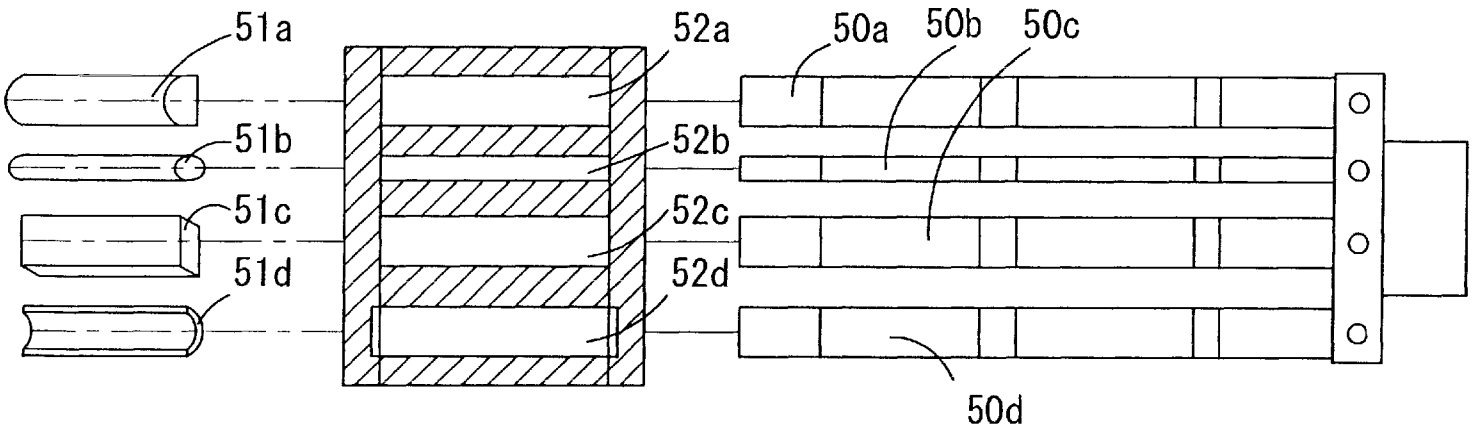
FIG. 12A is a descriptive illustration, showing a die, a wedge, and a compact according to an eighth embodiment.
Figure 12B:
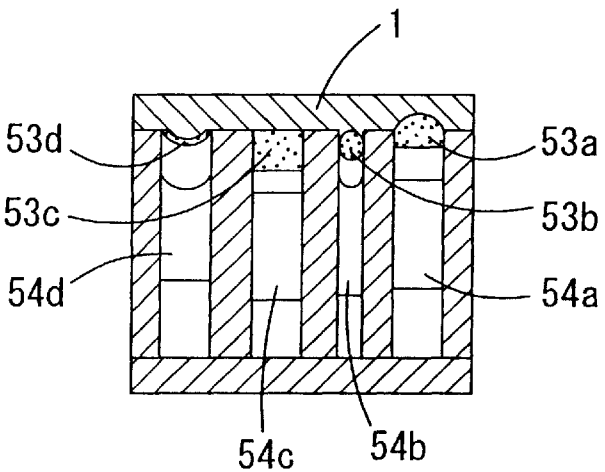
FIG. 12B is a cross-sectional view, showing compacted powder.

FIG. 12 illustrates a powder-compacting apparatus according to an eighth embodiment. This step compression realizes compacting using a combination of multi-aligned wedges including several different kinds of wedges 50*a*–50*d*, a die having a plurality of differently shaped compacting sections 52*a*–52*d*, and an upper lid 1. FIG. 12 exemplifies a variety of compacts 51*a*–51*d*, i.e., a substantially semi-pillar body, a bar body, a rectangle, and a substantially semi-cylindrical body. The upper lid 1 is formed with: a convex surface 53*d* for forming an inner peripheral surface of the substantially semi-cylindrical body; a planar surface 53*c* for forming a rectangular surface; a concave surface 53*b* for forming a semi-outer peripheral surface of the bar body; and, a concave surface 53*c* for forming an outer peripheral surface of the substantially semi-pillar body. The rods 54*a*–54*d* include curvilinear and planar pointed ends, which correspond with the above shapes. The multi-aligned wedge has proximal ends of the wedges 50*a*–50*d* integrally combined together by means of a connecting member. The other components are provided in a manner similar to those in the first embodiment.

According to the eighth embodiment, a plurality of differently shaped compacts is achievable at one time.

In order to produce a plurality of compacts having the same shape at one time, the wedges, die compacting sections 52*a*–52*d*, upper lid, and pressurizing rods can be made the same in shape. The elastic plate 4 can be either formed into the above-mentioned shapes or planar-shaped.

Figure 13:
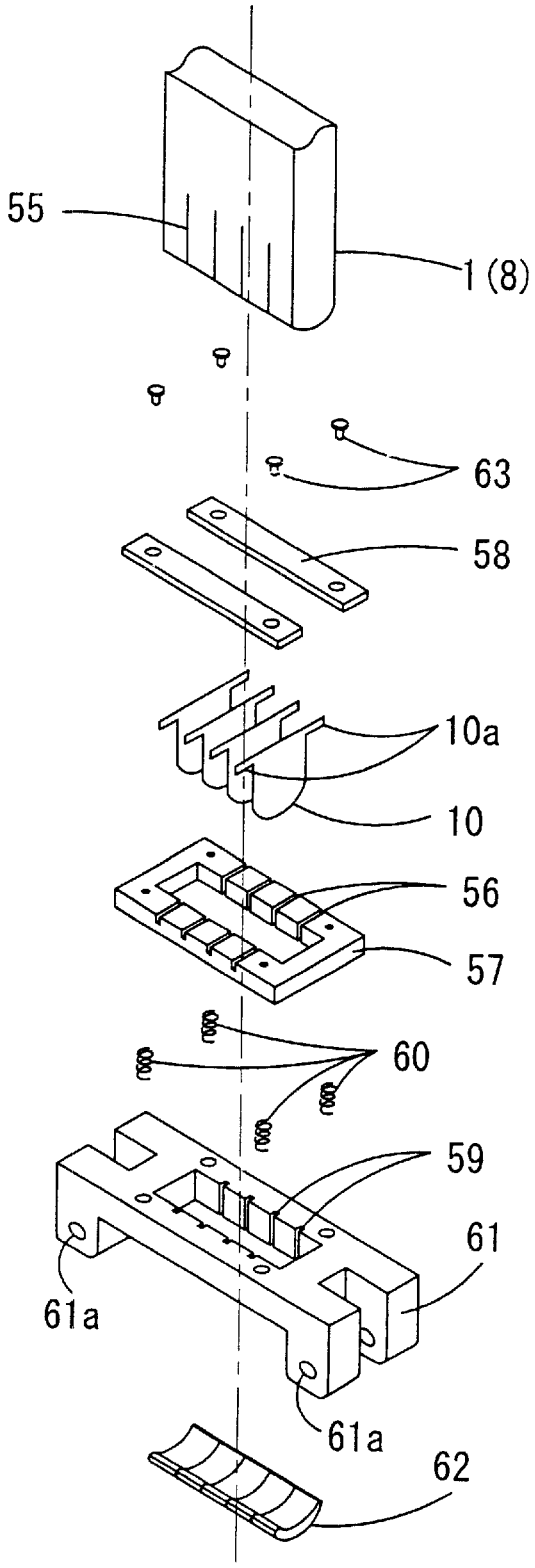
FIG. 13 is an exploded, perspective view, illustrating a slicer mechanism according to a ninth embodiment.
Figure 14:
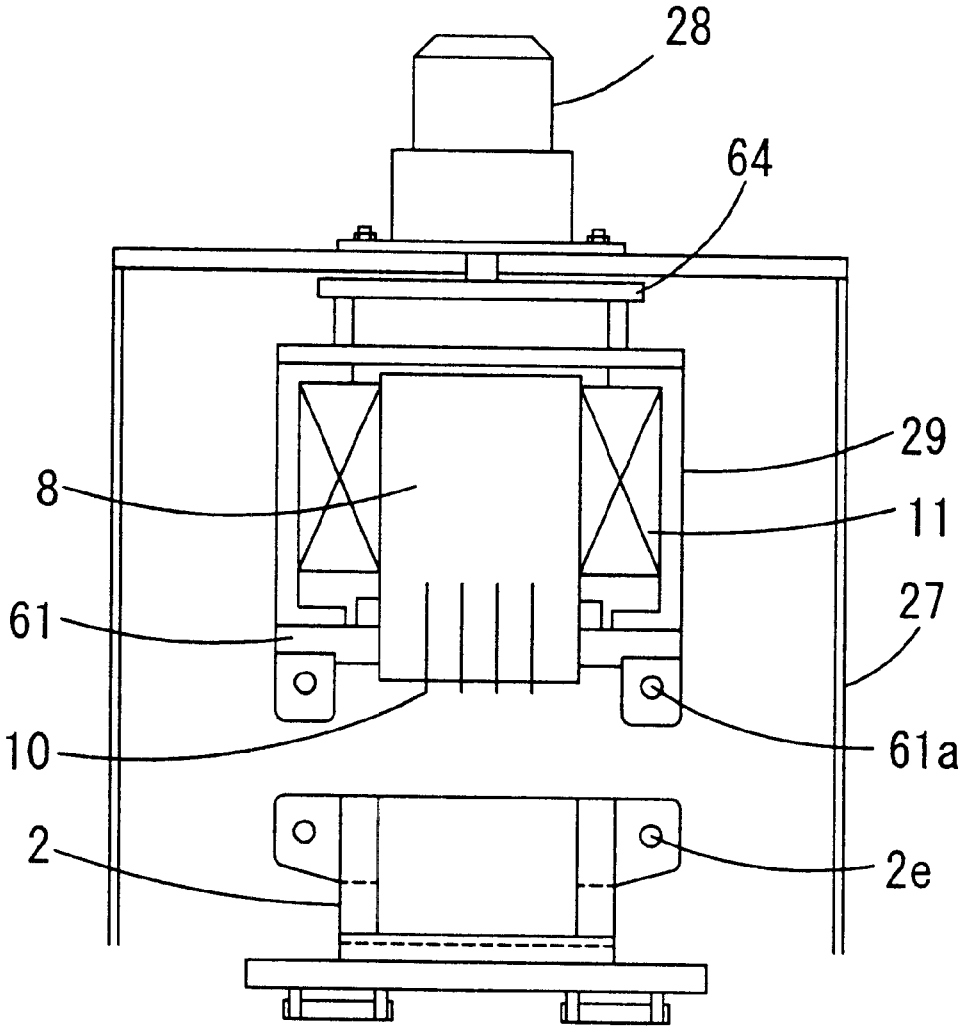
FIG. 14 is a cross-sectional view, illustrating a powder-compacting apparatus employing the slicer mechanism.

FIGS. 13 and 14 illustrate a ninth embodiment. More specifically, the upper lid 1 is provided with slicers 10, as illustrated in FIG. 3. The slicer 10 has a slicing function to produce a plurality of compacts. As previously mentioned, the slicers 10 serve as a bundle of cutting tools, each of which has a small thickness. As illustrated in FIG. 3, the powder compressed and lifted by the rods 3 and elastomeric plate 4 is divided into several pieces of compacts by means of the slicers 10. The divided compact forms a substantially cylindrical shape. In FIG. 13, the slicer 10 includes a pair of mounting portions 10*a* on the top thereof and an arcuate sector on the bottom thereof. The pair of mounting portions 10a extend outward from both proximal ends of the slicer 10 on the top thereof. The arcuate sector corresponds in shape with a substantially semi-cylindrical compact 62 to be molded. In addition to the slicer 10, a slicer mechanism further includes: a magnetic field yoke 8 serving as the upper lid 1; a slicer-fixing frame 57 snugly fitted to the magnetic field yoke 8; a pair of slicer-pressing plates 58 for pressing the mounting portions 10*a* against the slicer-fixing frame 57; an upper lid frame 61 in the form of a frame, through which the magnetic yoke 8 is penetrated; and, springs 60 positioned between the slicer-fixing frame 57 and the upper lid frame 61. The magnetic yoke 8 has cutouts 55 formed at a lower surface thereof in order to insert the slicers 10 into the cutouts 55. The slicer-fixing frame 57 is formed with grooves 56 in order to hold the mounting portions 10*a* there against. The upper lid frame 61 has grooves 59 formed in an inner peripheral surface thereof in order to insert each side of the slicers 10 into the groove 59. The slicer-pressing plate 58 and slicer-fixing frame 57 are mounted on the upper lid frame 61 by means of machine screws 63. Reference numeral 62 denotes the sliced compact.

In FIG. 14, the upper lid frame 61 is secured to a coil frame body 29, while a coil 11 wound around the magnetic field yoke 8 is supported on the coil frame body 29. The coil frame body 29 is mounted on a lifting member 64 for a motor 28 that is rigidly attached to a mounting platform 27. The upper lid frame 61 and the die 2 are formed with positioning holes 61*a*, 2*e*, respectively. The motor 28 is driven to match the holes 61a with the holes 2*e*, and then to insert positioning pins 6 into the holes 61*a* and 2*e*, thereby connecting the upper lid frame 61 and the die 2 together. The other compacting apparatus are similar to those in the fifth embodiment.

FIGS. 15–22 illustrate a tenth embodiment, which is concerned with the number of slanted surfaces that a wedge bar 7 includes, inclined angles of the slanted surfaces, and an elastomeric plate 4 in the first embodiment.

In powder compacting, a first step is to fill powder into the die 2 on the elastomeric plate 4. The first step is similar to that in conventional compacting methods. A second step involves deciding in the process between insertion of a pointed end of the wedge bar 7 and completion of the insertion thereof whether a multi-stage wedge bar is required. More specifically, it involves deciding the number of slanted surfaces (hereinafter simply called a slanted surface, which means a slant in a direction in which the wedge bar 7 is inserted) of the wedge bar 7 as well as an angle of each slanted surface with respect to the bottom surface. The respective angles of the slanted surfaces 7*a*, 7*b* must fall within a range to avoid causing an inconvenience in which the filled powder to be unevenly spread over the die 2. A similar inconvenience occurs, depending upon kinds of powder (e.g., an angle of repose for the powder) or a higher or lower speed at which the wedge bar 7 is inserted. Thus, a preferable angle varies according to individual conditions.

In magnetic field compacting, timing in which a magnetic field is applied to the powder requires a limited space in which powder particles containing easy axis of magnetization are rotated in a magnetic direction. In addition, respective lengths of parallel planes 7*c*, 7*d* that continuously extend from the slanted surfaces 7*a*, 7*b* insure a time in which the magnetic field is applied to the powder, while respective heights of the parallel planes 7*c*, 7*d* insure the above space.

The above two conditions determine preferable angles of the slanted surfaces 7*a*, 7*b*, and further determine preferable lengths of the parallel planes 7*c*, 7*d* according to a target compact. As a result, the slanted surfaces 7*a*, 7*b* raise the rods 3, thereby transmitting a pressurizing force sufficient to obtain a target compact density to the elastomeric plate 4.

Figure 15A:
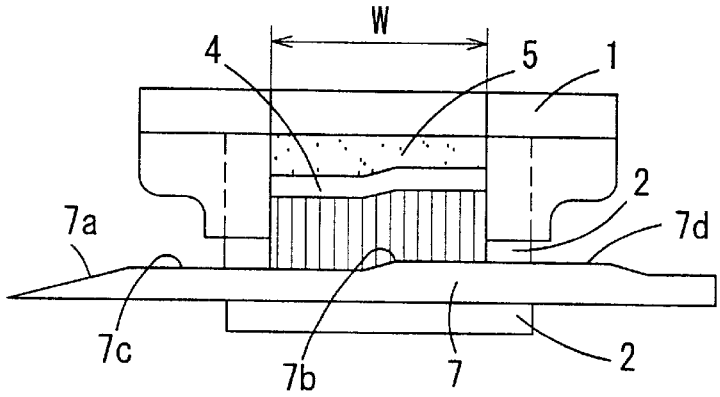
FIG. 15A is a cross-sectional view, showing a powder-compacting apparatus in the process of powder compacting.
Figure 15B:
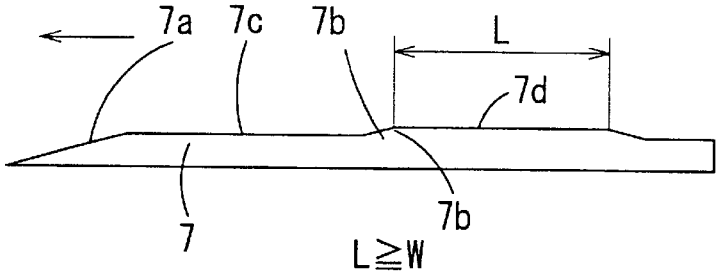
FIG. 15B is a side view, illustrating a wedge bar.
Figure 15C:
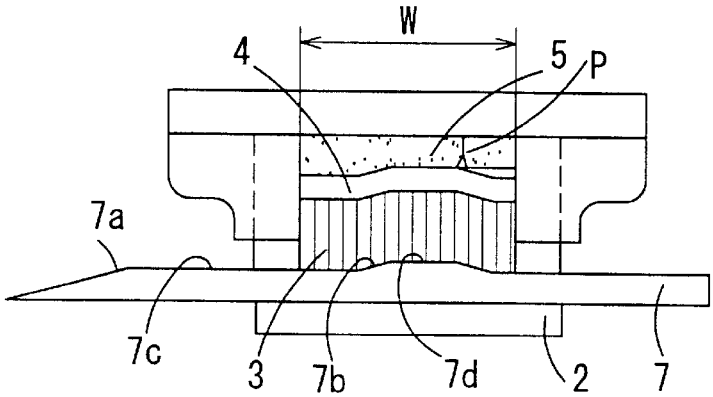
FIG. 15C is a cross-sectional view, showing a powder-compacting apparatus in the process of powder compacting, in which a wedge bar including a shorter planar portion is inserted.
Figure 15D:
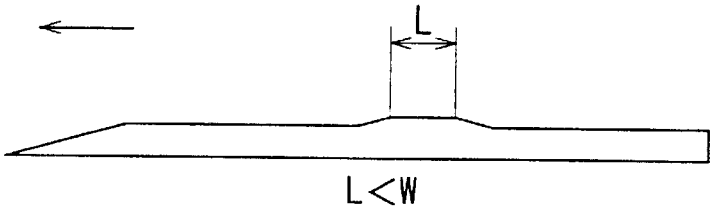
FIG. 15D is a side view, showing the wedge bar that includes the shorter planar portion.

In order to obtain such a target compact density, the entire lengths of the parallel planes 7*c*, 7*d* contiguous to the slanted surfaces 7*a*, 7*b* is preferably equal to or greater than a length of the compact or the entire length of the die 2, i.e., L>W. As illustrated in FIGS. 15C and 15D, for L<W, a compacting pressure is released in a state of the powder being insufficiently compacted, even when the powder on the upper surface of the wedge bar 7 is compacted under the compacting pressure. In this case, the compact in the die 2 experiences distortions "P" or cracks. "L" is a length of the parallel plane 7*d* in the direction in which the wedge bar 7 is moved, while "W" is a length of the volume of the die 2 in the direction in which the wedge bar 7 is moved.

Height dimensions of the parallel planes 7*c*, 7*d* vary, depending upon a material and height dimension of the compact as well as a degree of precision, with which the wedge bar is fabricated, but can lie within a range that brings about no inconvenience in the next manufacturing process after the powder compacting.

The wedge bar 7 is pulled out of the die 2 in a state of the above planes being thus insured. The wedge bar 7 can be of a multi-stage type in conjunction with a driving actuator, as illustrated in FIG. 8.

The wedge bar 7 withstands a compacting pressure of 100–1000 MPa, and has durability to repeated behaviors.

As illustrated in FIG. 1, the rods 3 and the elastomeric plate 4 both contained in the die 2 are important components designed to be sequentially raised vertically toward the upper lid 1 in response to the insertion of the wedge bar 7, thereby compressing the powder in steps. When the wedge bar 7 is inserted along an inner bottom surface of the die 2, on which the rods 3 are disposed, then the pointed end of the wedge bar 7 must easily be inserted between the inner bottom surface and the rods 3.

To this end, a radius is preferably placed on the rod 3 at a position where the rod 3 contacts the bottom surface of the die 2. The rods 3 contact each other through the parallel surfaces 7*c* and 7*d*, and are constrained within a space around an inner surface (or inner wall surface) of the die 2, except for the lower opening 2*a*. This constraint retains a function of sequentially transmitting a pressurizing force, exerted by the wedge bar 7, as step compression in an upward direction perpendicular to the bottom surface of the die 2. As a result, the above pressurizing function is fulfilled; compacting conditions such as a rectangular plate, a cylinder, a circular plate, a segment, and other shapes are satisfied; and, an either magnetic or non-magnetic material is selected.

The total pressurizing force is provided by the pressurizing rods 3 that are laid on the slanted surfaces 7*a*, 7*b* and the parallel surfaces 7*c*, 7*d*. In other words, the total pressurizing force is a sum of: one pressurizing force required to compact the powder in sequence by the powder being pressurized at different locations in consideration of a powder compact being viewed as a non-resilient object; and, another pressurizing force required to retain the compact held between the upper lid and the elastomeric plate 4 immediately after the powder is compressed by the rods 3.

Figure 39:
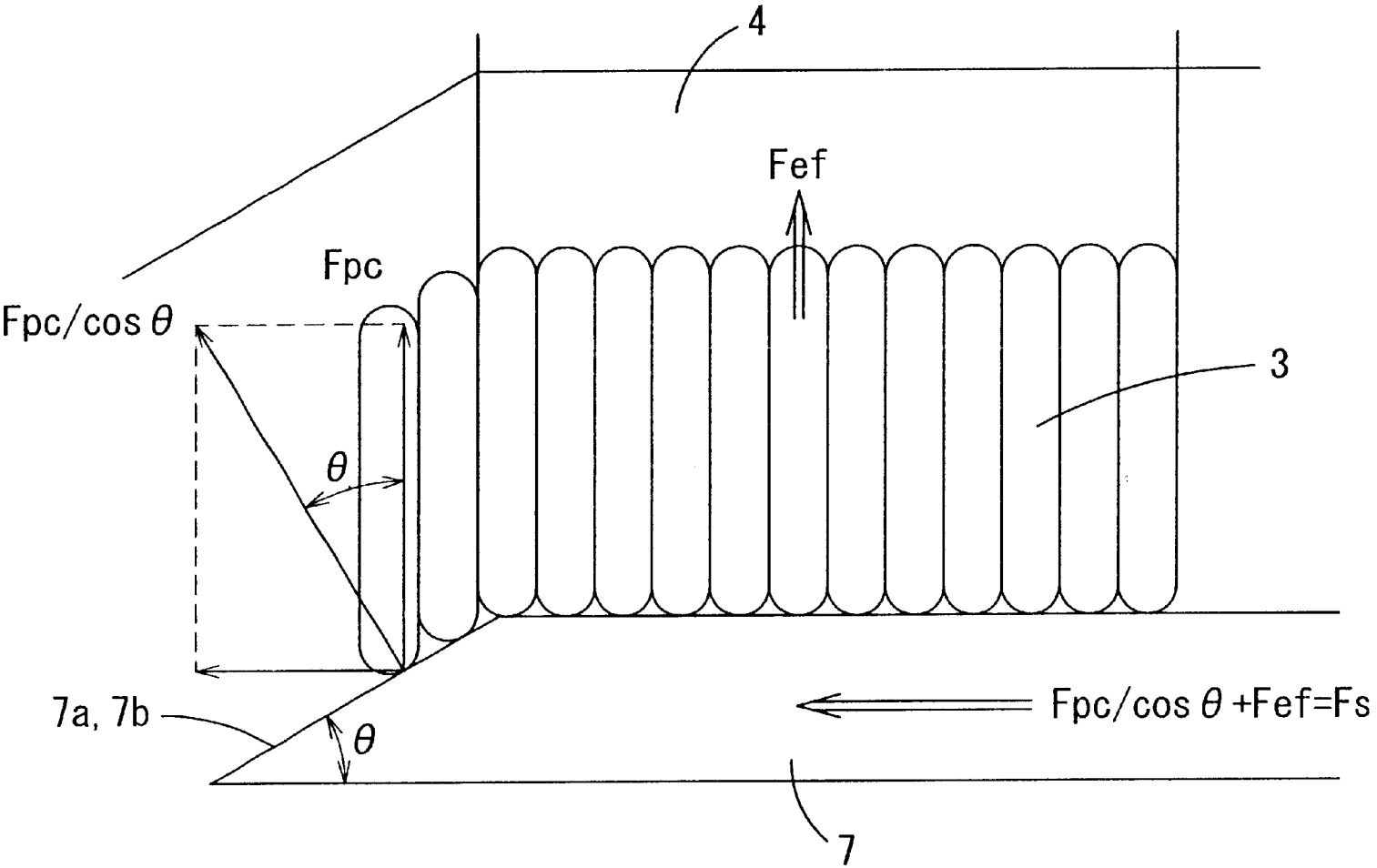

The sum of pressurizing forces, i.e., the total pressurizing force pressure to be attained by the present invention, is the maximum pressurizing force required for the insertion of the wedge bar 7. Total pressurizing force "Fs" is expressed by the following equation:

[Equation 1]

$$Fs = \frac{F_{pc}}{\cos\theta} + F_{ef} \tag{1}$$

where "Fpc" is a pressurizing force exerted on the powder by the rods 3 being raised at angles of the slanted surfaces 7*a*, 7*b* as illustrated in FIG. 39, and "Fef" is a force imposed on the parallel surface 7*d* by the elastomeric plate 4 being compressed in the die. These are calculated according to the following two equations:

[Equation 2]

$$F_{pc} = \frac{n}{2} \times SK \times \sum_{i=1}^{n} (P_i - P_{i+1}) \tag{2}$$

[Equation 3]

$$F_{ef} = \mu \times SE \times P1 \tag{3}$$

where "n" is the number of pressurizing rods during powder pressurization; "SK" is an pressurized projection cross-sectional area for each of the rod 3 ("SK"=thickness "w" times width "d"); and, "Pi" is a pressure point on a curve for each density in a powder compression characteristic graph of FIG. 36, in which "P1" denotes a pressure value for a target compacting density. $\mu$ is a friction coefficient between the bottom surface of the die, the rods 3, and the wedge bar 7; and, "SE" is a total area of the elastomeric plate 4 (SE=n·SK).

Figure 36:
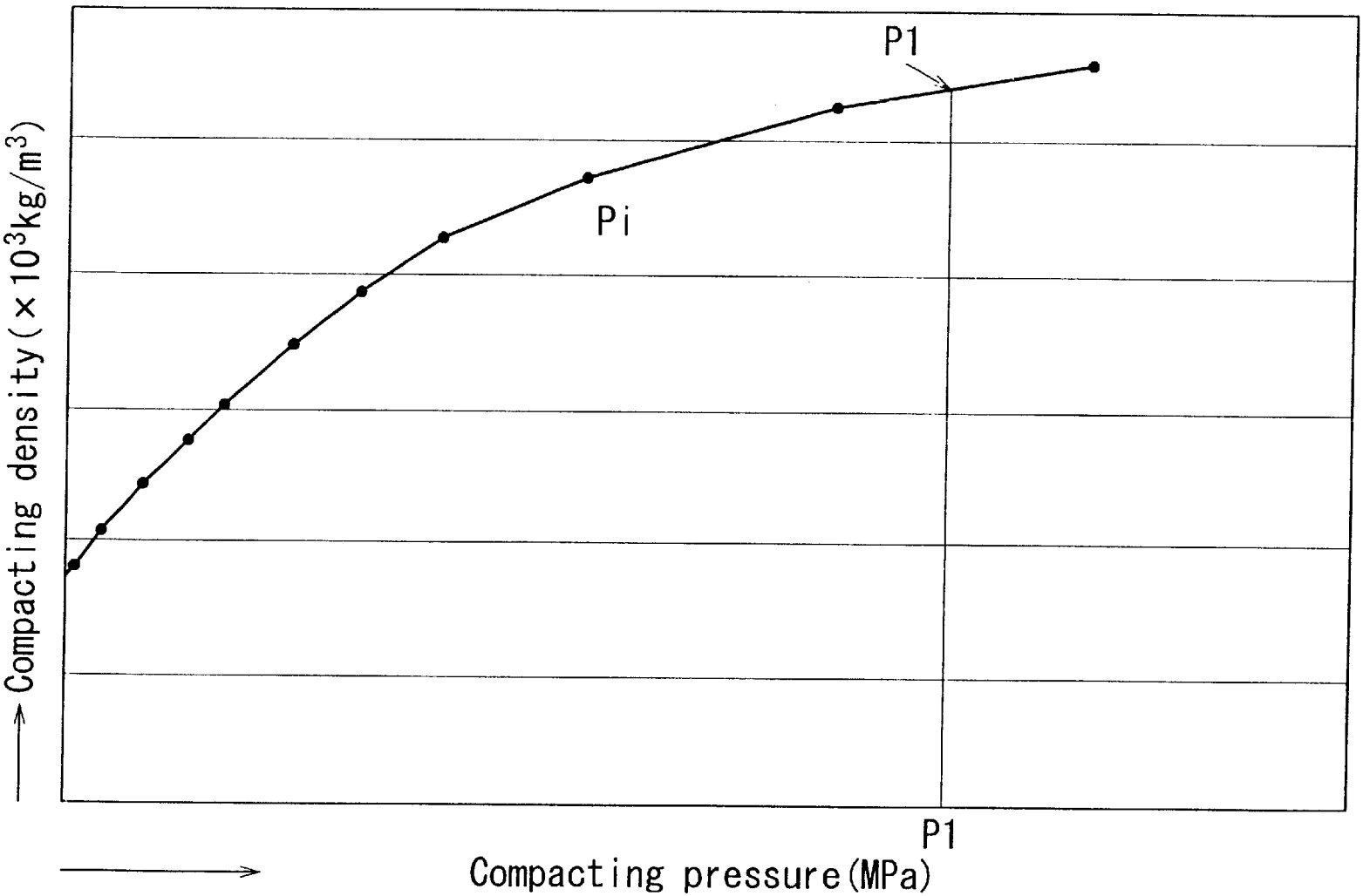
FIG. 36 is a graph, illustrating a compacting pressure and a compacting density.

A distance that the rod 3 moves, which is required to achieve a target compacting density, is calculated according to FIG. 36. The rod 3 travels a distance under a pressure of MPa unit. A density as an initial pressurization value is equal to a value on an extended curve of FIG. 36 at a zero pressure.

Figure 37:
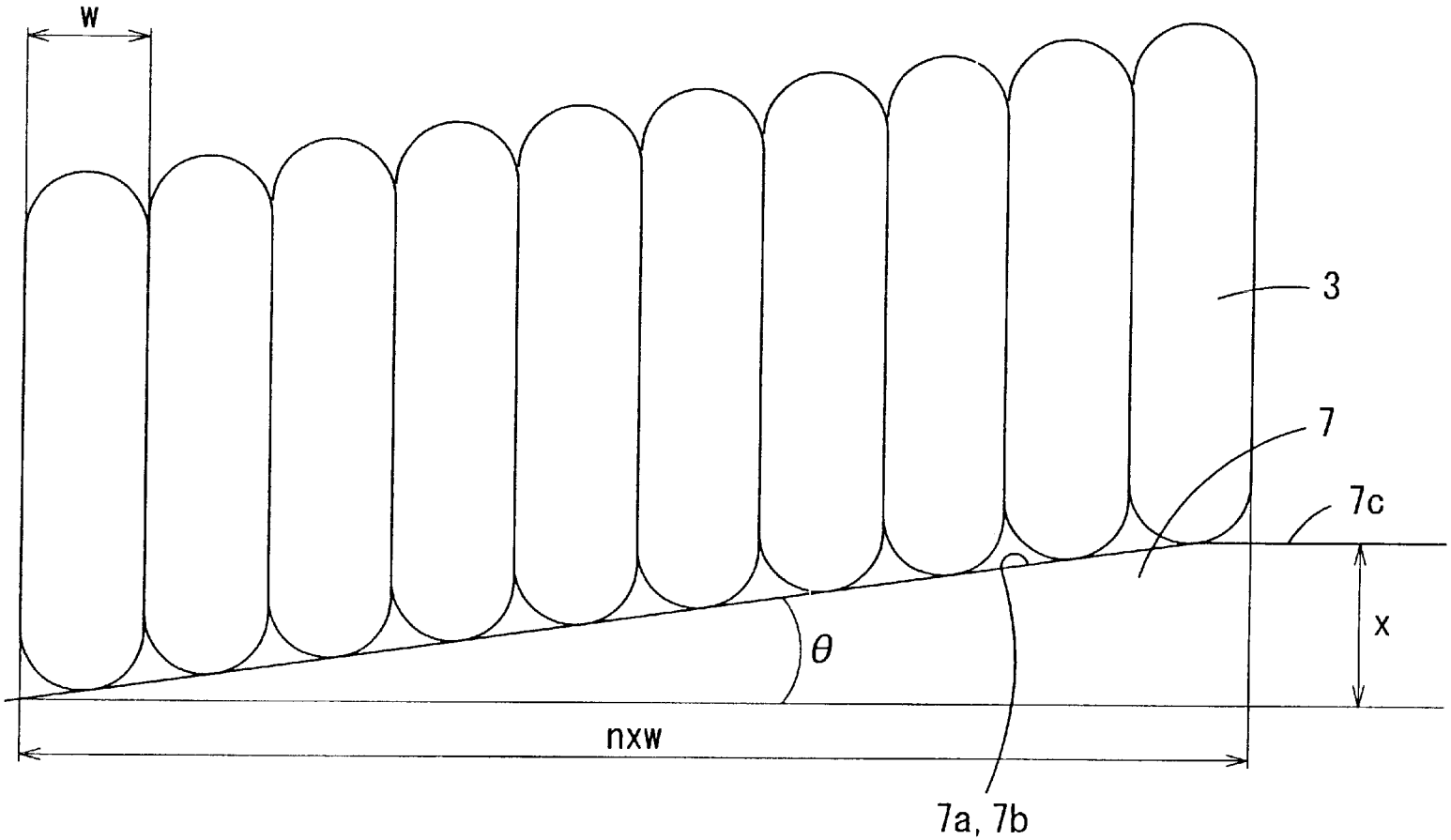
FIG. 37 is a descriptive illustration, showing pressurizing members carried on a wedge.
Figure 38:
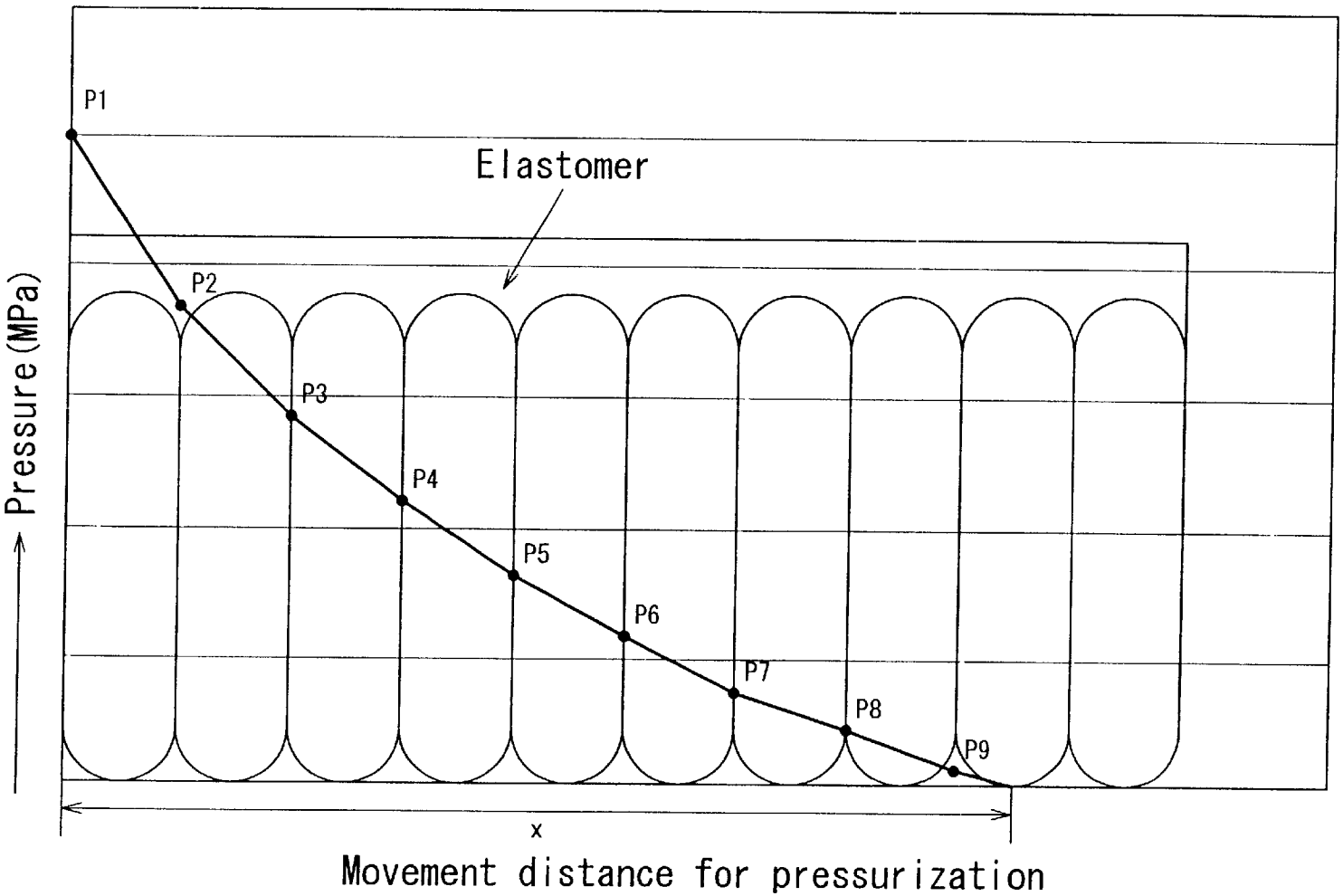
FIG. 38 is a graph, illustrating a relationship between a pressure applied by the pressurizing members and a distance that the wedge travels for pressurization; and, FIG. 39 is a descriptive illustration, illustrating a relationship between a force exerted by the wedge and a force applied to the pressurizing rod.

A curve in FIG. 38 shows a relationship between a pressure that achieves the target compacting density and a calculated distance that the rod 3 moves for pressurization. A value of each pressure point "Pi" is determined along the curve at spaced intervals that correspond with the number of the rods 3. The determined value is substituted in equation 2, thereby yielding a pressurizing force on the powder. Each pressure point "Pi" is related as illustrated in FIG. 37, and is determined by desirable angles θ of the slanted surfaces 7*a*, 7*b* and each thickness "w" of the rods 3. Such desirable angles θ vary, depending upon different kinds of the filled powder. In order to maintain the powder uniformly distributed in the die 2 immediately before the powder is pressurized, respective angles θ of the slanted surfaces 7*a*, 7*b* are preferably equal to or smaller than 15°, and the most preferred angles θ fall within a range of 4 to 10° in consideration of the mechanical strength, durability, and drive length of the wedge bar 7.

The thickness of the rod 3 is preferably equal to or greater than 2 mm in view of mechanical strength as similarly to the above as well as a relationship between the rods 3 and the elastomeric plate 4. In addition, two or more rods 3 are desirably moved by a certain distance when the powder is pressurized. Friction coefficient $\mu$ depends upon a selected material and a pressurizing structure. For a mold, friction coefficient $\mu$ ranges from 0.02 to 0.1, thereby yielding the result of equation 3.

Figure 16:
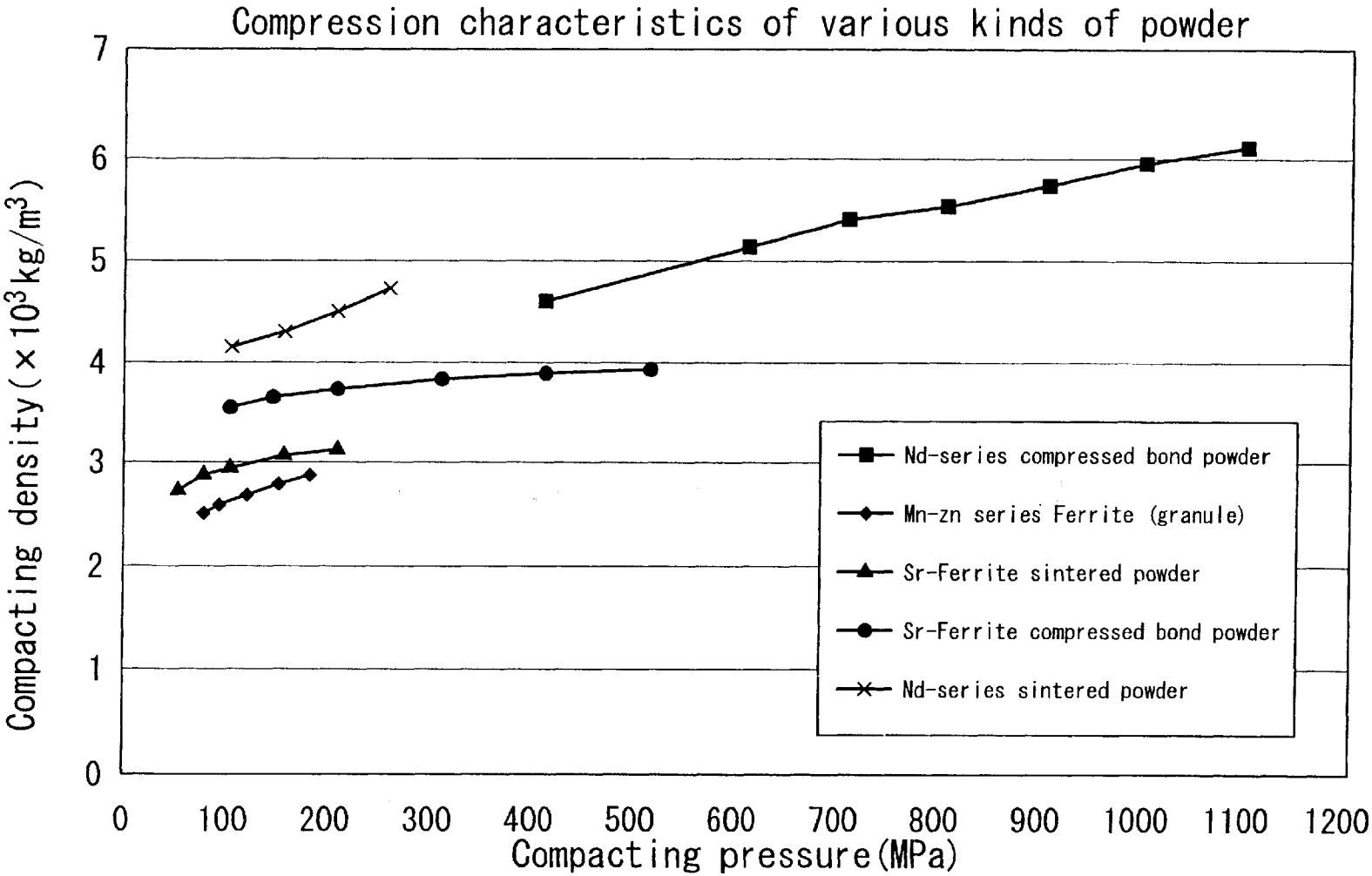
FIG. 16 is a graph, illustrating compression characteristics for various kinds of powder.

The step compression according to the present invention refers to a combination of one function of the limited rods 3 on the slanted surfaces 7*a*, 7*b* and another function of the rods 3 for retaining the just compressed compact that contacts the rods 3. FIG. 16 illustrates compression characteristics of various types of powder. The wedge bar 7 and the rods 3 are designed in such a manner that a target compacting density is achieved when section 7*b*' of the wedge bar 7 (see FIG. 15) between the slanted surfaces 7*a*, 7*b* and the parallel surfaces 7*c*, 7*d* travels beneath the rods 3. More specifically, the step compression means a system for pressurizing the filled powder, in which a powder-filled space in the die 2 varies according to different inserted portions of the wedge bar 7. In conventional techniques, a pressurizing force is required to compress the powder at a time by all of the rods 3 in the die 2 being raised by a lower punch instead of the wedge bar 7.

Figure 33A:
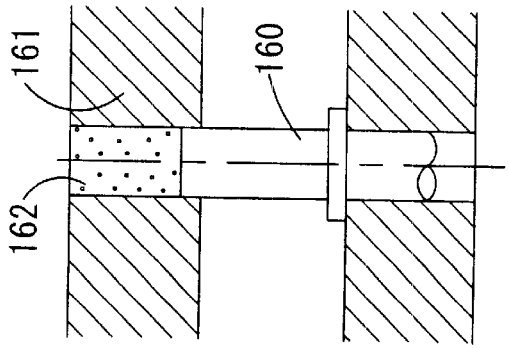
FIG. 33A is a descriptive illustration, showing a prior art compacting process.
Figure 33B:
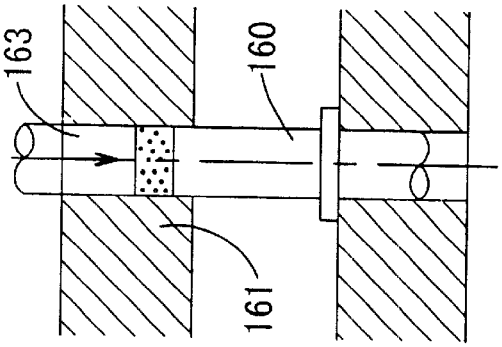
FIG. 33B is a descriptive illustration, showing a prior art compacting process.
Figure 33C:
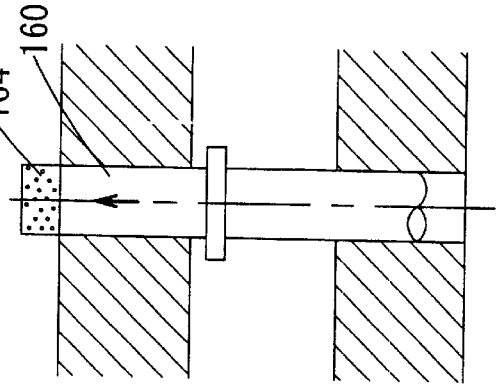
FIG. 33C is a descriptive illustration, illustrating a prior art compacting process.

The compression characteristics as shown in FIG. 16 are exhibited according to known arts. In addition, the powder is compacted according to a method as illustrated in FIG. 33 in which the powder filled into the die 161 is pressurized by upper and lower punches. FIGS. 33A, 33B, and 33C illustrate a process in which powder 162 is filled into the die 161 on a lower punch 160, a process in which an upper punch 163 pressurizes the powder, and a process in which the lower punch 163 is raised to extrude a compact 164, respectively.

The present invention seeks to disclose the fact that a difference between such compression systems reduces a total pressurizing force when compared with conventional techniques. The conventional techniques require a high level of a total pressurizing force in a moment during a very limited compression time. Meanwhile, the step compression according to the present invention forms a compact by sequentially applying a pressurizing force to the powder at only partial areas in response to a rate at which the wedge bar is inserted.

Figure 17A:
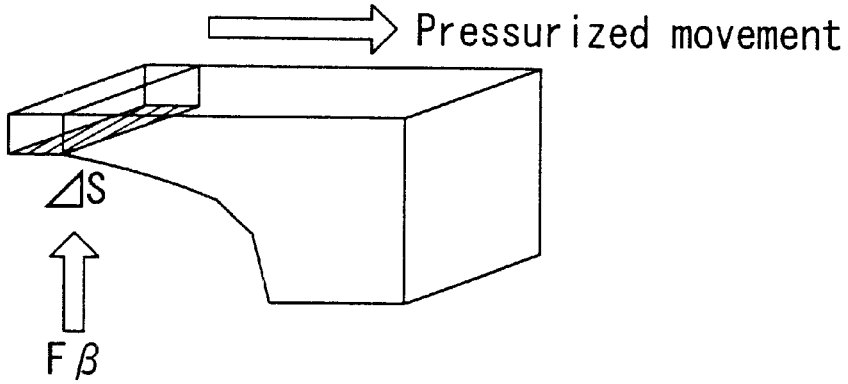
FIG. 17A is a descriptive illustration, showing one pressurized area for the technique according to the present invention.
Figure 17B:
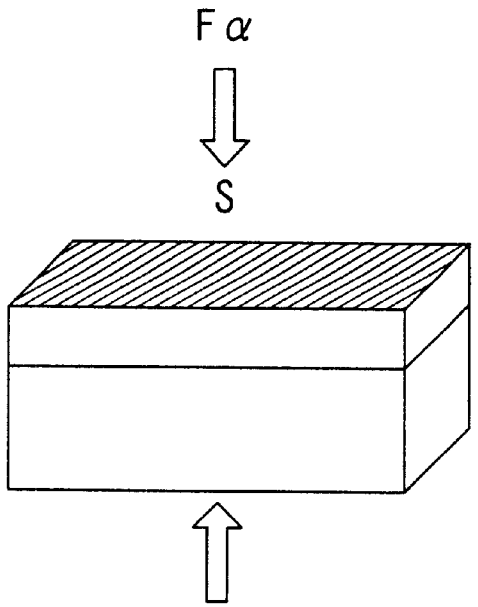
FIG. 17B is a descriptive illustration, showing another pressurized area for the prior art technique.

FIG. 17A schematically illustrates a technique according to the present invention, while FIG. 17B schematically shows a prior art technique. FIGS. 17A and 17B show differences between the technique according to the present invention and the prior art technique, more specifically, one difference in area at which required pressure is applied to compacts having the same shape, as shown by slanted lines, and another difference in the presence of pressurized movement. Reference character "σPa" in FIG. 17A and 17B denotes a compacting pressure required to achieve a target compacting density.

A relationship between the elastomeric plate 4 and the rods 3 when the insertion of the slanted surfaces 7*a*, 7*b* into the die 2 causes the rods 3 to raise the elastomeric plate 4 will be described.

Figure 18A:
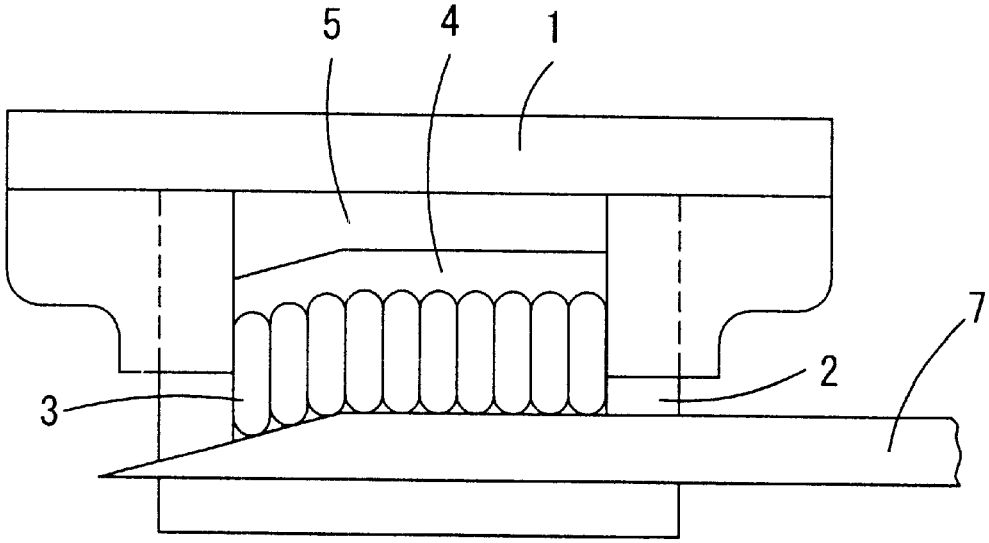
FIGS. 18A and 18B provide a descriptive illustration, showing how results of compacting vary, depending upon the presence of an elastomeric plate.
Figure 18B:
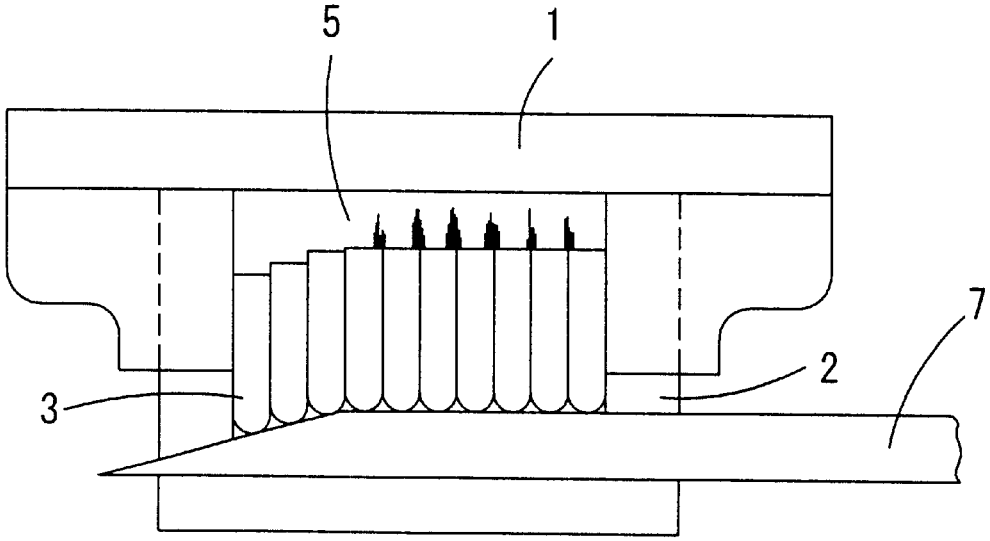

As illustrated in FIG. 18B, when it is assumed that planar pressurizing rods 3 having the powder filled thereon without the elastomeric plate 4 are sequentially raised, then a powder-filled density is distributed in a non-uniform manner for each of the rods 3 in a direction in which the wedge bar 7 is inserted. This cause brings about a compact having a non-uniform density. In addition to such an inconvenience, there occurs another inconvenience in which the powder enters gaps between the rods 3 and further gaps between the rods 3 and the die 2, thereby precluding repeated movement of the rods 3. Furthermore, for magnetic field compacting, there occurs a disturbance in magnetic orientation in the powder as well as variations in density, with the result that magnetic characteristics are rendered unstable and then degraded As shown by vertically striped patterns in FIG. 18B, the absence of the elastomeric plate 4 causes density distribution in a compact 5 to be rendered non-uniform with each of the raised rods 3. In addition, direct pressurization onto the filled powder increases friction between the powders 5. As a result, compacting fails, or otherwise a compact 5 containing internal distortions is molded. FIG. 18A illustrates a compacting process in the presence of the elastomeric plate 4, in which the wedge bar 7 is being inserted.

The important things in the present invention are to demonstrate that a continuous pressurizing surface can be provided to the filled powder, and further that the compact is achievable by the powder being partially pressurized or compressed in steps in order to provide a target shape. This shows that the above is attained by the high pressure-resistant elastomeric plate 4 being introduced into a compacting mold. Thus, the elastomeric plate 4 is a component vial to the step compression according to the present invention.

The elastomeric plate 4 sealingly attached to an inner wall of the die 2 serves to transmit to the filled powder a pressurizing force caused by the raised rods 3. At that time, the elastomeric plate 4 is desirably deformed and elongated while a minimum gap through a contact surface between the rods 3 and the elastomeric plate 4 occurs.

Figure 19A:
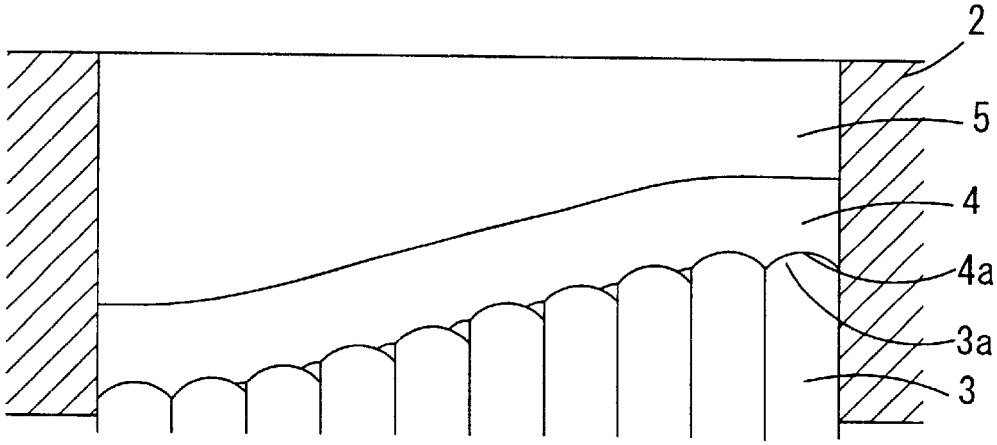
FIGS. 19A and 19B provide a descriptive illustration, showing one example in which a radius is placed on a contact between the elastomeric plate and pressurizing rods and another example in which no radius is place thereon.
Figure 19B:
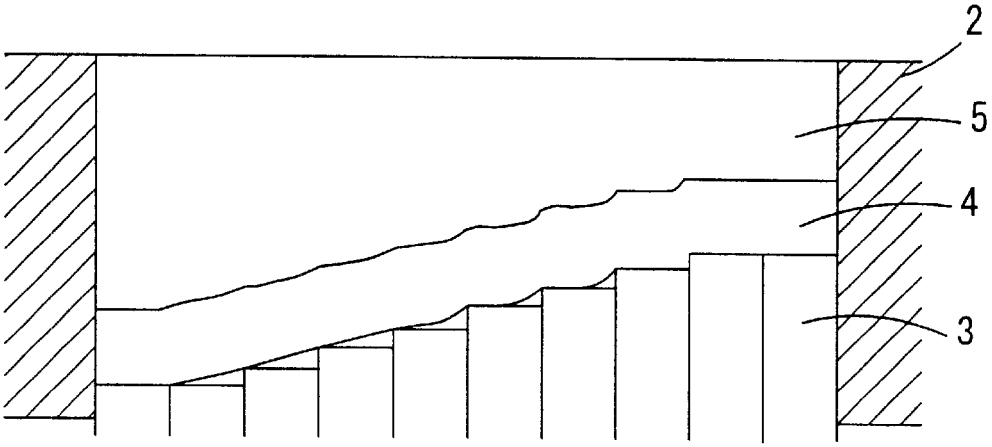

In this connection, FIGS. 19A and 19B illustrate one example in which radii are placed on the rods 3 and another example in which no radii are placed thereon. When compared with the radius-placed rods 3 in FIG. 19A, the rods 3 in FIG. 19B have the top surfaces flattened, with the result that there occurs great gaps between such flattened top surfaces and the elastomeric plate 4. Such great gaps demand an elongation rate that lies beyond a range of an elasticity limit. As a result, the elastomeric plate 4 is broken.

When being pressurized, the elastomeric plate 4 must locally be made elongated adjacent to ends of the rods 3. This means that any material simply having flexibility does not meet such a requirement. The pressurized elastomeric plate 4 returns to its original shape at the end of powder pressurization. Therefore, the elastomeric plate 4 must possess mechanical and physical properties including an elongation rate such as to meet the above requirements, and further must be made of any material to withstand an elevated pressure of 100–1000 MPa. As illustrated in FIG. 19A, the elastomeric plate 4 preferably includes concave surfaces 4*a* that mate with top surfaces of the rods 3 or convex surfaces 3*a* in order to allow such mated shapes to alleviate the above-described requirement of local elongation.

Next, the structure having the filled powder placed thereon according to the present invention will now be described, while the elastomeric plate 4 is acknowledged to be a required component. The filled powder is desirably rendered uniform as much as possible in the die 2. In addition, layers of the filled powder must be maintained uniform, even with the insertion of the wedge bar 7 during the compacting process. In order to satisfy such requirements, the elastomeric plate 4 must be held against contact surfaces between the elastomeric plate 4 and the rods 3 when the rods 3 are sequentially moved in a vertically upward direction. To this end, the elastomeric plate 4 and the rods 3 can be engaged together or rigidly secured together through the contact surfaces using an adhesive in order to prevent both ends of the elastomeric plate 4 from being lifted off the rods 3. If the underside of the elastomeric plate 4 toward the rods 3 is flattened, the lifting-off of the elastomeric plate 4 is undesirably accelerated. The most preferred elastomeric plate 4 is identical in shape to the compact at the side of the elastomeric plate 4, and further has a uniform thickness. Such a preferred example of configuration is illustrated in FIG. 12.

The preferred elastomeric plate 4 depends upon powder characteristics such as the fluidity of various kinds of powder and the presence of a lubricating agent, while depending upon a depth of the filled layers and a thickness of the compact. Thus, there exist optimum shape conditions. Therefore, optimum real dimensions must be determined according to experiments under individual compacting conditions.

In the step compression according to the present invention, the elastomeric plate 4 as well as the powder is contained in a sealed structure. In the die 2, the rods 3 designed for movement in a small void space are moved in a vertically upward direction for pressurization. Thus, the elastomeric plate 4 on the rods 3 must possess physical and mechanical properties to withstand such a reduced void space. If such properties are small, the elastomeric plate 4 fails to withstand a pressurizing force of 100–1000 MPa, and is deformed and then extruded into gaps between the elastomeric plate 4, the die 2, and the rods 3. Therefore, such extrusion must be checked. FIG. 20 illustrates results from tests on various types of rubber and the elastomeric plate 4 using a mold in which the gaps are clearly viewed.

Figure 20A:
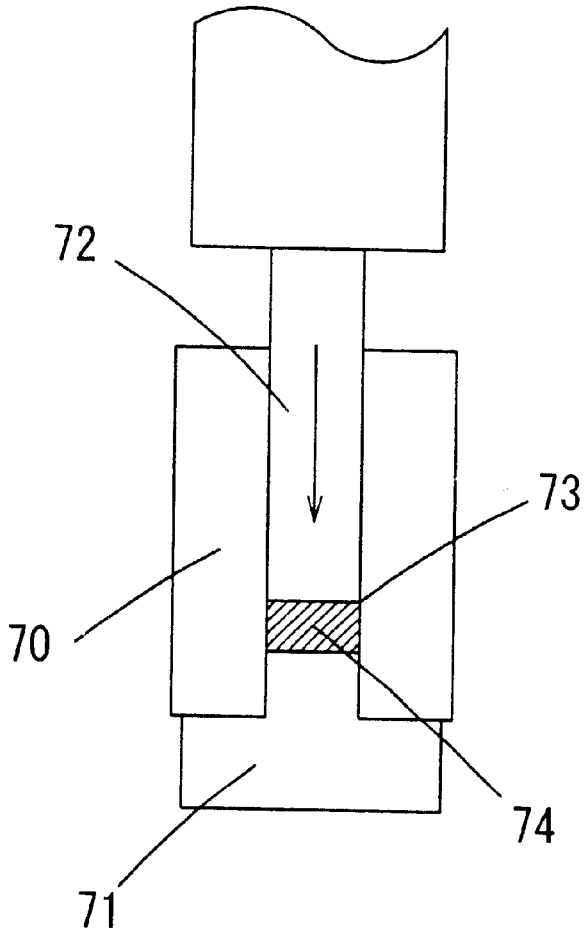
FIGS. 20A and 20B provide a descriptive illustration, showing extrusion of the elastomeric plate.
Figure 20B:
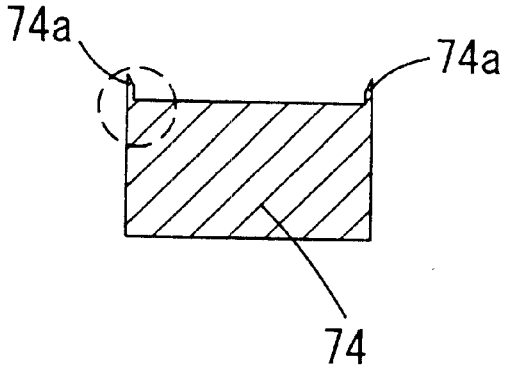

FIG. 20A is a cross-sectional view, illustrating a mold employed in the tests. The mold includes a die 70 and a bottom die 71, thereby forming the inside of the mold. Inside the mold, rubber and an elastomer 74, both of which have the same diameter, was introduced and then pressurized by means of a punch bar 72. At that time, a difference 73 in diameter between the die 70 and the punch bar 72 was set to be 70$\mu$ and 170$\mu$. The tests were carried out to see a pressure range from the moment when extrusions 74*a* are produced from the elastomeric plate 74, as illustrated in FIG. 20B, to a degree that the elastomer 74 is impossible to restore. The results are shown in Tables 1 and 2. In Table 1 and 2, each arrow shows an extrusion restorable pressure range in which a variety of materials obtained for a restorable pressure test on the rubber and elastomeric plate are determined to be durable.

TABLE 1

Rubber/Elastomer Restorable Pressure Test

| No. | Material name | Manufacture name | Extrusion restorable pressure range (MPA) | Shore hardness | Elongation rate (%) | Applicability judgment |
|---|---|---|---|---|---|---|
| | | | 100 500 1000 | | | |
| 1 | Thermosetting ether-series polyurethane TU-906 | Toyo Urethane | | 90 | 540 | Acceptable |
| 2 | Thermosetting ester-series polyurethone TU-903 | Toyo Urethane | | 90 | 550 | Acceptable |
| 3 | Thermosetting ester-series polyurethane TU-803 | Toyo Urethane | | 80 | 650 | Unacceptable |
| 4 | Thermosetting ester-series polyurethane TU-503 | Toyo Urethane | | 50 | 590 | Unacceptable |
| 5 | Thermosetting ether-series polyurethane TR200-90 | Tigers Polymer | | 90 | 520 | Acceptable |
| 6 | Thermosetting ester-series polyurethane TR100-90 | Tigers Polymer | | 90 | 460 | Unacceptable |
| 7 | Thermosetting ester-series polyurethane TR100-70 | Tigers Polymer | | 70 | 710 | Unacceptable |
| 8 | Thermosetting ester-series polyurethane TR100-50 | Tigers Polymer | | 50 | 800 | Unacceptable |
| 9 | Thermosetting ester-series polyurethane U801 | Nippon Mektron | | 95 | 550 | Acceptable |

(Note) Die-to-pressurizing punch bar gap: 70 μm ——→
Die-to-pressurizing punch bar gap: 170 μm - - - - - →

TABLE 2

Rubber/Elastomer Restorable Pressure Test
(continued from the previous page)

| No. | Material name | Manufacture name | Extrusion restorable pressure range (MPA) | Shore hardness | Elongation rate (%) | Applicability judgment |
|---|---|---|---|---|---|---|
| | | | 100 500 1000 | | | |
| 10 | Thermoplastic ester-series polyurethane iron rubber U478 | Nippon Mektron | → | 85 | 580 | Unacceptable |
| 11 | Ether-series urea resin Polea R-110 | Ihara Chemical | ——→ ---→ | 98 | 440 | Acceptable |
| 12 | Cold setting urethane Pandex, middle hardness type | Dainippon Ink | → | 60 | 450 | Unacceptable |
| 13 | Cold setting urethane Pandex, lower hardness type | Dainippon Ink | → | 40 | 600 | Unacceptable |
| 14 | Silicon rubber TSE3562 | Toshiba Silicone | → | 28 | 400 | Unacceptable |
| 15 | Natural rubber | Products on the market | → | 60 | 550 | Unacceptable |

(Note) Die-to-pressurizing punch bar gap: 70 μm ——→
Die-to-pressurizing punch bar gap: 170 μm ------→ where a different in diameter is a numeral assumed to show a setting value of precision as to how the die 2 and the rods 3 are fitted together when the mold is produced in practice. In view of practical use, the gap 73 preferably has 70μ or smaller manufacturing precision between the plurality of aligned rods 3 and an inner wall of the die, and desirably has 170μ or smaller precision as a durability limit.

It is found from the above data that the rubber/elastomer 74 falling within the range of a high pressure of 100–1000 Mpa is Nos. 1, 2, 5, 9, and 11, and has an elongation rate of 400% or greater and Shore hardness of A90 or greater. The other materials are shown exhibiting lower values of an extrusion restorable pressure range when compared with the above. As evidenced by Tables 1 and 2, the Shore hardness of A90 or greater and the extrusion restorable pressure range are not correlated, but depend upon individual manufacturers. For example, when materials having the same hardness in ester-series and ether-series urethane are compared with one another, the extrusion restorable pressure range varies from manufacture to manufacture. In Table 1, No. 2 possesses an extrusion restorable pressure of at most 1100 MPa.

In a target pressurizing range of 100 MPa or greater according to the present invention, the above data for assessing materials are not found. The rubber/elastomer 74 are rated to fall within a pressure range of some 80 MPa or smaller. For example, material assessment on an oil seal that is made of a similar material using hydraulic technology is by far low than a pressure range required for the present invention. (See "Yuatsu Gijyutsu Binran" issued by Nikkan Kogyou Shinbunsha.) Similarly, existing data as shown in material technology references and industrial standards lie within a reduced pressure range. As shown in Table 1, the present invention discovers the presence of the elastomer 74 usable within a high-pressure range in a small void space and required for a step compression mechanism.

A relationship among the upper lid 1, the die 2, and magnetic field compacting will now be described. The upper lid 1 and die 2 inevitably vary in structure according to both different shapes of the compacts and the presence of the magnetic field compacting. After pressurization is completed, the wedge bar 7 is pulled out of the die 2, and then the upper lid 1 is detached from the die 2. In this step, the compact in the die 2 is distorted and then cracked when the upper lid 1 is released from the die 2 in a state in which the elastomeric plate 4 inside the die 2 remains pressurized by the wedge bar 7 located beneath the elastomeric plate 4. The above actions are common to compacting operations related to the upper lid 1 and die 2 in the step compression according to the present invention. Initially, matters unrelated to the magnetic field compacting will be described. The die 2 and the upper lid 1 are secured together by means of either a fitting structure or a pin before the powder is compacted. At that time, the powder filled into the die 2 need not be pressurized. The upper lid 1 has the underside shaped to mate with the compact. The upper lid 1 is fixed to the die 2 at an upper opening portion thereof.

The present invention provides a technique for allowing a longer compact to be molded, when compared with conventional techniques. FIGS. 13 and 14 illustrate one useful example to use such an advantage, in which a slicer mechanism is added to the upper lid 1 and the die 2 for allowing a plurality of compacts to be molded. The slicer mechanism divides the compact into a plurality of pieces using a cutting tool when the compact is molded under pressure at the final stage in a series of processes. In this dividing step, the cutting tool may be inserted into the elastomeric plate 4; however, this is permissible because such insertion can be accommodated by the elastomeric plate 4.

It is improper to employ any material other than the elastomeric plate 4, which is an example of showing a difference between the technique according to the present invention and prior art techniques. The upper lid 1 is detached from the die 2 in either a vertically upward or a horizontal direction after the powder is compacted, irrespective of whether the above mechanism is present. A direction in which the upper lid 1 is released from the die 2 is selected according to a shape of the compact under conditions in which improper pressure such as to bring about inconveniences to the compact is not applied to the compact during the above detachment. For example, when the compact is a rectangular, then the upper lid 1 can be detached in the horizontal direction as well.

A mechanism for knocking out the compact from the die 2 after release of the upper lid 1 from the die 2 will now be described. In prior art techniques, compacting is completed at a substantially middle portion of the die 2. At that time, several inconveniences occur: scuffing adhesion of metallic powder between the inner wall of the die 2 and the upper-lower punches; and, chip-off and cracks of the compact, which occurs between the compact and the die inner wall when the compact is knocked out. In order to prevent such inconveniences, there provided countermeasures such as granulated powder resulting from mixture of a various types of organic binders with original powder, addition of a lubricating agent, a draft-tapered die inner surface that extends from a deep position, and the use of a mold having an ultra-hardened alloy fitted thereto. However, these countermeasures cannot allow conventional techniques to release the step of compacting the powder using a high level of a total pressurizing force in which a target pressure is applied to a compact projection area in a moving direction of the upper punch. Meanwhile, compacting cannot be realized without a high-cost, durable mold structure and a compacting apparatus capable of supplying an elevated pressure.

In the step compression according to the present invention, operative knockout is achievable by a draft-tapered die that extends from a shallow position and further that is substantially identical in dimension to the compact. In addition, any mold structure is acceptable, which has wear-resistant coating applied thereto, depending upon certain kinds of powder, and further which is designed to accommodate a lower level of a total pressurizing force. In this way, the present invention realizes a low cost technique in both of the mold and the compacting apparatus.

Figure 21:
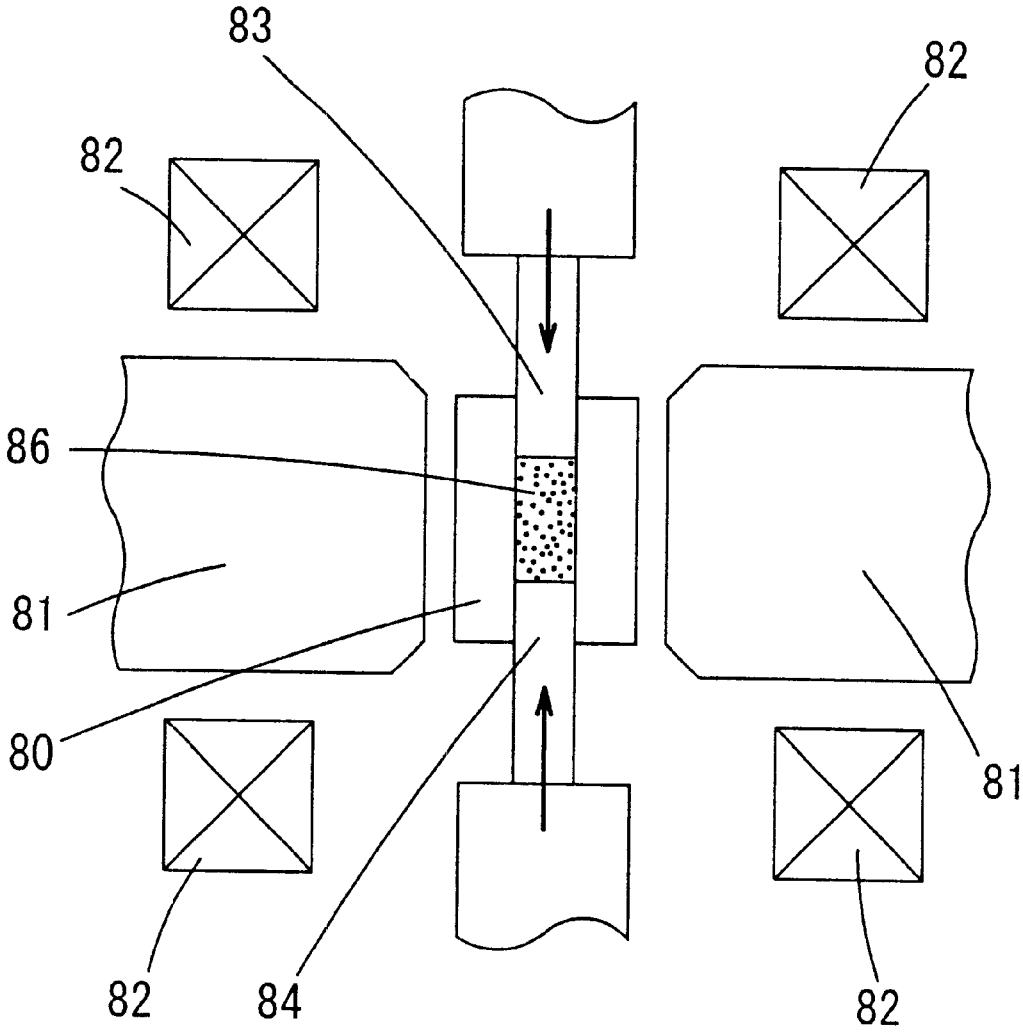
FIG. 21 is a descriptive illustration, showing a transverse magnetic field compacting according to the prior art.
Figure 22:
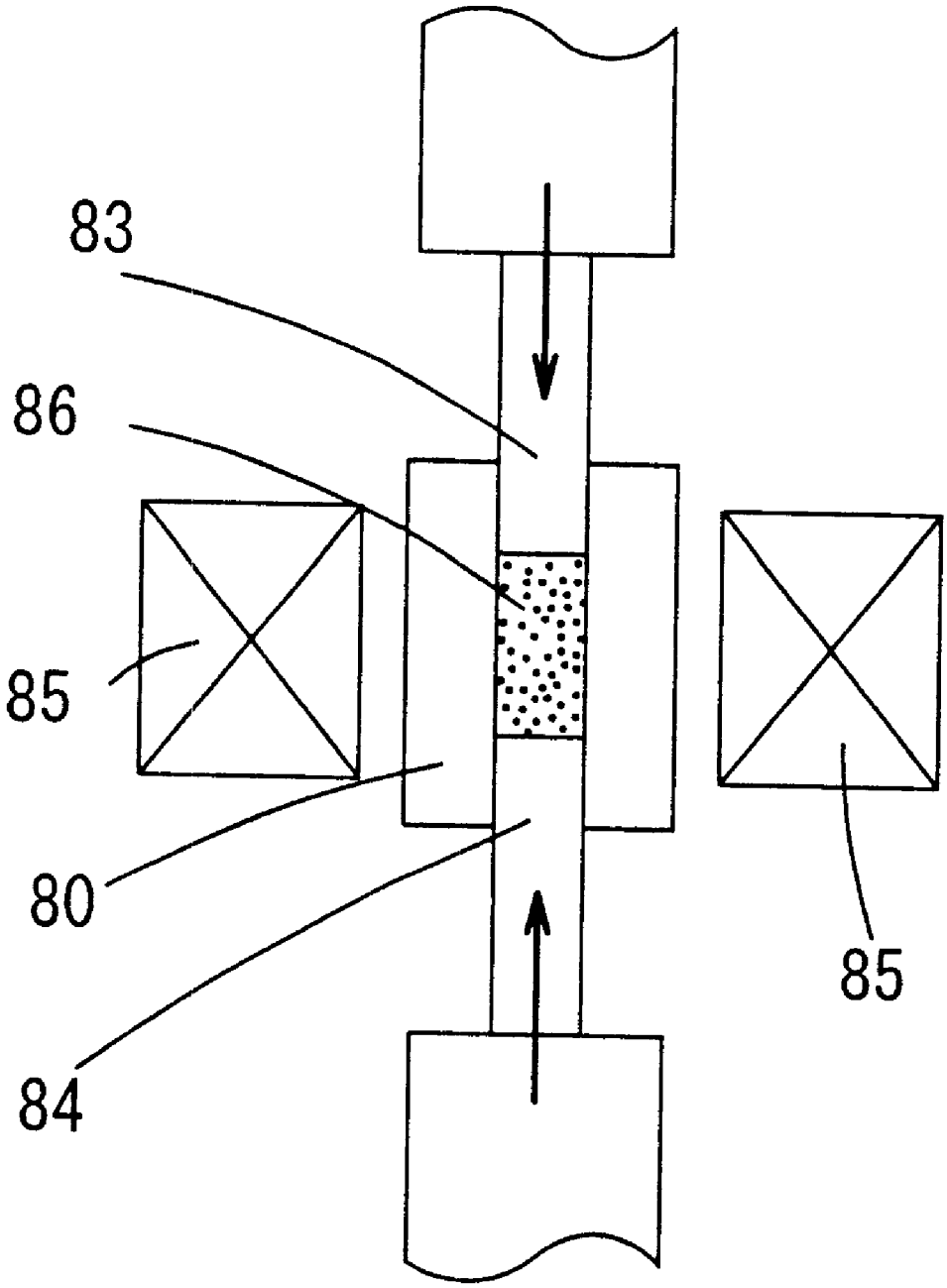
FIG. 22 is a descriptive illustration, showing longitudinal magnetic field compacting according to the prior art.

Next, the magnetic field compacting will be described. As illustrated in FIG. 4, the technique according to the present invention involves magnetic field compacting using both the magnetic field coil 11 and a magnetic circuit that includes an either magnetic or non-magnetic material. Meanwhile, prior art techniques involve one referred to as transverse magnetic field compacting by those skilled in the art, as illustrated in FIG. 21, in which the powder is compacted in directions both vertical and horizontal to a direction in which the magnetic field coil generates a magnetic field. FIG. 21 illustrates the transverse magnetic field compacting, in which a pair of magnetic yokes 81 is disposed on both sides of a die 80, while a magnetic coil 82 is trained around each of the magnetic yokes 81. Reference numerals 83 and 84 denote upper and lower punches, respectively. FIG. 22 illustrates longitudinal magnetic field compacting, in which a magnetic field coil 85 is wound around the die 80. Reference numeral 86 denotes a compact.

Figure 23:
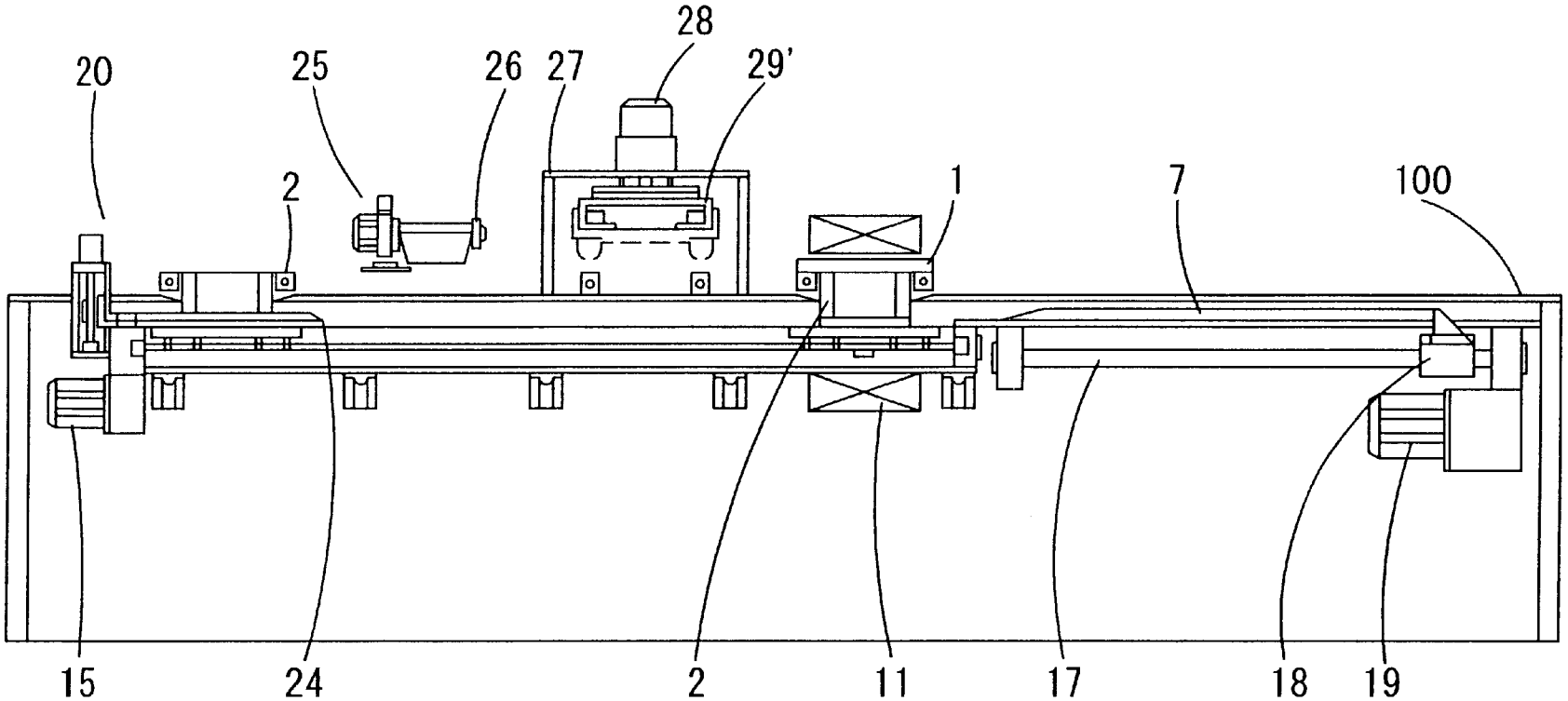
FIG. 23 is a side view, illustrating a powder-compacting apparatus according to an eleventh embodiment.
Figure 24:
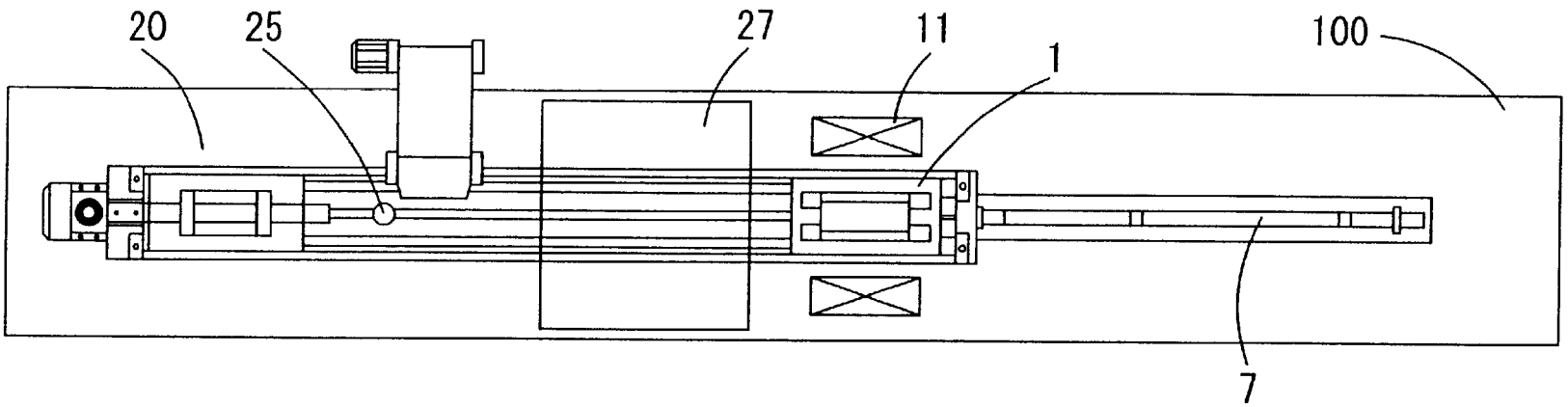
FIG. 24 is a plan view, illustrating the powder-compacting apparatus.
Figure 25:
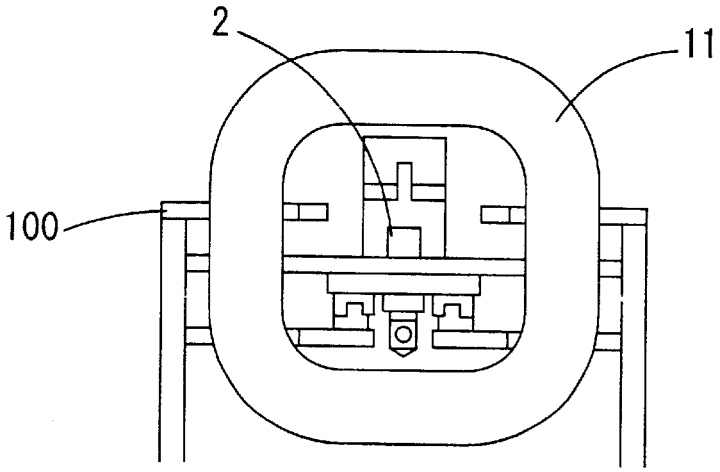
FIG. 25 is a cross-sectional view, illustrating a position at which powder is compacted.

FIGS. 23–25 illustrate an eleventh embodiment. This embodiment is comparable in feature to FIG. 21, but is shown greatly different from FIG. 21 in view of appearance and function of a compacting apparatus.

In conventional techniques, the upper and lower punches 83, 84 are fitted onto pointed ends of upper-lower rams or cylinders as a driving actuator, and are driven to pressurize the powder, as illustrated in FIG. 21. Thus, a pressurizing force from the driving actuator acts in a vertical direction. In the present invention, the pressurizing rods 3 as well as the slanted surface 7*a* of the wedge bar 7 moved in a horizontal direction cause the pressurizing force to be shifted in the vertical direction.

Such a compacting mechanism makes it possible to realize a transverse magnetic field-compacting apparatus as illustrated in FIGS. 23–25, which is new to conventional techniques. The transverse magnetic field-compacting apparatus is designed to permit the die 2 to be moved and then inserted into the magnetic field coil 11. In conventional transverse magnetic field-compacting apparatus, a typical combination of two magnetic field coils 82 and one yoke 81 imparts a parallel magnetic field to the powder in the die 80, as illustrated in FIG. 21. According to the present invention, one magnetic field coil 11 houses the die 2, as illustrated in FIG. 4. This system can realize at one time downsizing of the magnetic field coil 11, elimination of the magnetic circuit yoke, and a space saving.

More specifically, the eleventh embodiment is nearly common in structure to the embodiment as shown in FIGS. 5 and 6, but differs in that a compact-pressurized position is provided between one position at which the upper lid 1 is opened and closed and another position at which the wedge bar 7 is retracted. At the compact-pressurized position, the magnetic field coil 11 is disposed for inserting the die 2 therein while carrying a shaft of the die 2, which shaft extends in a direction in which the die 2 is moved. The upper lid 1, a typical lid, not a yoke, is removably attached to an upper lid mounted body 29' of an upper lid-driving means by being pin-connected thereto by means of a pin-driving means. After a powder-filling apparatus 26 fills the powder into the die 2, a motor 28 lowers the upper lid 1 onto the die 2 at an upper lid-mounting position. The die 2 having the upper lid 1 fixed thereto is then moved to the compact-pressurized position. The steps of compacting the powder by the insertion of the wedge bar 7 and then discharging the compact from the die 2 are practiced in a similar manner as shown in FIGS. 5 and 6, and the same reference characters are used for features common to those of FIGS. 5 and 6. Reference numeral 100 denotes a supporting platform. In addition, a plurality of the above apparatus may be arranged longitudinally and transversely in a manner similar to the seventh embodiment.

The compacting apparatus according to the present invention employs a thinner magnetic field coil, not the above-described magnetic field coil 11 that accommodates the entire die 2, and applies a magnetic field of 5T or greater to the powder by means of a high-magnetic field pulse power source according to stages in which the wedge bar 7 is inserted into the die 2. As a result, it is expected to realize a magnet having further high magnetic characteristics.

In conclusion, it has been regarded according to conventional techniques that a compacting apparatus, a compacting mold, and a compacting method, all of which are employed in a powder-compacting field, must be provided with features capable of accepting almost all target compact shapes.

Figure 26:
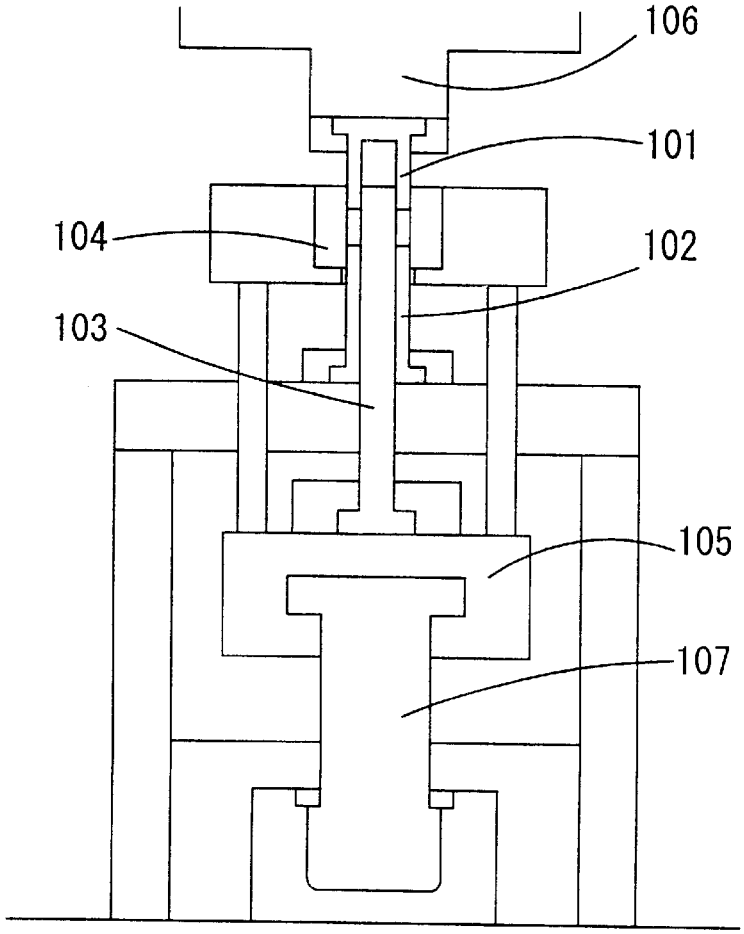
FIG. 26 is a cross-sectional view, illustrating a powder-compacting apparatus including a core rod according to the prior art.

For example, it has been considered as being proper that a compacting mold including upper-lower punches 101 and 102, a core rod 103, and a die 104 is attached to a die set 105, as illustrated in FIG. 26, in order to accommodate a variety of shapes. Reference numerals 106, 107 denote upper and lower rams. In addition, the step of compacting the powder in the filled space using uniform pressurizing surfaces has been thought of as the sole compacting method. To this end, granulation in which a binder is added to the powder, addition of a lubricating agent, and setting of complicated pressurizing profiling are practiced as a matter of course. Furthermore, a fixed idea in which compacting must be completed at the middle of the die 104 has been accepted. An object of the present invention is to overcome such a fixed idea, and then to demonstrate the presence of a technique that has heretofore remained.

Introducing the step compression according to the present invention provides many advantages in which a reduction in total pressurizing force during powder compacting is attained by the step of completing partially pressurizing the compact at an upper portion of the die 2, and further which downsizing of the compacting apparatus, laminated layers of the compacting apparatus that are connected together, sealing of inert gases, and a reduction in mold cost are achievable. A variety of compacts as indicated in the undermentioned embodiments is an example of demonstrating effectiveness of the compacting method according to the present invention.

Figure 27C:
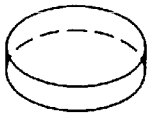
FIGS. 27A–C are perspective views, illustration a die, a wedge bar, and pressurizing rods for use in compacting powder into a circular plate-shaped compact according to a twelfth embodiment.
Figure 27B:
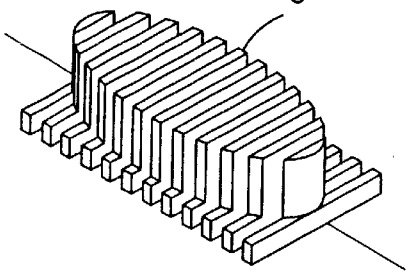
Figure 27A:
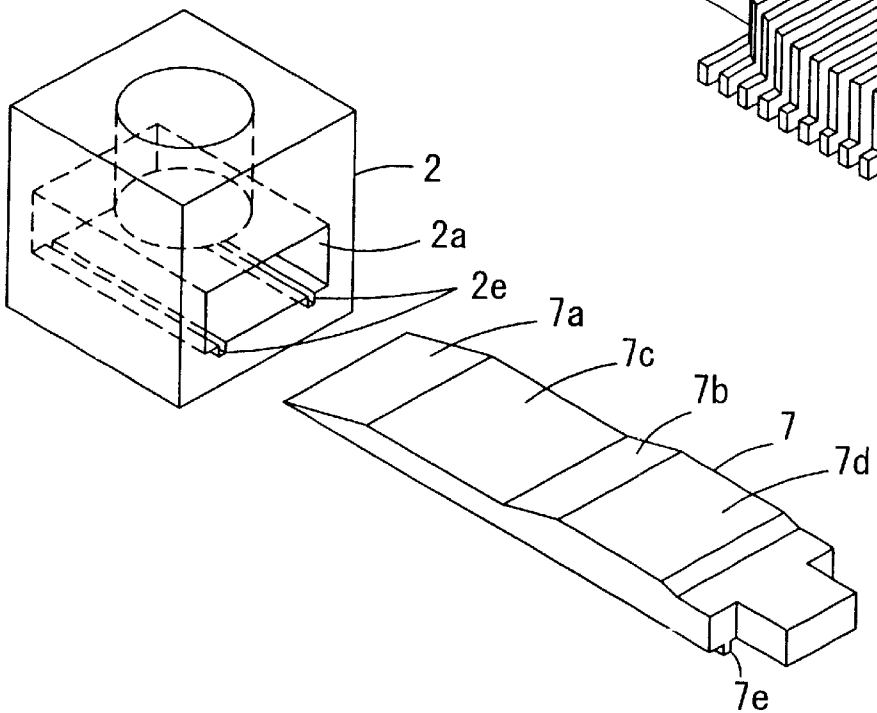
Figure 28D:
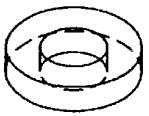
FIGS. 28A–D are perspective views, showing each section of the powder-compacting apparatus that includes a core rod.
Figure 28C:
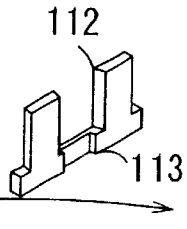
Figure 28B:
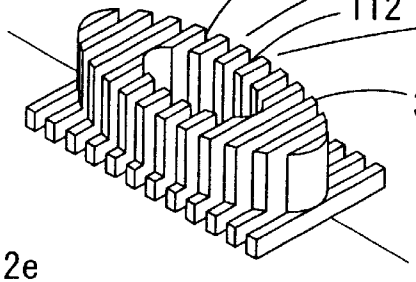
Figure 28A:
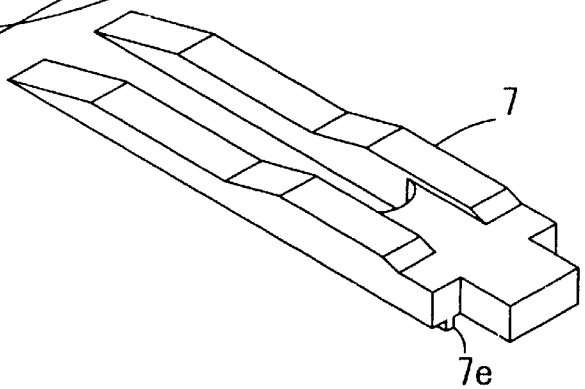
Figure 28A:
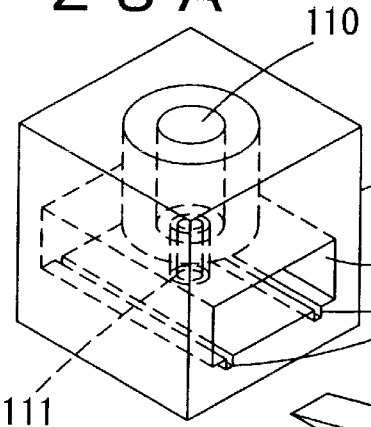

FIGS. 27 and 28 illustrate a twelve embodiment. In the previous embodiments, shapes requiring no core rod have been described. For example, FIG. 27 illustrates an example of a compact in the form of a circular plate that has a diameter 100 mm or greater. FIG. 27A illustrates a die 2 and a wedge bar 7. The die 2 has a pair of grooves 2*e* formed at a lower opening 2*a* thereof for guiding the wedge bar 7. The wedge bar 7 is defined with a pair of elongated protrusions 7*e* for engagement with the grooves 2*e*. FIG. 27B illustrates a plurality of spaced-apart pressurizing rods 3. FIG. 27C illustrates a compact. FIG. 28 illustrates a compact in the form of a holed circular plate as one example in which any compact shaped to require a core rod can be molded by means of a partly modified mold structure. The compact in FIG. 28 forms a typical speaker magnet shape. A core rod 110 is a cylindrical object positioned at a central portion of the die 2. The lowermost end of the core rod 110 is combined integrally with the bottom of the die 2 through a rectangular connection 111. A wedge bar 7 is forked to avoid the connection 111. An elastic plate is shaped to permit the core rod 110 to extend through the elastic plate, is thereby formed in a manner substantially similar to a ring-shaped compact as illustrated in FIG. 28D. Pressurizing rods 3 are formed with cutouts 112 in order to avoid the core rod 110, and further with concaves 113 at side surfaces of the rods 3 in order to avoid the connection 111.

Figures 29A, 29B, 29C:
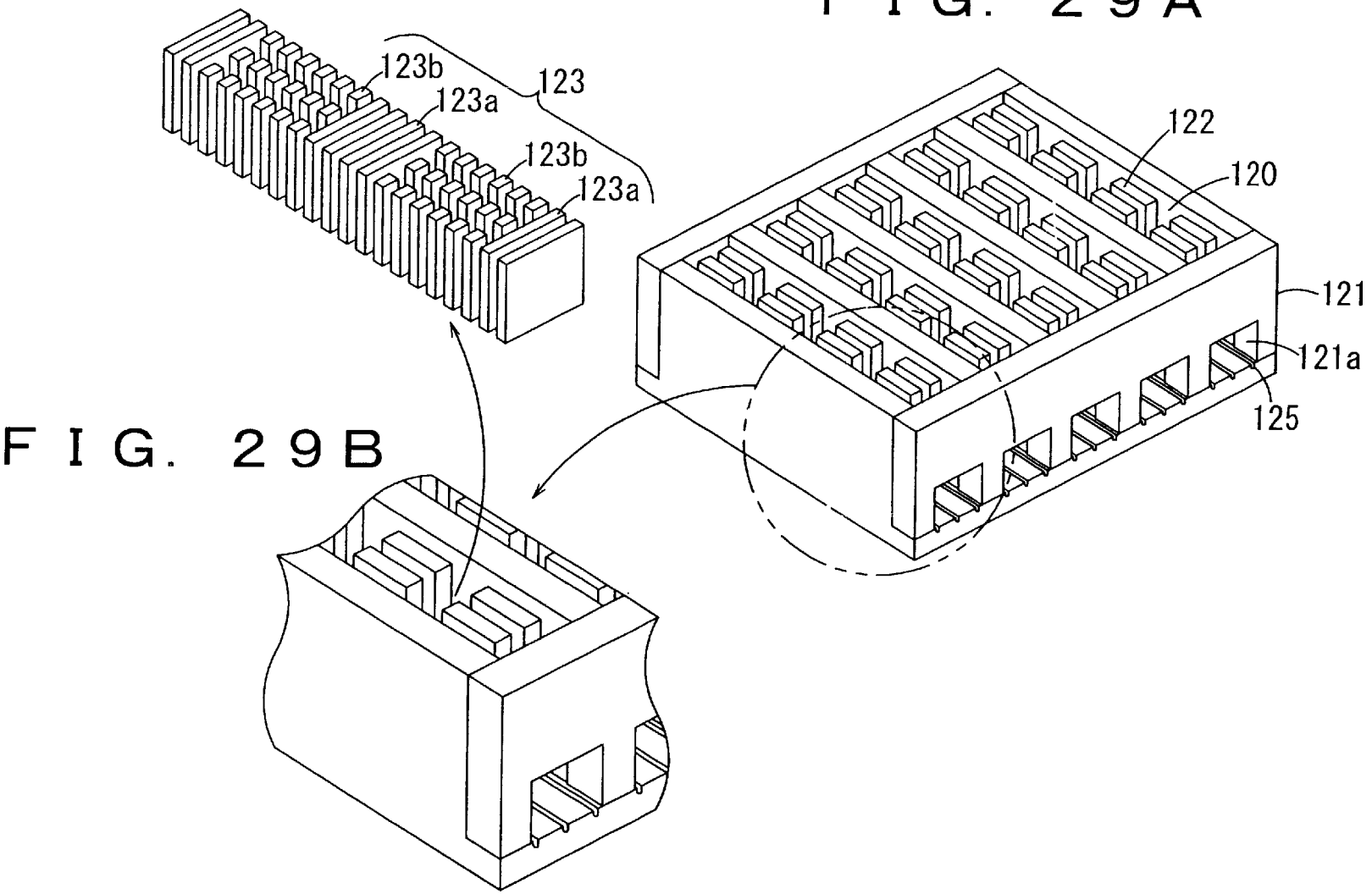
FIGS. 29A–C are perspective views, illustrating a die and pressurized rods for use in compacting powder into an E-shaped compact according to a thirteenth embodiment.
Figure 30A:
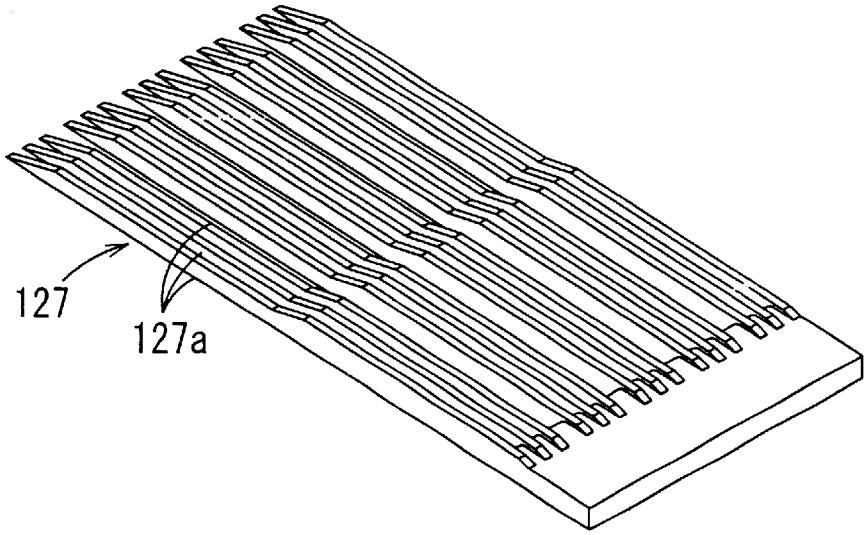
FIGS. 30A–C are perspective views, showing a wedge bar, an upper lid having slicers disposed thereon, and E-shaped compacts.
Figure 30B:
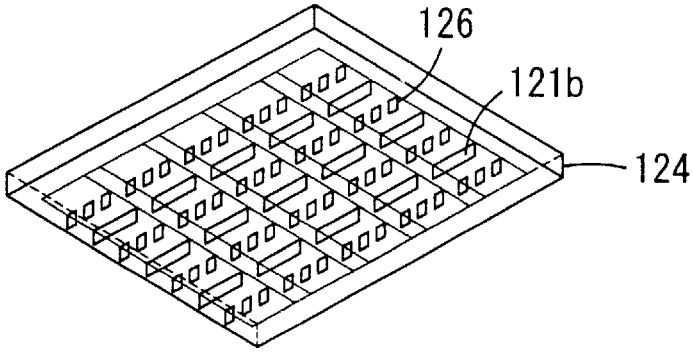
Figure 30C:
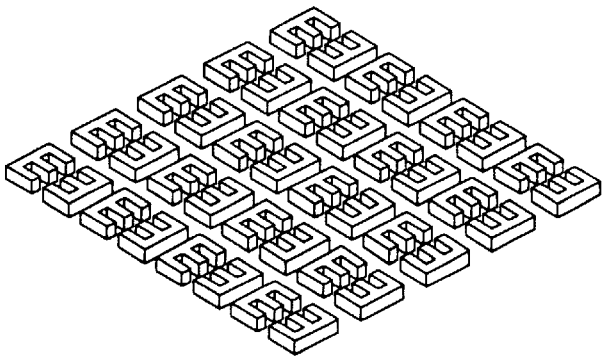

FIGS. 29 and 30 illustrate a thirteenth embodiment. The novelty and usefulness of the present invention is demonstrated in a structure of a compacting mold for compacting the powder into a plurality of E-shaped compacts having trans-core shapes in the field of soft ferrite as well as in the previous embodiment as shown in FIG. 28. FIGS. 29A and 29B illustrate a die 121 that includes five containers 120. Each of the containers 120 has eight cores 122 in two adjacent columns (four cores 122 for each of the columns). The cores 122 and the bottom surface of the die 121 are combined together by means of a connection (not shown) that is constructed in a manner similar to the connection 111 as shown in FIG. 28. FIG. 29C illustrates a pressurizing rod 123 that includes plate-like pressurizing rods 123*a*, which do not straddle the cores 122, and substantially W-shaped pressurizing rods 123*b* that straddle the cores 122. The pressurizing rod 123 has concaves (not shown) formed along side surfaces thereof in order to the connection. An elastic plate (not shown) is formed into a planar plate that includes holes, through which the cores 122 are penetrated. As shown in FIG. 30A, each wedge bar 127 is three-forked to correspond with the container 120 in order to avoid the cores 122. In addition, the same number of the wedge bars 127 as the number of the containers 120 is connected together. Each wedge portion 127*a* has an elongated protrusion (not shown) defined on the underside thereof so as to be engaged with a groove 125 of the die 121 at a lower opening 121*a*. FIG. 30B illustrates an upper lid 124 with slicers for slicing the compact to a predetermined length. Each slicer 125 disposed between four cores 122 aligned in a row protrudes in the form of a rectangle, while each slicer 126 is divided into three parts in order to avoid the cores 122. FIG. 30C illustrates finished compacts. The slicers 125, 126 form eight E-shaped compacts in each array.

Figures 31A, 31B, 31C:
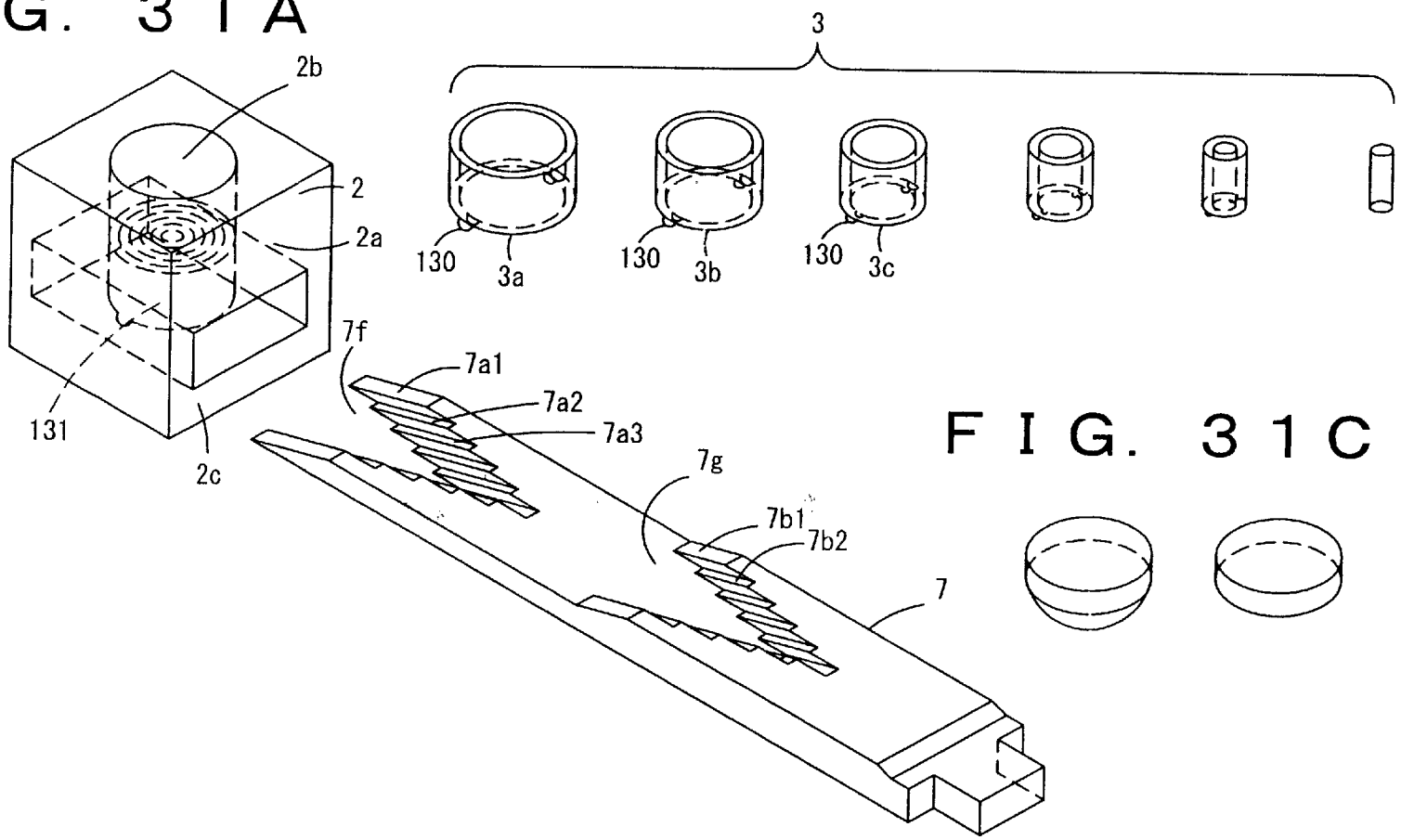
FIG. 31A is a perspective view, showing a die and a wedge bar for use in compacting powder into a circular plate-shaped compact according to a fourteenth embodiment.
FIG. 31B is a perspective view, illustrating pressurizing rods.
FIG. 31C is a perspective view, illustrating compacts.
Figure 32A:
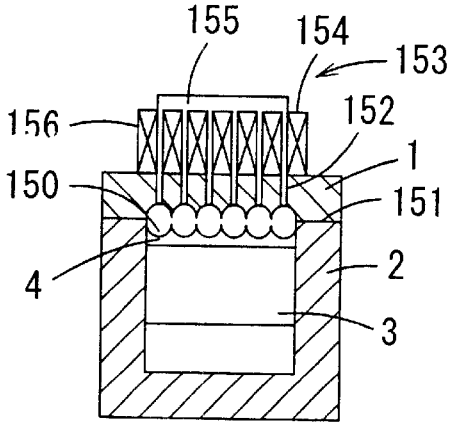
FIG. 32A is a longitudinal cross-sectional view, illustrating a powder-compacting apparatus according to a fifteenth embodiment.
Figure 32B:
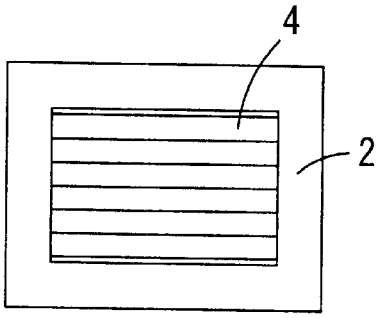
FIG. 32B is a plan view, showing the powder-compacting apparatus.
Figure 32C:
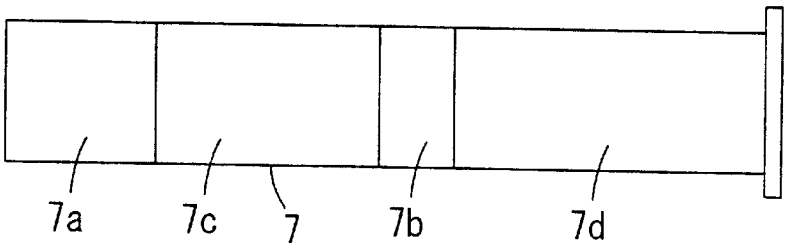
FIG. 32C is a plan view, illustrating a wedge bar.
Figure 32D:
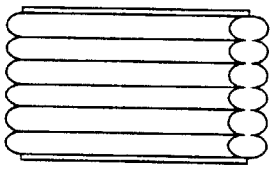
FIG. 32D is a perspective view, illustrating compacts.

FIG. 31 illustrates a fourteenth embodiment, i.e., another combination of cylindrical pressurizing rods and a wedge bar by way of one example for producing a compact either in the form of a circular plate or having a semi-sphere on one side surface thereof, as illustrated in FIG. 31C, which is not limited to soft ferrite, magnets, and powder metallurgy.

A die 2 has a cylindrical hole vertically defined at a central portion thereof. The cylindrical hole includes an upper opening 2*b*, while a lower opening 2*a* is horizontally formed at a bottom 2*c* of the die 2. A pressurizing rod 3 includes a plurality of concentric cylinders having different diameters. The rod 3 is slidably inserted in the die 2. Reference numeral 130 denotes a rotation-proof protrusion to be engaged in position with an engagement concave 131 of the die 2 on an inner bottom surface thereof. An elastic plate in the form of a circular plate is inserted in the cylindrical hole. The wedge bar 7 has a substantially V-shaped portion 7*f* removed and defined at a pointed end thereof, and further has slanted surfaces 7*a* formed in stages on both pointed end and inner surfaces of the V-shaped portion 7*f*. In addition, a staged portion is provided toward a proximal end of the wedge bar 7 on an upper surface thereof, and another substantially V-shaped portion 7*g*, which is similar to the former V-shaped portion 7*f*, is removed and defined at a pointed end of the staged portion. Similarly, slanted surfaces 7*b* are formed in stages on both pointed end and inner surfaces of the V-shaped portion 7*g*. Thus, the wedge bar 7 forms a two-stage construction.

The rods 3 are all inserted into the die 2, and the elastic plate is subsequently inserted to be disposed on the rods 3. An upper lid (not shown) is closed after the die 2 is filled with powder. Then, the wedge bar 7 is inserted into the die 2 through the lower opening 2*a*. As a result, a pair of first slanted surfaces 7*a*1 at both ends of the wedge bar 7 at the pointed end thereof raises an outermost rod 3*a* of the rod 3, and then a pair of second slanted surfaces 7*a*2 raises an inner rod 3*b*. Similarly, the other smaller rods are raised in sequence, thereby providing first compacting. In addition, the slanted surfaces 7*b*1, 71*b* on the upper stage provide ultimate compacting.

FIG. 32 illustrates a fifteenth embodiment. In FIG. 32A, reference numeral 2 denotes a die. FIG. 32B is a plan view, illustrating the die. Reference numeral 3 denotes a pressurizing rod that includes planar plates. Reference numeral 4 denotes an elastomeric plate having six substantially semi-cylindrical concaves 160 closely arranged on one surface opposite to the rod 3. Reference numeral 1 denotes an upper lid that is formed with six semi-cylindrical concaves 151 so as to oppose the concaves 150. The upper lid 1 is further formed with yoke-inserting grooves 152 that are penetrated through the bottoms of the concaves 151. Reference numeral 153 denotes a magnetic yoke that includes six legs 154 inserted into the yoke-inserting grooves 152 and a connector 155 for connecting the legs together. Reference numeral 156 denotes a magnetic field coil disposed to generate and then introduce a magnetic field into a compact through the legs 152. As illustrated in FIG. 32C, a wedge bar 7 is of a two-stage construction similar to that in the first embodiment. FIG. 32D illustrates a compact including six closely aligned cylinders that are separable after compacting. The compact is shown by way of one example of a multi-connected, solid compact that has a cylindrical shape and reduced strength.

Next, examples of a variety of powder compacting under conditions in which the step compression according to the present invention is employed will be described in comparison with a total pressurizing force required for conventional techniques.

EXAMPLE 1

This example involves compacting an Mn-Zn ferrite granule material into a shape of a large-scaled rectangular plate. A compact in the form of a large-scaled rectangular plate having a size of 120×120×10 mm was produced using the technique according to the present invention. The compacting was practiced using a mold structure as shown in FIG. 1 and a compacting apparatus free of a magnetic coil, but including a wedge bar-driving actuator having a pressurizing force of 250 kN, as illustrated in FIGS. 8 and 9.

Figure 33D:
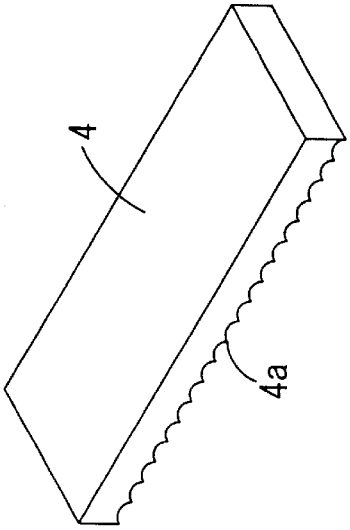
FIG. 33D is a perspective view, showing one type of an elastomeric plate.

In the powder compacting, twelve pressurizing rods disposed in a die 2 and a wedge bar 7 having a slanted surface inclined at an angle of 6° were used. Each of the rods is 10 mm thick and 120 mm wide. An elastomeric plate 4 made of material No. 5 selected from Table 1 is equal in size to a die opening surface, and is further formed with concave grooves 4*a*, each of which forms a semi-circular shape in cross-section, as illustrated in FIG. 33D. The concave grooves 4*a* engage with upper ends of the rods 3, each of which similarly forms a semi-circular shape in cross-section. The die 2 was draft-tapered by an amount of 2/100 along an inner surface thereof to a depth of 10 mm from an upper opening 2*b* for knocking out the compact from the die 2. The die 2 was formed by no ultra-hardened raw material, but only by die steel.

Figure 34A:
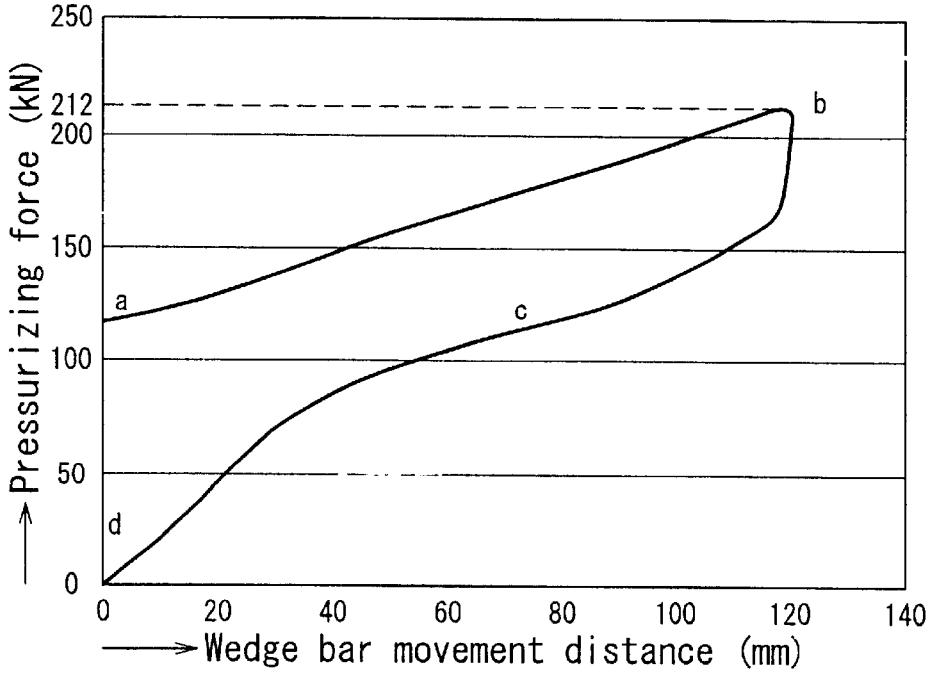
FIG. 34A is a graph, illustrating a compacting pressurizing force curve.
Figure 34B:
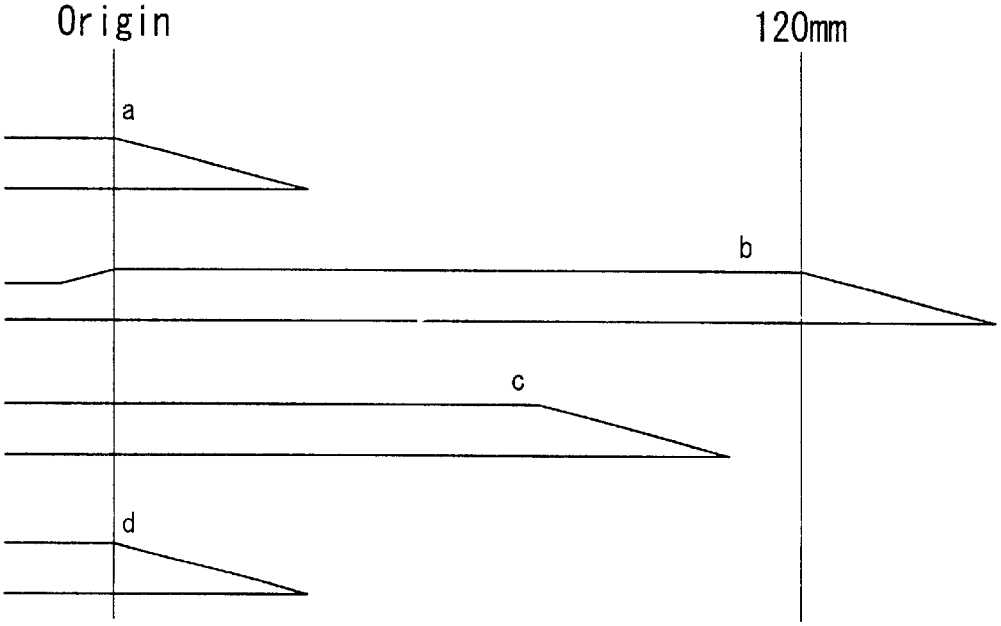
FIG. 34B is a descriptive illustration, showing respective positions of a wedge.

FIG. 34 illustrates a compacting pressurizing force curve during step compression compacting using a compacting apparatus as shown in FIGS. 8 and 9. In FIG. 34A, reference characters "a"–"d" denote respective positions "a"–"d" at which respective wedges as shown in FIG. 34B were moved halfway at one reciprocating stroke. The maximum pressurizing force in FIG. 34A was 212 kN on an average after tests were made ten times. The pressurizing force curve includes an internal stress to be stored in the elastomeric plate 4 when the wedge bar 7 is inserted into and pulled out of the die 2, and a frictional force between the bottom of the die 2 and the pressurizing rods 4. In the compacting operation, it was acknowledged that the elastomeric plate 4 withstands continuing use without experiencing any damage.

Prior art techniques require a pressure of 175 MPa in order to obtain a compacting density of 2.88×103 kg/m3, and a total pressurizing force of 2520 kN is required for the entire compacting area. Meanwhile, pursuant to the present invention, the step compression system was able to provide a compact having a target density using a total pressurizing force that is some 8.5% of that in the prior art techniques.

EXAMPLE 2

Sr-ferrite sintered powder was magnetic field-compacted to obtain a 200×120×20 mm compact in the form of a rectangular plate. A mold as illustrated in FIG. 1, which is capable of molding a compact having the above shape, and further which includes a mold structure made of a non-magnetic material except for a sidewall of the die 2 and a surface of the upper lid 2 opposite the compact, was disposed in the magnetic field coil 11 as illustrated in FIGS. 8 and 9. The magnetic field coil 11 and a magnetic field power source were such as to produce and apply a magnetic filed of some 800 kA/m in the die 2 at a position where the powder is filled into the die 2. Twenty plate-like pressurizing rods 3, each of which was 10 mm thick and 120 mm wide, were disposed in the die 2. An elastomeric plate 4 as illustrated in 33D and made of material No. 9 of Table 1 was used. A wedge bar 7 had a 210 mm long parallel surface 7*c* formed between slanted surfaces 7*a*, 7*b*, and further had the same slanted surfaces 7*a*, 7*b* inclined at first- and second-stage angles of 8° and 6°, respectively.

The die 2 was draft-tapered along an inner surface thereof to a depth of 20 mm from an upper opening 2*b* under the same condition as those in the Example 1. The above-described magnetic field was continuously applied at a position where the parallel surface 7*c* and the second-stage slanted surface 7*b* are located in the die 2. A magnetic field compact having a target density of 2.94×103 kg/m3 was yielded by the compacting according to the action diagram as shown in FIG. 7. At that time, the maximum pressurizing force in a pressurizing force curve similar to that of FIG. 34 was 132 kN on an average after tests were made ten times. In order to obtain such a density, a pressure of 100 MPa is required according to the present invention. In conventional techniques, such a requirement can be met only by the use of a compacting apparatus having a total pressurizing force of 2400 kN or greater. Therefore, Example 2 demonstrates a greatly reduced level of a total pressurizing force, which was of 5.5% of that in the conventional techniques.

EXAMPLE 3

Example 3 is intended to provide magnetic field compacting of Sr-ferrite compressed bond powder in order to obtain compacts having the same shape, each of which has a diameter of 13.6×224 mm2, in which a width of each contact surface is extended by an amount of 0.2 mm. In the powder compacting, a compacting apparatus as illustrated in FIGS. 5 and 6, a mold structure as shown in FIG. 33, and an elastomeric plate 4 shaped as illustrated in FIG. 33D and made of material No. 2 in Table 1 were used. The elastomeric plate 4 has six concave grooves sequentially formed on a surface that opposes an upper lid 1. In addition, twenty-eight pressurizing rods 3, each of which is 8.0 mm thick and 27.6 mm wide, were disposed in a die 2. A wedge bar 7 has first- and second-stage slanted surfaces 7*a*, 7*b* inclined at each angle of 6°. While a 230 mm long parallel surface 7*c* located between the slanted surfaces 7*a*, 7*b* and the second stage-slanted surface 7*b* were inserted into the die 2, a magnetic circuit disposed on the upper lid 1 applied a magnetic field of some 1 MA/m to the filled powder. The powder compacting was practiced according to the action diagram of FIG. 7.

The Sr-ferrite compressed bond powder exhibited compression characteristics of 3.94×103 kg/m3 under the pressure of 500 MPa. In prior art techniques, a total pressurizing force of 3090 kN is required, which results from the pressure times a projection area of the compact in a direction in which the compact is pressurized.

In the apparatus employed in Example 3, the maximum pressurizing force in a pressurizing force curve similar to that of FIG. 34 was 164 kN on an average after test were made ten times. Thus, the present invention achieved a reduced level of a total pressurizing force, which was 5.3% of that in conventional techniques. The elastomeric plate 4 withstood continuing use under a pressure ranging from 0 to 500 MPa. It was ascertained that there was not any damage to gaps of 30–150 μm between the die 2 and the rods 3, which otherwise would result from extrusion of the compact.

EXAMPLE 4

Figure 33E:
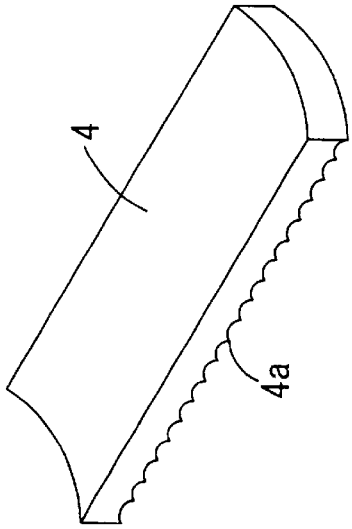
FIG. 33E is a perspective view, showing another type of an elastomeric plate.

Example 4 is intended to compact Nd—Fe—B-series sintered powder using a mold structure as shown in FIG. 4 in order to provide a compact in the form of a VCM magnet. In the powder compacting, an apparatus as shown in FIGS. 23 and 24, an elastomeric plate 4 fabricated from material No. 1 in Table 1, and a mold with an upper lid 1 having the underside shaped to provide two radius grooves were used. The elastomeric plate 4 having a projection area dimension of 40×120 mm includes arcuate surfaces as illustrated in FIG. 33E.

In order to cause a mold in the die 2 to be mounted in a magnetic field coil 11, the mold as well as the wedge bar 7 were made of a non-magnetic raw material, except for part of an inner side surface of the mold in a direction in which the wedge bar 7 is advanced. Twenty pressurizing rods 3 made of a stellite-series non-magnetic raw material, each of which is 6.0 mm thick and 4.0 mm wide, were positioned in the die 2. The wedge bar 7 has first- and second-stage slanted surfaces inclined at 6° and 4°, respectively. While a parallel surface 7*c* formed between the slanted surfaces as well as the second-stage slanted surface 7*b* were inserted into the die 2 to compact the powder having a density of some 2.5–3.0× 103 kg/m3, a magnetic field coil applied a magnetic field of 1.6 MA/m to the powder A compact was ultimately pressurized by means of a terminal end of the second-stage slanted surface 7*b*. The maximum pressurizing force similar to those in the above Examples was 102 kN on an average after tests were made ten times. In prior art techniques, 1200 kN is required to obtain a compression density of 4.75×103 kg/m3 under the pressure of 250 MPa. Meanwhile, the technique according to the present invention was able to provide magnetic field compacting using a total pressurizing force that was 8.3% of that in the prior art techniques. The die 2 was made of die steel subjected to nitriding. In addition, the die 2 was draft-tapered along an inner wall thereof by an amount of 2/100 (20 mm from an upper opening). As a result, scuffing adhesion encountered in conventional techniques was eliminated.

EXAMPLE 5

Sr-ferrite sintered powder was magnetic field-compacted to provide a circular compact having a diameter of 120×15 mm. A die 2 having a mold construction as shown in FIG. 27 and having an inner diameter of 120 mm, twelve circular pressurizing rods 3, each of which is 10 mm thick, and a circular elastomeric plate 4 made of material No. 11 in Table 1 were used.

A mold capable of compacting the powder into the above shape and having a mold structure made of a non-magnetic material except for a sidewall surface of the die 2 and a surface of an upper lid 1 opposite to a compact was disposed in a magnetic field coil 11 as illustrated in FIGS. 8 and 9. The magnetic field coil 11 and a magnetic field power source were able to generate and apply a magnetic field of some 800 kA/m at a position where the powder is filled into the die 2.

Figure 35A:
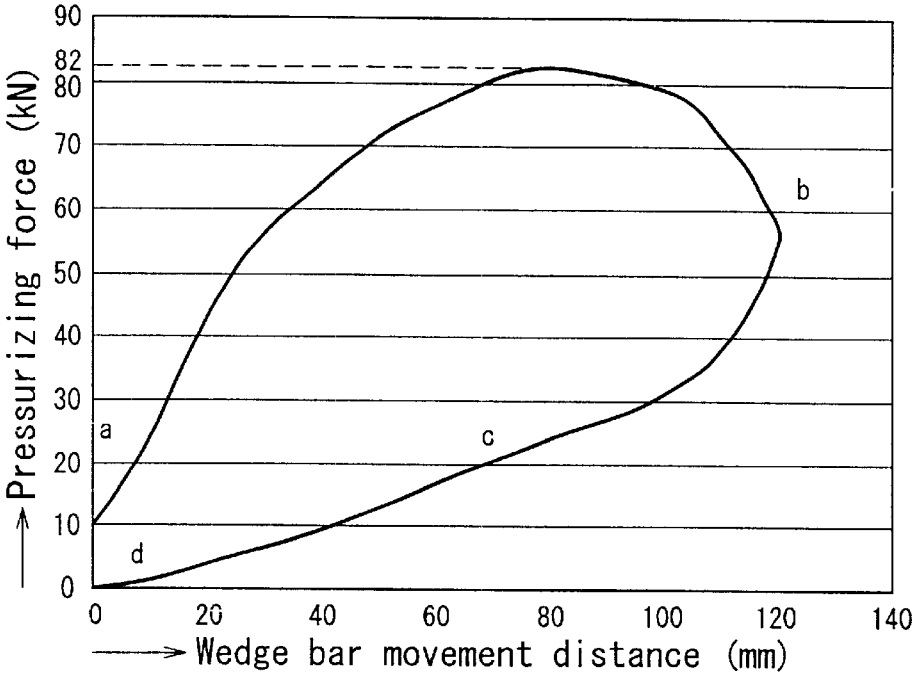
FIG. 35A is a graph, illustrating a compacting pressurizing force curve for a circular plate-shaped compact having a diameter of 120 mm.
Figure 35B:
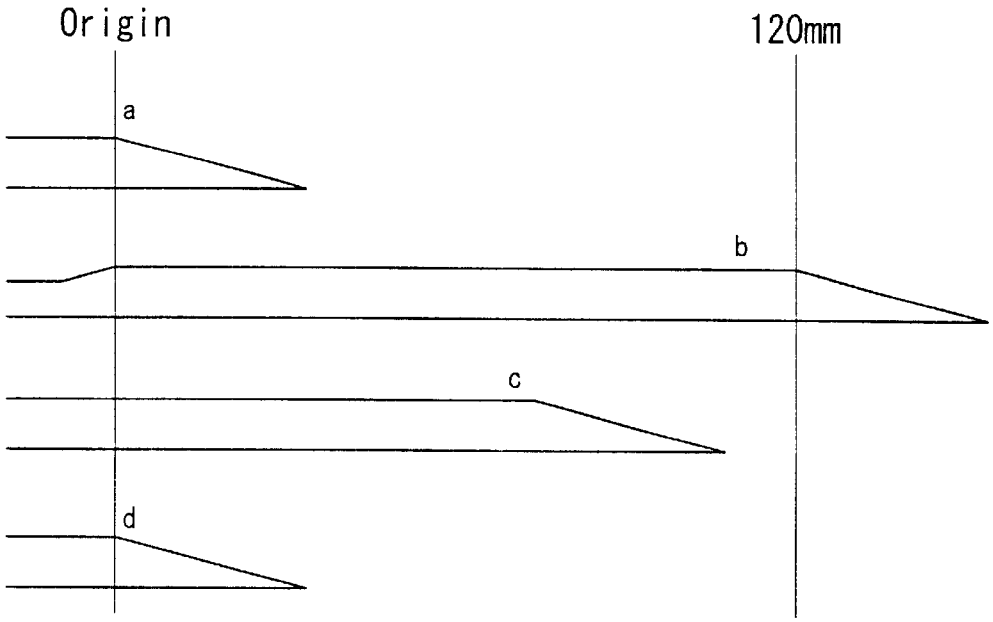
FIG. 35B is a descriptive illustration, showing respective positions of a wedge.

The twelve rods 3 and the elastomeric plate 4 as shown in FIG. 33D but fabricated to be circular were disposed in the die 2. A wedge bar 7 had a 130 mm long parallel surface 7*c* formed between first- and second-stage slanted surfaces 7*a*, 7*b*, and further had the first- and second-stage slanted surfaces inclined at angles of 8° and 6°, respectively. The die 2 was draft-tapered along an inner surface thereof to a depth of 20 mm from an upper opening of the die 2 under the same conditions as those in Example 1. The above magnetic field was continuously applied to the powder at a position where the parallel surface of the wedge bar 7 and the second-stage slanted surface 7*b* were located in the die 2. A magnetic field compact having a target density of 2.94×103 kg/m3 was yielded by the compacting according to the action diagram as shown in FIG. 7. At that time, the maximum pressurizing force in a pressurizing force curve as shown in FIG. 35 was 82 kN on an average, after tests were made ten times, for a distance of 80 mm that an inserted end of the wedge bar 7 travels. Reference characters "a"–"d" in FIG. 35 are similar to those in FIG. 34. The powder achieves a density of 2.94×103 kg/m3 under the pressure of 100 MPa. In conventional methods, this can be achieved only by the use of a compacting apparatus that has a total pressurizing force of 113 kN. Therefore, the present invention realized a considerably reduced level of a total pressurizing force, which was 7.3% of that in the conventional methods.

It has heretofore been impossible that a demand for a compact having a diameter ranging from 100 mm to some 300 mm is met by inexpensive techniques. Meanwhile, the above Examples are believed to offer a resolution to a technique and apparatus for satisfying requirements of rare earth magnets and soft-hard ferrite in application fields.

EXAMPLE 6

Sr-ferrite sintered powder was magnet field-compacted to provide a segmented compact having an projection area 40×120 mm.

The compacting according to an action diagram as shown in FIG. 7 was practiced using a mold structure as shown in FIGS. 3, 13, 14 and an apparatus as shown in FIGS. 5, 6. An upper lid 1A was provided with a slicer mechanism that was integrally combined with a magnetic field yoke of a magnetic circuit. The slicer mechanism includes four slicers 10. An elastomeric plate 4 shaped as illustrated in FIG. 33E and made of material No. 9 in Table 1 was used.

More specifically, the elastomeric plate 4 and pressurizing rods 3 were configured to have respective shapes of the elastomeric plate 4 and pointed ends of the rods 3, as illustrated in FIG. 3, in which inner/outer peripheries and length of a segmented shape are equal in dimension to 23r×19r×24 mm. Twenty-five pressurizing rods 3, each of which is 5.0 mm thick and 40.00 mm wide and which is made of a magnetic raw material, were disposed in a die 2. The die 2 includes a non-magnetic sidewall. A wedge bar 7 has a long 140 mm parallel surface 7*c* defined between first-and second-stage slanted surfaces 7*a*, 7*b*, which are both inclined at an angle of 5°. A magnetic field coil 11 extending around the above-mentioned magnetic yoke continuously applied a magnetic field to the powder at a position where the parallel surface 7*c* and the second-stage slanted surface 7*b* were located in the die 2. The compacting according to an action diagram as illustrated in FIG. 7 yielded five magnetic field compacts, each of which had a target density of 2.94×103 kg/m3.

The magnetic field coil 11 and a magnetic field power source generated and applied a magnetic field of some 800 kA/m to the powder at a position where the powder is filled into the die 2. At that time, the maximum pressurizing force in a pressurizing force curve similar to that of FIG. 34 was 34.4 kN on an average after tests were made ten times. In order to obtain such a density, a pressure of 100 MPa is required. In prior art techniques, this can be achieved only by the use of a compacting apparatus that has a total pressurizing force of 480 kN or greater. Therefore, the present invention attained a considerably reduced level of a total pressurizing force, which was 7.2% of that in the prior art techniques. The powder on the elastomeric plate 4 was not extruded into 30–170 μm gaps between the die 2 and the rods 3 after the powder compacting, and the elastomeric plate 4 was capable of continuing use.

EXAMPLE 7

Example 7 is intended to demonstrate non-magnetic field compacting in which Nd—Fe—B series compressed bond powder is molded into a 10×120×6 mm rectangular compact.

As illustrated in FIG. 16, the compressed bond powder exhibited compression characteristics including a density of 6.1×103 kg/m3 under a pressure of 1100 MPa, in which the density gradually increases when a pressure of 800 MPa is achieved. Fifteen pressurizing rods 3 (8 mm thick and 10 mm wide) were arranged in a die 2 having a mold structure as shown in FIG. 1. There were provided 170 μm or smaller gaps between an internal surface of the die 2 and the rods 3. An elastomeric plate 4 shaped as illustrated in FIG. 33D and made of material No. 2 in Table 1 was used.

he mold was secured to an apparatus as shown in FIGS. 8 and 9, and then the filled powder was pressurized by means of a wedge bar 7 having a surface slanted at an angle of 8°. As a result, the powder on the elastomeric plate 4 was partially extruded into the gaps between the internal surface of the die 2 and the rods 3. This can be believed that a extrusion restorable pressure range was reduced because the elastomeric plate 4 was required to be rendered elongated under the maximum pressure according to differences in stage between the rods 3 disposed on the slanted surface of the wedge bar 7. In order to overcome such an inconvenience, the surface of the wedge bar 7 was slanted at 5°, not 8°, while a target compacting density was reduced to be 5.95×103 kg/m3 under the pressure of 1000 MPa. As a result, no extrusion was ascertained to occur. At that time, the maximum pressurized force was 355 kN, which was 15.4% of a total pressurizing force of 1200 kN in conventional techniques.

The method and apparatus innovation provided by the above-described new mold structure and compacting apparatus is believed to make a considerable contribution in the field of powder compacting toward a cost reduction, an energy saving, a space saving, and automation.

In the present invention, addition of a liquid suction mechanism to the upper lid 1 allows the above-described compacting apparatus to be easily used as a wet pressing. For production of metallic powder and, in particular, a rare earth magnet, such a compacting apparatus facilitates avoiding oxidation of the powder in a compacting line.

The present invention may be applicable in practice to compacting in the field of magnetic materials and magnets in order to temporarily sinter such materials when these materials are produced, and further may be applicable to manufacturing lines for a radio wave absorbent, various soft ferrite materials for use in transformers, various segmented magnets for use in motors, a compressed bond magnets for use in copier and printer magloire, a sintered ferrite magnet, and a VCM magnet for HDD as an example of a rare earth magnet. In addition, the present invention finds wide application in manufacturing lines for dielectrics, insulations, and various alloy components provided by powder metallurgy.

In the present invention, a direction in which the magnetic field is applied to a molding container is not limited to vertical and horizontal directions.

What is claimed is:

1. A powder-compacting method, comprising the steps of: filling powder to be pressurized into a molding container; and, individually pressing a plurality of pressurizing members in sequence toward the powder, the pressurizing members being aligned on a pressurized surface of the powder through an elastic plate.

2. A powder-compacting apparatus, comprising: a molding container having a plurality of pressurizing members disposed on a bottom of the molding container, and further having an elastic plate disposed on the pressurizing members as a bottom surface, wherein the plurality of pressurizing members are sequentially driven to pressurize powder via the elastic plate for compacting.

3. A powder-compacting apparatus, comprising: a molding container having a bottom, the container having a powder-filled opening formed at an upper portion thereof and a wedge-inserted hole defined through a sidewall of the container; a plurality of pressurizing members aligned on a bottom plate of the molding container; an elastic plate disposed on the plurality of pressurizing members for providing a bottom surface of the powder when the powder is filled into the molding container through the powder-filled opening; a lid body for closing the powder-filled opening; and, a wedge inserted into the molding container through the wedge-inserted hole, the wedge being pushed along the bottom plate into between an inner surface of the bottom plate and the pressurizing members, thereby permitting the plurality of pressurizing members to sequentially pressurize the powder via the elastic plate for compacting.

4. A powder-compacting apparatus as defined in claim 3, wherein at least the lid body and compacting surfaces of the pressurizing members contiguous with the elastic plate are curvilinear in shape in order to allow the compact to be formed into one of a pillar shape, substantially semi-pillar shape, substantially semi-cylindrical shape, partially cylindrical shape.

5. A powder-compacting apparatus as defined in claim 3, wherein the wedge includes a slanted surface for raising the pressurizing members and a planar surface continuously extending from the slanted surface for retaining the pressurizing members at a position where the pressurizing members are raised.

6. A powder-compacting apparatus as defined in claim 3, wherein the molding container has an inner peripheral surface tapered at the powder-filled opening so as to expand outward.

7. A powder-compacting apparatus as defined in claims 3, 4, or 5, wherein the upper lid serves as a magnetic field yoke, the magnetic field yoke having a coil wound therearound in order to vertically generate a magnetic field in the molding container.

8. A powder-compacting apparatus as defined in claims 3, 4, or 5, wherein a coil is trained around the molding container in order to generate a magnetic field in the molding container in a direction in which the wedge is advanced and retracted.

9. A powder-compacting apparatus as defined in claim 3, wherein the molding container includes one of a plurality of the same compacting sections and a plurality of different compacting sections, and wherein the wedge, elastic plate, and pressurizing members are provided so as to correspond with the compacting sections, the wedge having a proximal end combined together.

10. A powder-compacting apparatus as defined in claim 5, wherein the wedge has the slanted surface and the planar surface continuously extending therebetween in a stepwise manner so as to form a several stage construction.

11. A powder-compacting apparatus as defined in claim 3, wherein the molding container includes a core for forming a hollow in the compact, and wherein the pressurizing members and the wedge are both configured to avoid the core.

12. A powder-compacting apparatus as defined in claim 3 or 11, wherein the lid body is provided with a slicer that protrudes into the molding container for dividing a compact during powder compacting.

13. A powder-compacting apparatus as defined in claim 3, wherein the pressurizing member includes a plurality of concentric cylinders, the wedge including a V-shaped pointed end, the wedge having a plurality of slanted surfaces formed along an inner surface of the V-shaped pointed end for sequentially raising the pressurizing members.

14. A powder-compacting apparatus as defined in claim 3, wherein the pressurizing member is defined with a convex surface at an upper end thereof, while the elastic member is formed with a concave surface to be engaged with the convex surface of the pressurizing member.

15. A powder-compacting apparatus as defined in claim 2, further comprising: an upper lid-lifting apparatus for raising and lowering an upper lid for closing an upper opening of the molding container; a discharging apparatus spaced apart from the upper lid-lifting apparatus for discharging a compact out of the molding container; a delivering means for reciprocably delivering the molding container between the upper lid-lifting apparatus and the discharging apparatus; a filling apparatus disposed between the upper lid-lifting apparatus and the discharging apparatus for filling the next pack of powder to be compacted into the molding container through the upper opening of the molding container after the discharging apparatus discharges the compact out of the molding container; and, a wedge-driving means for permitting a wedge for sequentially driving the pressurizing members to be inserted into the molding container after the upper lid-lifting apparatus closes the upper opening of the molding container.

16. A powder-compacting apparatus as defined in claim 15, wherein the wedge-driving means moves the wedge in a direction identical to a direction in which the molding container is moved.

17. A powder-compacting apparatus as defined in claim 2, further comprising: a driving apparatus including an upper lid for closing an upper opening of the molding container and a powder-filling apparatus for filling powder into the molding container through the upper opening, the driving apparatus permitting a combination of the upper lid and the powder-filling apparatus to be individually moved to a position above the upper opening; a wedge-driving apparatus including a wedge inserted between the pressurizing members and a bottom of the molding container for permitting the pressurizing members to pressurize the powder via the elastic plate, the wedge-driving means designed to insert and retract the wedge; and, a discharging apparatus for raising the bottom of the molding container to discharge a compact out of the molding container through the upper opening after the wedge is pulled out of the molding container, the bottom of the molding container being free to rise and lower, wherein the driving means permits a pointed end of the upper lid to push the compact to a position where a product is discharged, while causing the powder-filling apparatus to be positioned above the upper opening.

18. A powder-compacting apparatus as defined in claim 3 or 17, wherein the wedge includes a plurality of laminated components, each of which is individually driven by a driving means.

19. A powder-compacting apparatus as defined in claim 2, further comprising: a magnetic field coil, in which the molding container is inserted; an upper lid attachment-detachment apparatus disposed adjacent to the magnetic field coil for attaching and detaching an upper lid that closes an upper opening of the molding container; a discharging apparatus disposed on the side opposite to the upper lid attachment-detachment apparatus for discharging a compact out of the molding container; a delivering means for reciprocably delivering the molding container between the magnetic field coil and the discharging apparatus; a filling apparatus disposed between the upper lid attachment-detachment apparatus and the discharging apparatus for filling the next pack of powder to be compacted into the molding container through the upper opening of the molding container after the discharging apparatus discharges the compact out of the molding container; and, a wedge-driving means disposed on the side opposite to the upper lid attachment-detachment apparatus, the wedge-driving means including a wedge for sequentially driving the pressurizing members while the upper lid attachment-detachment apparatus closes the opening of the molding container and the molding container is positioned in the magnetic field coil, the wedge-driving means being designed to insert the wedge into the molding container.

20. A powder-compacting apparatus as defined in claim 15, 17 or 19, wherein the powder-compacting apparatus are aligned longitudinally and transversely, and wherein the powder-compacting apparatus share a common material powder tank.

21. A powder-compacting apparatus as defined in claim 3, wherein inert gases are hermetically sealed up within the powder-compacting apparatus.

22. A powder-compacting apparatus as defined in claim 8, wherein the powder-compacting apparatus are aligned longitudinally and transversely, and wherein the powder-compacting apparatus share a common material powder tank.

23. A powder-compacting apparatus as defined in claim 20, wherein inert gases are hermetically sealed up within the powder-compacting apparatus.

24. A powder-compacting apparatus as defined in claim 8, wherein inert gases are hermetically sealed up within the powder-compacting apparatus.

* * * * *